US009620096B2

(12) United States Patent
Ambrosino

(10) Patent No.: US 9,620,096 B2
(45) Date of Patent: Apr. 11, 2017

(54) ILLUMINATED POTENTIOMETER ASSEMBLY

(71) Applicant: AMBROSONICS, LLC, Windsor, CT (US)

(72) Inventor: Eric Ambrosino, Windsor, CT (US)

(73) Assignee: AMBROSONICS, LLC, Windsor, CT (US)

( * ) Notice: Subject to any disclaimer, the term of this patent is extended or adjusted under 35 U.S.C. 154(b) by 0 days.

(21) Appl. No.: 14/310,439

(22) Filed: Jun. 20, 2014

(65) Prior Publication Data

US 2014/0298977 A1 Oct. 9, 2014

Related U.S. Application Data

(62) Division of application No. 13/183,084, filed on Jul. 14, 2011, now Pat. No. 8,796,531.

(60) Provisional application No. 61/364,676, filed on Jul. 15, 2010.

(51) Int. Cl.

| | |
|---|---|
| ***G10H 3/06*** | (2006.01) |
| ***G10H 3/14*** | (2006.01) |
| ***G10H 3/18*** | (2006.01) |

(52) U.S. Cl.

CPC ..... *G10H 3/06* (2013.01); *G10H 3/143* (2013.01); *G10H 3/183* (2013.01); *G10H 3/186* (2013.01)

(58) Field of Classification Search

CPC ..... F21Y 2113/005; F21Y 2111/005; F21Y 2103/00; F21Y 2103/022; F21Y 2105/003; F21Y 2111/00; F21Y 2111/004; F21Y 2113/002; F21Y 2113/007; H05B 41/392; H05B 33/0824; G10H 1/46; G10H 1/348; G10H 1/34; G10H 2220/061; G10H 2210/381

See application file for complete search history.

(56) References Cited

U.S. PATENT DOCUMENTS

| | | | |
|---|---|---|---|
| 3,915,048 | A | 10/1975 | Stich |
| 4,080,867 | A | 3/1978 | Ratanangsu |
| 4,175,462 | A | 11/1979 | Simon |
| 4,305,320 | A | 12/1981 | Peavey |
| 4,336,734 | A | 6/1982 | Polson |
| 4,339,979 | A | 7/1982 | Norman |

(Continued)

FOREIGN PATENT DOCUMENTS

| | | | |
|---|---|---|---|
| CA | 2 372 014 | A1 | 8/2003 |
| GB | 2 207 542 | A | 2/1989 |
| WO | 2004/008428 | A2 | 1/2004 |

*Primary Examiner* — Marlon Fletcher
(74) *Attorney, Agent, or Firm* — Greenblum & Bernstein, P.L.C.

(57) ABSTRACT

A programmable pickup director switching system for a musical instrument having a plurality of pickup coils and a pickup director control board communicatively interconnected to the plurality of pickup coils. The system also includes a push/pull potentiometer structured and arranged to activate different combinations of one or more of the plurality of pickup coils, a main multi-position switch having m positions, and a bank select switch having n positions. Additionally, the system includes a switching matrix configured to switch one or more of the plurality of pickup coils into a signal path based on a position of at least one of the main multi-position switch, the bank select switch and the push/pull potentiometer.

17 Claims, 27 Drawing Sheets

(56) References Cited

U.S. PATENT DOCUMENTS

| | | | | |
|---|---|---|---|---|
| 4,480,520 | A | 11/1984 | Gold | |
| 4,658,690 | A | 4/1987 | Aitken et al. | |
| 4,704,941 | A | 11/1987 | Reilly | |
| 4,711,149 | A | 12/1987 | Starr | |
| 4,817,486 | A | 4/1989 | Saunders | |
| 5,024,134 | A | 6/1991 | Uchiyama | |
| 5,051,799 | A | 9/1991 | Paul et al. | |
| 5,136,918 | A | 8/1992 | Riboloff | |
| 5,136,919 | A | 8/1992 | Wolstein | |
| 5,245,128 | A | 9/1993 | Araiza | |
| 5,270,475 | A | 12/1993 | Weiss et al. | |
| 5,311,806 | A | 5/1994 | Riboloff | |
| 5,339,275 | A | 8/1994 | Hyatt | |
| 5,700,966 | A | 12/1997 | LaMarra | |
| 5,763,808 | A | 6/1998 | Thomson | |
| 5,780,760 | A | 7/1998 | Riboloff | |
| 5,789,689 | A | 8/1998 | Doidic et al. | |
| 5,834,671 | A | 11/1998 | Phoenix | |
| 5,837,912 | A | 11/1998 | Eagen | |
| 5,866,834 | A | 2/1999 | Burke et al. | |
| 5,932,827 | A | 8/1999 | Osborne et al. | |
| 6,034,316 | A | 3/2000 | Hoover | |
| 6,121,537 | A | 9/2000 | Pawar et al. | |
| 6,253,654 | B1 | 7/2001 | Mercurio | |
| 6,316,713 | B1 | 11/2001 | Furst et al. | |
| 6,353,169 | B1 | 3/2002 | Juszkiewicz et al. | |
| 6,686,530 | B2 | 2/2004 | Juszkiewicz et al. | |
| 6,781,050 | B2 | 8/2004 | Olvera et al. | |
| 6,787,690 | B1 | 9/2004 | Celi et al. | |
| 7,115,810 | B2 | 10/2006 | Ambrosino | |
| 7,276,657 | B2 | 10/2007 | Bro et al. | |
| 7,279,631 | B2 | 10/2007 | Celi et al. | |
| 7,601,908 | B2 | 10/2009 | Ambrosino | |
| 9,168,335 | B2 * | 10/2015 | Neer | A61M 5/007 |
| 2003/0145715 | A1 | 8/2003 | Wnorowski | |
| 2004/0003709 | A1 | 1/2004 | Kinman | |
| 2004/0069127 | A1 | 4/2004 | Ludwig | |
| 2004/0107822 | A1 | 6/2004 | Olvera et al. | |
| 2004/0168566 | A1 | 9/2004 | Juszkiewicz et al. | |
| 2005/0087063 | A1 | 4/2005 | Bryce | |
| 2005/0150364 | A1 | 7/2005 | Krozack et al. | |
| 2005/0211081 | A1 | 9/2005 | Bro et al. | |
| 2006/0011051 | A1 | 1/2006 | Aivbrosino | |
| 2006/0079765 | A1 * | 4/2006 | Neer | A61M 5/007 600/432 |
| 2007/0180976 | A1 * | 8/2007 | Demsey | G10H 1/40 84/315 |
| 2012/0024129 | A1 | 2/2012 | Ball et al. | |
| 2012/0036983 | A1 * | 2/2012 | Ambrosino | G10H 3/143 84/731 |

* cited by examiner

Pickup Director and Sonic Glow POTs

Pickup Director and Simple Menu Display

Pickup Director with Backlit Light Pipe or Transparent Screws Display

Pickup Director with Two Seven Segment LED Display

Pickguards with related Pickup Director options and Sonic Glow POTs for installation on existing Guitars

1305

1405

1715

1710

1705

ILLUMINATED POTENTIOMETER ASSEMBLY

CROSS REFERENCE TO RELATED APPLICATIONS

The present application is a divisional of U.S. patent application Ser. No. 13/183,084, filed on Jul. 14, 2011, which claims the benefit of U.S. Provisional Application No. 61/364,676 filed on Jul. 15, 2010, the disclosures of which are expressly incorporated by reference herein in their entireties.

BACKGROUND OF THE INVENTION

1. Field of the Invention

The present invention relates generally to switching systems, display systems, control knob display systems and human touch control indicators for musical instruments. The invention particularly lends itself to programmable pickup, sensor or transducer switching where a selection of multiple pickups, sensors or transducers are used on musical instruments to provide different sounds.

2. Description of the Related Art

Electric guitars and other electric instruments typically provide one or more pickups that "pickup" vibrations of the steel strings within the electro-magnetic field or pole of the pickup system to produce an electric signal output when the steel strings are moving while being played. Likewise, transducers (e.g., piezo transducers) that reside under a bridge saddle or under each individual string saddle provide amplification for nylon string type instruments or allow for an acoustic type sound of instruments with steel strings employing transducers in addition to the magnetic pickups.

Many types of pickups and transducers exist and each produce specific tone and timbre qualities depending, for example, on the location where these pickups are placed under the strings, amongst other variables. Depending on the type of pickup configurations, the instrument can produce even more unique tones and timbre sound qualities. The electric signals produced by the plurality of pickup locations and pickup types are sent to an amplifier or recording device through which the instrument's sound can be heard. Many switching schemes and systems provide different combinations for when the pickups are on (and actively producing sound) or off and not producing sound. That is, switching systems allow a musician to change, in real time, the sound of his/her musical instrument during a musical performance at times of their discretion. Prior art switching or selection systems, however, do not provide for full combinatorial combinations of pickup selections of series pickups, parallel pickups and series and parallel combinations of pickups used to create new instrument sounds and tones. Furthermore, the prior art does not provide a method for quick, convenient switching of selection of pickups in a way conducive to real time live performance or in recording situations nor do they provide for display options indicating the modes of operation the pickups are in for each sound.

Therefore, a need exists for programmable pickup, sensor and transducer switching systems with display options for the selection of multiple pickups, sensors and transducers for musical instruments, that enables programming with great ease (for example, even while in live and real time performance), and provides many combinations of pickup selections ranging in multiple pickup sounds, such as, for example, three to over one hundred and fifty, single coil, parallel coil and single coil mixed with humbucking configurations and/or piezo type transducers.

SUMMARY OF THE INVENTION

In embodiments of the present invention, a Pickup Director provides a fully programmable pickup switching and display system that can be used with great ease in live or studio performances. In embodiments, the programmable Pickup Director switching system includes a control logic printed circuit board (PCB), a plurality of switches communicatively interconnected to the control logic PCB, a switch matrix communicatively interconnected to the control logic PCB, and optional display systems communicatively interconnected to the control logic PCB. In embodiments, the display system may include at least one transparent fastening screw or a light pipe next to the pickup with an associated light emitting diode (LED) or LEDs on a side of single coil or humbucking pickup, pickup covers, and enclosures on or around a pickup retaining ring surrounding a pickup that is configured to provide a visual indication of any associated pickup activity.

In embodiments, the present invention also offers many display options for backlighting, for example, the volume, tone, bass, treble and/or middle equalization controls through the use of illuminated LED potentiometers (or POTs). These light-up POTS allow easy viewing of where the controls are set while on stage during low stage lighting levels. Likewise, the transparent pickup fastening screws with backlighting indicate which pickups are on or off and which modes (series or parallel or a combination of series/parallel) they are operating in by use of multi-colors. In embodiments, the fastening screws can be replaced with traditional mounting hardware and the use of light pipe installed next to the mounting screws for an easier form of installation. The number of pickup sounds or tones can be displayed with an optional two digit seven segment display module that can be installed in the instrument or on a small display box attached to the instrument using a cable.

In further embodiments, at least one potentiometer configured for volume control contains a translucent shaft backlit directly or indirectly by LED's mounted to a printed circuit board and placed under the translucent shaft or from LED's mounted to an additional printed circuit board contained within the translucent shaft illuminating the volume control shaft and knob itself.

Additionally, in embodiments, at least one potentiometer configured for tone control contains a translucent shaft backlit directly or indirectly by LED's mounted to a printed circuit board and placed under the translucent shaft or from LED's mounted to an additional printed circuit board contained within the translucent shaft illuminating the tone control shaft and knob itself.

According to further aspects of the invention, a programmable pickup switching system comprises a control printed circuit board; a plurality of switches communicatively interconnected to the control printed circuit board, a plurality of switches communicatively interconnected within the switching system, the plurality of switches including a multi-pole, double-throw bank switch; a tip, ring and sleeve output jack communicatively interconnected within the switching system for providing power; and/or a battery voltage source communicatively interconnected within the switching system to provide power to the visual indication of associated controls, illuminated POTs, touch sensitive control/indicators or Two Digit LED display modules in the switching system.

Additionally, in embodiments, at least one potentiometer configured for volume control contains a vertically mounted PCB containing at least one of six LEDs, which is mounted to a main horizontal PCB providing support and power connections to the vertical mounted PCB. The two printed circuit boards, vertical and horizontal, now mated together as a single assembly, are then inserted into a potentiometer with a hollow translucent shaft to backlight the translucent shaft and any clear, translucent, or opaque control knob pushed onto or fastened to the translucent shaft.

In further embodiments, at least one potentiometer configured for tone control contains a vertical mounted PCB having a least one of six LEDs, which is mounted to a main horizontal PCB providing support and power connections to the vertical mounted PCB. The two printed circuit boards, vertical and horizontal, now mated together as a single assembly, are then inserted into a potentiometer with a hollow translucent shaft to backlight the translucent shaft and any clear, translucent, or opaque control knob pushed onto or fastened to the translucent shaft.

Additionally, in embodiments, at least one potentiometer configured for volume control contains a horizontal PCB containing a least one LED that aligns under a potentiometer with a hollow translucent shaft thereby lighting up the shaft and any clear, translucent, or opaque control knob pushed onto or fastened to the translucent shaft.

Furthermore, in embodiments, at least one potentiometer configured for tone control containing a horizontal PCB containing a least one LED that aligns under a potentiometer with a hollow translucent shaft thereby lighting up the shaft and any clear, translucent, or opaque control knob pushed onto or fastened to the translucent shaft.

According to further aspects of the invention, a pickup switching system comprises a plurality of control printed circuit boards; a plurality of potentiometers communicatively interconnected to the control printed circuit boards, the plurality of potentiometers including potentiometers with hollow translucent shafts providing control of volume and tone; a plurality of switches communicatively interconnected within the switching system, the plurality of switches including a three position switch; a tip, ring and sleeve output jack communicatively interconnected within the switching system; and a battery voltage source communicatively interconnected within the switching system to provide power to the visual indication of associated controls in the switching system.

According to further aspects of the invention, the Pickup Director can be configured with a touch sensitive system including one or more touch sensitive indicators/controllers that respond to the human touch. Control outputs then turn on or off different pickup selections of the pickups and backlight the touch surface light pipe with the same or different LED colors. When one of the touch sensors are touched, a discrete output control line toggles and is available to control the on/off status of a pickup and also lights the LED that is under the light pipe touch surface to provide indication on the control surface. Likewise, these outputs can be used in conjunction with a wireless transceiver module that sends switch commands wirelessly to a corresponding transceiver on stage to control an amplifier's control modes, for example. In embodiments, the touch sensitive system can also drive effects pedals on or off or other electronics from the musical instrument according to the present invention. In an exemplary embodiment, there are five control/indicators that reside in the lower horn of an electric guitar of form Stratocaster. The touch system technology itself supports, and the inventor contemplates, for example, from one to eight control touch sensors/indicators within this exemplary electrical design and according to aspects of the present invention.

In embodiments, a programmable pickup director switching system for a musical instrument comprises a plurality of pickup coils, a pickup director control board communicatively interconnected to the plurality of pickup coils, and a push/pull potentiometer structured and arranged to activate different combinations of one or more of the plurality of pickup coils. The system also includes a main multi-position switch having m positions, a bank select switch having n positions and a switching matrix configured to switch one or more of the plurality of pickup coils into a signal path based on a position of at least one of the main multi-position switch and the bank select switch or a position of the push/pull potentiometer.

In embodiments, the push/pull potentiometer in a first position is structured and arranged to activate available selections or combinations of one or more of the plurality of pickup coils.

In embodiments, the push/pull control potentiometer, when moved from the first position to a second position, is configured to store a selected pickup selection or combination in a storage location designated by the relative positions of the multi-position switch and bank select switch.

In further embodiments, the main multi-position switch and the bank select switch are structured and arranged to activate stored selections or combinations of one or more of the plurality of pickup coils.

In additional embodiments, the plurality of pickup coils comprise one of: three single coil pickups, one humbucking pickup and two single coil pickups, one 4-wire humbucking pickup and two single coil pickups, two 4-wire humbucking pickups, two 4-wire humbucking pickups and one single coil pickup, and four single coil pickups.

In embodiments, at least one illuminated potentiometer is configured as at least one of a volume control knob and a tone control knob and structured and arranged to illuminate at least one of numbers and patterns on the control knob.

In further embodiments, the pickup director control board is communicatively interconnected to the main multi-position switch having m positions and the bank select switch having n positions, wherein the bank select switch is configured to multiply the m positions of the main multi-position switch by the n positions of the bank select switch to provide n×m pickup configuration storage locations.

In additional embodiments, a pickup composer software code is tangibly embodied on a storage medium and operable to alter a total number of different pickup selections and combinations and the different pickup selections and combinations afforded by a pickup configuration of the musical instrument.

In further embodiments, the push/pull potentiometer, when in the second position, is configured to adjust another parameter for the musical instrument.

In embodiments, the relative positions of the multi-position switch and the bank select switch are operable to select a stored pickup configuration when the push/pull potentiometer is in the second position.

In embodiments, two backlit LED light pipes are communicatively interconnected with the pickup director control board, wherein the two backlit LED light pipes are structured and arranged to alternately toggle between themselves upon a change in pickup selection actuated by rotation of the push/pull potentiometer in the first position.

In additional embodiments, the pickup director switching system further comprises internal firmware, and a control port structured and arranged for re-programming of the internal firmware.

In further embodiments, the system includes at least one of a transparent fastening screw and a lightpipe, backlit by an LED and located adjacent to at least one of the pickup coils, wherein the pickup director control board is communicatively interconnected to the LED to indicate operation of the at least one of the pickup coils.

In embodiments, at least two transparent fastening screws or two lightpipes backlit by different color LEDs are structured and arranged adjacent at least one of the plurality of pickup coils, wherein the pickup director control board is communicatively interconnected to the different color LEDs to indicate one of parallel, series and parallel series wiring for the at least one of the plurality of pickup coils.

In additional embodiments, the pickup director switching system is re-scalable to configure a number of pickup configuration selection positions of the push/pull control potentiometer.

In further embodiments, an LED alphanumeric display is configured to indicate a selected pickup configuration.

In embodiments, at least one touch sensitive control is configured to activate a pickup coil of the plurality of pickup coils.

In additional embodiments, the pickup director control board comprises a micro-controller.

In further embodiments, the push/pull potentiometer is configured to activate different stored equalization settings.

In embodiments, the system includes at least one touch sensitive control and a wireless transceiver, wherein the at least one touch sensitive control is configured to control one or more parameters of a device connected via the wireless transceiver.

In additional embodiments, the system includes at least one piezo pickup, wherein the push/pull potentiometer is configured to activate different combinations of one or more of the plurality of pickup coils and the at least one piezo pickup.

In further embodiments, an illuminated potentiometer is configured as at least one of a volume control knob and a tone control knob. The illuminated potentiometer includes a potentiometer, a translucent shaft extending from the potentiometer, at least one light emitting diode (LED), and a control knob. The at least one LED is structured and arranged to project illumination via translucent shaft to the control knob to illuminate the control knob.

In embodiments, the potentiometer is configured as a passive controller.

In additional embodiments, the potentiometer is configured as an active controller.

In embodiments, the pickup director switching system further comprises a remote powered system operable to power at least one of: the pickup director control board; an illuminated potentiometer; a touch sensitive system; a display system; and a pre-amplifier.

In further embodiments, a pickup director switching system for a musical instrument includes a plurality of pickup coils, a touch sensitive control system comprising at least one touch sensitive controller/indicator, and a push/pull potentiometer configured to activate a touch sensitivity of the touch sensitive control system when in a first position. The at least touch sensitive controller/indicator is configured to at least one of: activate or deactivate a respective pickup coil of a plurality of pickup coils upon activation of the touch sensitive controller/indicator, and visually indicate an active/deactive status of the respective pickup coil; and activate, deactivate or control one or more parameters of a device connected via a wireless transceiver upon activation of the touch sensitive controller/indicator, and visually indicate an active/deactive status of the device or the one or more parameters.

In embodiments, a programmable pickup director switching system is for a musical instrument comprising a plurality of pickup coils. The switching system includes a pickup director control board structured and arranged for communicative interconnection to the plurality of pickup coils, a push/pull potentiometer structured and arranged to activate different combinations of one or more of the plurality of pickup coils. Also, the system includes a main multi-position switch having m positions, a bank select switch having n positions and a switching matrix configured to switch one or more of the plurality of pickup coils into a signal path based on a position of at least one of the main multi-position switch and the bank select switch or a position of the push/pull potentiometer.

In additional embodiments, a remote powered system for a musical instrument comprises a tip-ring-sleeve cable having three signal paths and comprising a first connector and a second connector and an AC to DC power adaptor structured and arranged to supply power to a first signal path of the three signal paths. A second signal path of the three signal paths is configured for an instrument signal, and a third signal path of the three signal paths is configured for a ground signal.

In further embodiments, the remote powered system is operable to power via the first signal path at least one of: the pickup director control board; an illuminated potentiometer; a touch sensitive system; a display system; and a pre-amplifier.

In embodiments, a method of using a programmable pickup director switching system for a musical instrument having a plurality of pickup coils comprises moving a push/pull potentiometer from a second position to a first position to activate a pickup configuration selection mode of the switching system, and rotating the push/pull potentiometer to activate a selected pickup configuration amongst a plurality of different pickup configurations comprising selections or combinations of one or more of the plurality of pickup coils. The method further comprises moving the push/pull potentiometer from the first position to the second position to activate a pickup configuration storing mode of the switching system, wherein the selected pickup configuration is stored in a particular memory bank location of a memory device.

In additional embodiments, the method further comprises selecting the particular memory bank location using least one of a main multi-position switch and a bank select switch.

In additional embodiments, the method further comprises using a touch sensitive control system comprising at least one touch sensitive controller/indicator to at least one of: activate or deactivate a respective pickup coil of a plurality of pickup coils upon activation of the touch sensitive controller/indicator, and visually indicate an active/deactive status of the respective pickup coil; and activate, deactivate or control one or more parameters of a device connected via a wireless transceiver upon activation of the touch sensitive controller/indicator, and visually indicate an active/deactive status of the device or the one or more parameters.

In additional embodiments, the method further comprises retrofitting the instrument with the programmable pickup director switching system.

BRIEF DESCRIPTION OF THE DRAWINGS

Similar reference characters denote corresponding features consistently throughout the attached drawings.

DETAILED DESCRIPTION OF THE INVENTION

Figure 1:
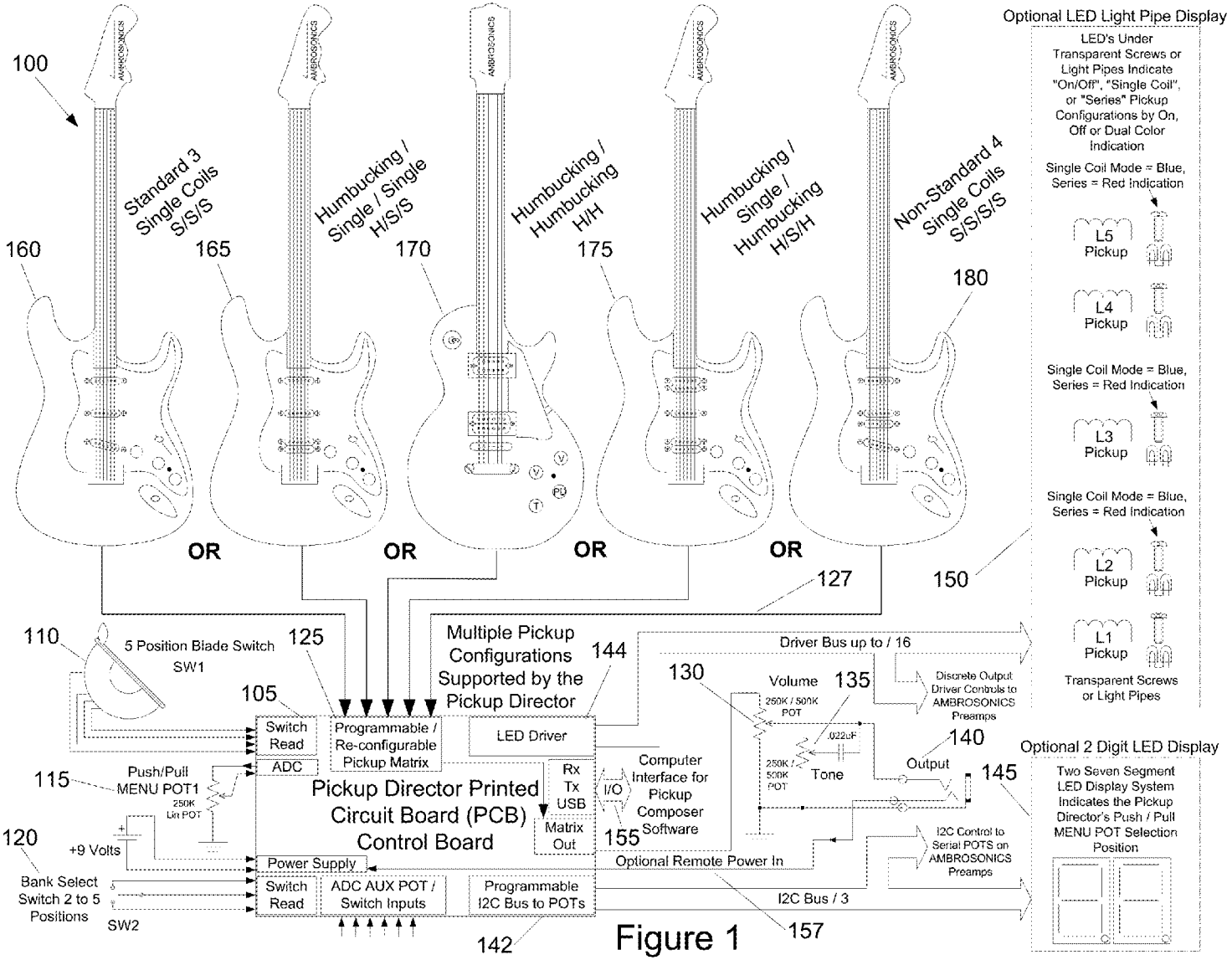
FIG. 1 illustrates an exemplary programmable Pickup Director switching system showing the present invention's applications across several different instrument and pickup configurations with optional display systems according to aspects of the present invention.

The present invention relates to a fully programmable Pickup Director switching system. The invention disclosed herein is, of course, susceptible of embodiment in many different forms. Shown in the drawings and described herein below in detail are exemplary embodiments of the invention. It is to be understood, however, that the present disclosure is an exemplification of the principles of the invention and does not limit the invention to the illustrated embodiments.

Pick-Up Switching System

Referring now to the drawings, FIG. 1 shows a Pickup Director pickup switching system 100 with display options and across several different instrument and pickup configurations according to aspects of the present invention. The system is designed to increase the number of pickup sounds yet simplify the selection, by a musician, of multiple pickups and transducers for musical instruments. The system is configured for use with any type of stringed musical instrument with pickups, such as an electric guitar, electric bass guitar or the like. In embodiments, the system is configured for use with electric guitars, acoustic/electric guitars, or electric bass guitars employing, for example, from three to five electro-magnetic pickups (or coils), transducers, or a mixture of piezo and electro-magnetic pickups for the production of an instrument's sound quality and output characteristics. Pickup switching systems are also discussed in U.S. Pat. Nos. 7,115,810 and 7,601,908, the disclosures of which are incorporated herein in their entireties.

As shown in FIG. 1, in embodiments, the system 100 includes a control (or control board) 105, a guitar selector switch 110, a two or three position bank select switch 120, a menu push/pull potentiometer (POT) 115 communicatively connected to the control 105 and a pickup switch matrix 125 communicatively connected to the guitar's pickups. In embodiments, the control 105 is configured as an integral control logic board and is communicatively interconnected throughout the system. In embodiments, the control 105 can also be communicatively connected to one or more optional display systems depending on, for example, the application and type of electric guitar or bass guitar. With an exemplary embodiment, the display options include an I2C serial bus 142 that can drive an associated LED Driver Integrated Circuit (IC) 145 to then drive LED segments. Also, a Driver bus 144 capable of driving up to, for example, sixteen discrete output drivers can drive standard or multicolor LEDs 150 directly. In embodiments, the optional display systems 145, 150 are communicatively interconnected to the control 105 to provide an indication or display system to indicate the on or off status of each particular pickup, pickup mode or system status. In embodiments, the system further includes a computer interface 155, a volume potentiometer 130 and a tone potentiometer 135.

In embodiments, the guitar selector switch 110 is a pickup selector switch, for example, a five position blade switch or the like, and is read by the control 105 to then select a particular pickup or combination of pickups in order to achieve a desired sound via the programmable pickup matrix 125. The switch 110 may be configured as any type of switch, such as, for example, a slide switch, toggle switch, rotary multiple position selector switch, three position on/on/on switch etc. When attached to a small printed circuit board (PCB), the switch 110 can replace an existing five position switch and be located within a guitar, e.g., a FENDER® STRATOCASTOR® type guitar (amongst other contemplated types and styles of guitars) with very minimal, and in some cases no need for any additional drilling or routering. (Fender and Stratocastor are registered trademarks of Fender Musical Instruments Corporation in the United States and other countries.) In embodiments, the MENU push/pull potentiometer 115 is a rotary potentiometer with an integral push/pull switch for setting and/or selecting parameters. Further, in embodiments, when the Push/Pull POT 115 is in the "Pulled" up position the POT Menu is active and allows auditioning of the many different pickup configurations and sounds to choose from. When the Push/Pull POT switch 115 is "Pushed" down the setting is stored and the current MENU selection is saved for instant recall using the guitar selector switch 110. The Pickup Director control board 105 may reside in an electric guitar of Stratocaster-type guitar, for example, by replacing the tone control in the center position of the Stratocaster-type guitar (e.g., the second tone control position).

In embodiments, the bank select switch 120 may be, for example, a micro-sized or standard sized three-position switch common in the arts. In embodiments, the switch 120 can be used for BANK selection in groups of five (due to the exemplary five position guitar select switch 110) for three by five selections of fifteen preprogrammed pickup combinations and/or single coil or humbucking type configurations. Alternatively, for example, in embodiments, the three-position switch 120 may be replaced with a five-position switch for five by five or twenty five user programmable selections of pickup combinations of single coil and humbucking type configurations for recall, for example, during real-time performance.

Figure 5:
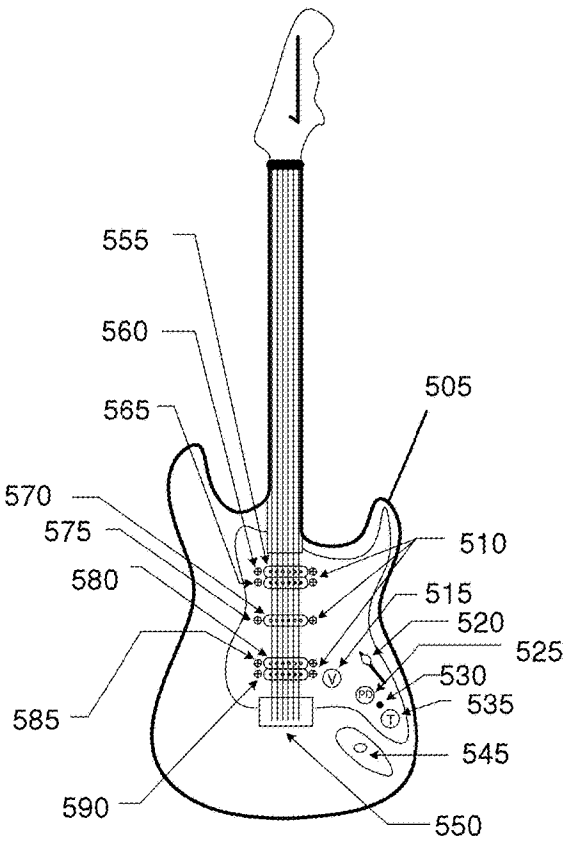
FIG. 5 illustrates an exemplary front view pickup configuration of a six-string guitar equipped with a Pickup Director with optional display system comprising backlit LED driven light pipes or a transparent screw display system and optional illuminated POTs for volume and tone controls that are also backlit by LEDs according to aspects of the present invention.
Figure 8:
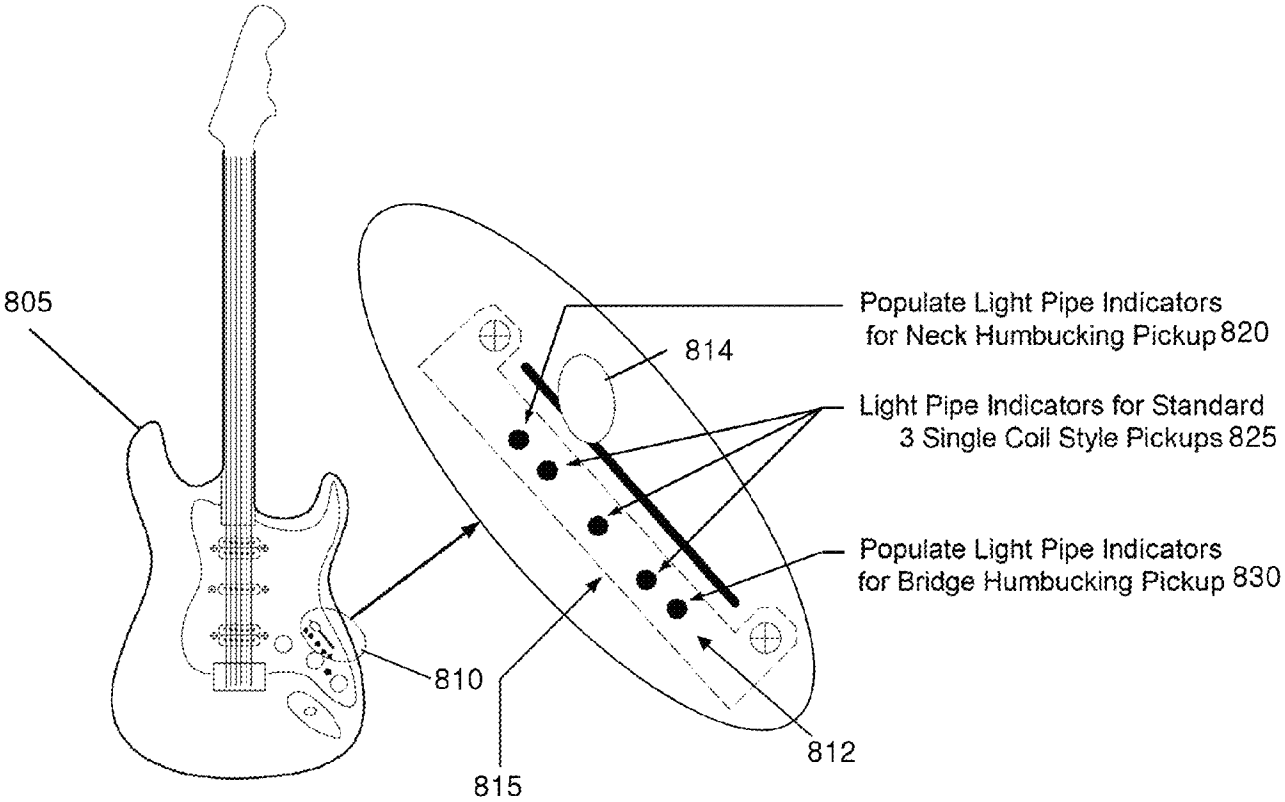
FIG. 8 illustrates an exemplary view of a six-string guitar equipped with a Pickup Director with optional light pipe display system comprising backlit LED driven light pipes near the blade switch control for visual indication of pickup selections according to aspects of the present invention.

In embodiments, an indication or display system includes a LED light pipe system 150 having light emitting diodes (LEDs) respectively mounted under transparent fastening screws used to hold pickups and pickup elements in place on an instrument or under transparent light pipes next to the pickups to allow for original standard screw fastening to hold the pickups in place, as illustrated in FIG. 5 and further described below. Likewise, in embodiments, standard or surface mount technology (SMT) type LEDs can be used in the pickguard itself near the pickups or within the pickup itself or the pickup ring around the pickup, or close and parallel to the guitar select switch 110 (e.g., a five-position blade switch), as illustrated in FIG. 8 and further described below. The LED light pipe display system 150 illustrates transparent fastening screws and associated LEDs to provide single coil mode indication of single coil/humbucking type pickups. For example, a red color LED under transparent fastening screw or light may indicate a humbucking mode of operation. Further, transparent fastening screw or light pipe and an associated LED with blue color, for example, may provide a single coil mode indication of single coil pickup. In embodiments, the system 100 is powered by a direct current power source, such as a nine volt battery or the like. Alternatively, in embodiments, the system 100 may be powered by an optional remote power source (illustrated in FIG. 26 and further described below) via circuitry 157 shown in FIG. 1 via an Output Tip Ring and Sleeve connection jack 140.

Figure 2:
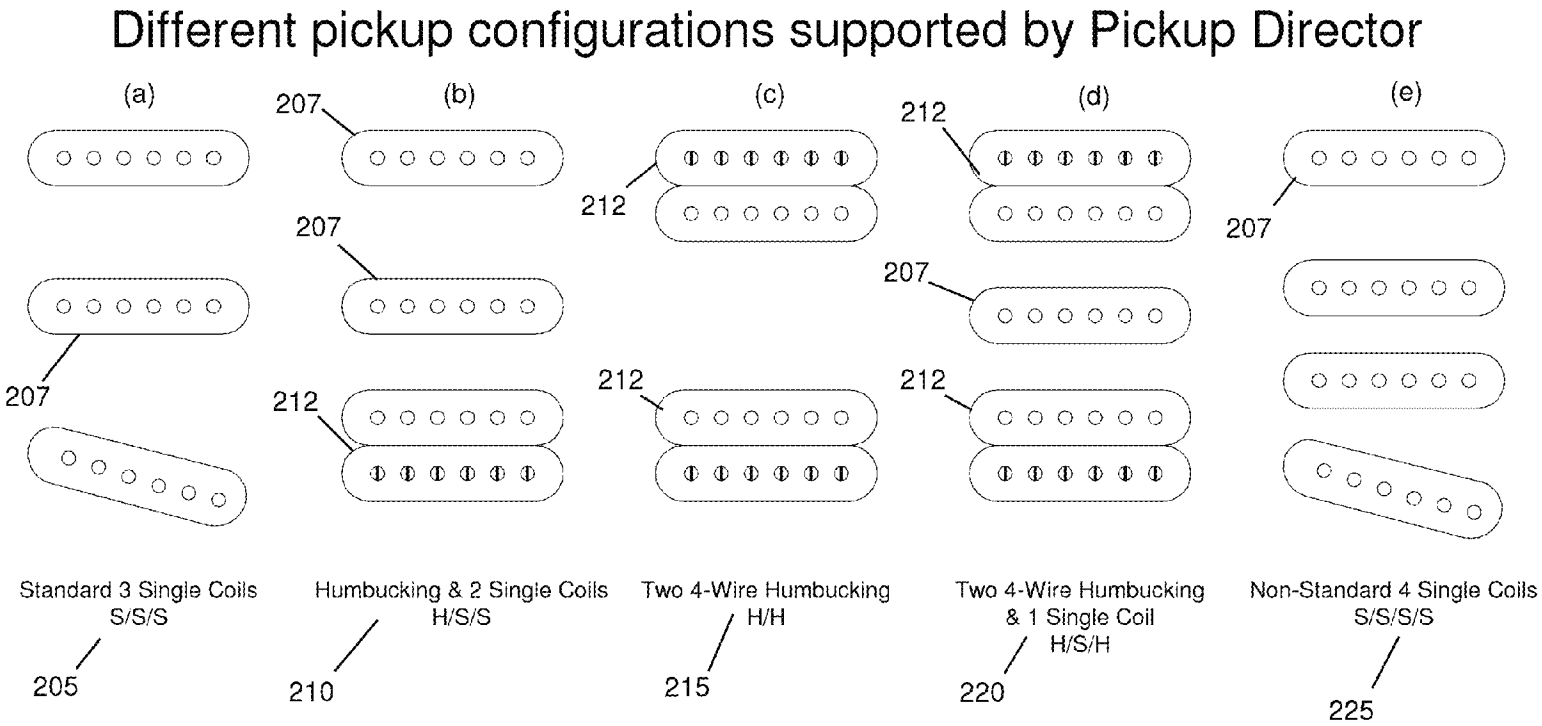
FIG. 2 shows exemplary different pickup configurations supported by the Pickup Director used with single coil pickups, humbucking pickups and combinations of both single coil and parallel humbucking pickups according to aspects of the present invention.

FIG. 2 shows exemplary different pickup configurations supported by the Pickup Director pickup switching system 100. FIG. 2 shows examples using single coil pickups, humbucking pickup and combinations of both single coil and parallel humbucking pickups. Starting at the far left column (a) of FIG. 2, is an example of an instrument 205 with three single coil pickups 207. In embodiments, the programmable Pickup Director switching system 100 is operable to configure these three single coil pickups 207 in parallel, series, and/or series/parallel combinations. Column (b) illustrates a four-wire humbucking pickup 212 in the bridge position and two single coil pickups 207 in the middle and neck positions of a guitar 210. In embodiments, the programmable Pickup Director switching system 100 is operable to configure these pickups in parallel, series, and/or series/parallel combinations. Column (c) illustrates an example of a third configuration 215 using two four-wire humbucking pickups 212. In addition to using these two pickups as humbucking type pickups, the programmable Pickup Director switching system 100 is operable to configure these pickups in parallel, series, and/or series/parallel combinations. Column (d) of FIG. 2 illustrates an example of an instrument 220, e.g., a guitar or bass, having a four-wire humbucking pickup 212, a single coil pickup 207 at center and another four-wire humbucking pickup 212 used in the neck or at the top of the guitar or bass guitar. In embodiments, the programmable Pickup Director switching system 100 is operable to configure these pickups in parallel, series, and/or series/parallel combinations. Finally, column (e) illustrates an example of an instrument 225 with four single coil pickups 207. In embodiments, the programmable Pickup Director switching system 100 is operable to configured these pickups in parallel, series, and/or series/parallel combinations.

Figure 3:
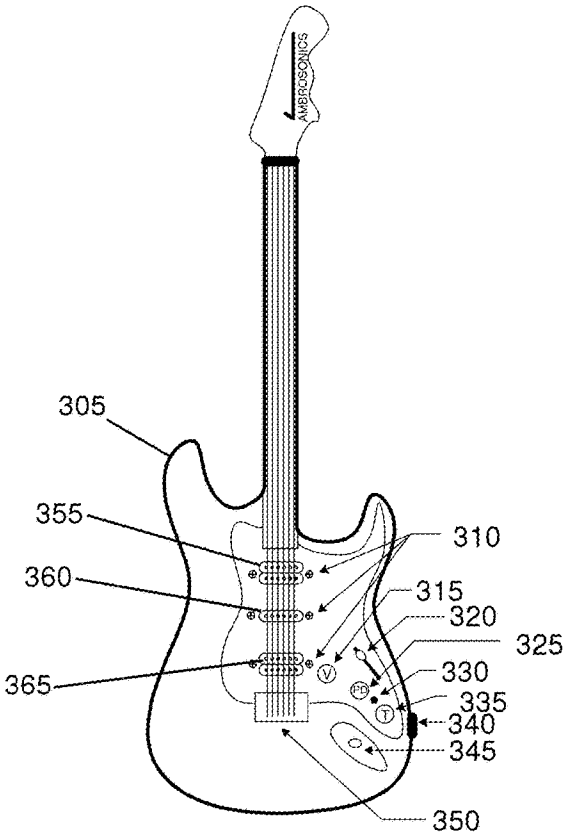
FIG. 3 illustrates an exemplary front view pickup configuration of a six-string guitar equipped with a Pickup Director according to aspects of the present invention.

FIG. 3 illustrates an exemplary front view pickup configuration of a six-string guitar 305 equipped with a Pickup Director according to aspects of the present invention. FIG. 3 shows a six-string guitar 305 with a body and with a neck. The guitar 305 is configured with the programmable Pickup Director system. A bridge saddle 350 is mounted on the guitar 305. The guitar 305 includes a volume (V) control POT (or knob) 315, the programmable Pickup Director switching system and Menu knob (PD) 325, a three position BANK selector switch 330, a tone (T) control POT 335, an optional programming computer port 340 for the Pickup Director, a main output jack 345 and a five position blade switch 320. A neck four-wire humbucking pickup 355 is attached to the guitar by standard adjustment screws 310. A middle position pickup 360 is attached to the guitar standard adjustment screws 310. A lower bridge position four-wire humbucking pickup 365 is attached to the guitar by standard adjustment screws 310. It is to be noted that the programmable Pickup Director is operable to provide different modes of series and parallel combinations between bridge, middle and neck position pickups being used together and are not limited to the bridge, middle and neck position pickups alone. By way of a non-limiting example, the volume (V) control POT 315 and/or the tone (T) control POT 335 can be backlit such that the numbers on the knob, shapes or patterns on the knobs themselves light up and can be seen in low stage light levels according to aspects of the present invention.

Figure 4:
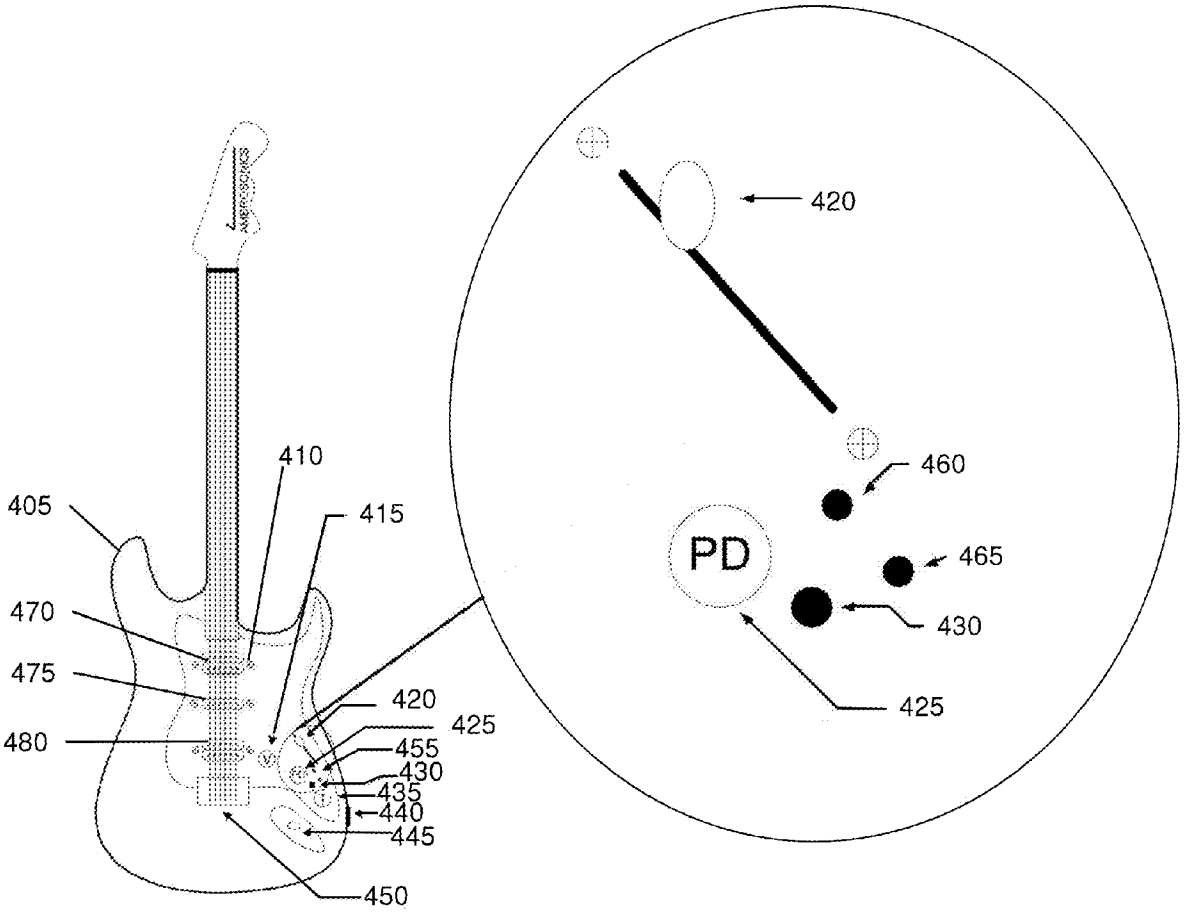
FIG. 4 illustrates an exemplary front view pickup configuration of a six-string guitar equipped with a Pickup Director with an optional main menu display system comprising two backlit LED driven light pipes according to aspects of the present invention.

FIG. 4 illustrates an exemplary front view pickup configuration of a six-string guitar 405 equipped with a Pickup Director according to aspects of the present invention. It shows a six-string guitar 405 with a body and with a neck. The guitar 405 is configured with the programmable Pickup Director system. A bridge saddle 450 is mounted on the guitar 405. The guitar 405 includes a volume (V) control POT 415, the programmable Pickup Director switching system and Menu knob (PD) 425, a three position BANK selector switch 430, a tone (T) control POT 435, an optional programming computer port 440 for the Pickup Director, a main output jack 445 and a five position blade switch 420. Additionally, in accordance with the illustrated embodiment, two backlit light pipes are shown, Menu LED1 465 and Menu LED2 460. These LEDs 465, 460 toggle 180 degrees out of phase with respect to each other when the Menu Push/Pull POT 425 is pulled to the up position and rotating. Each pickup subsequent configuration that is accessed by turning the Menu POT 425 causes the respective LEDs 465, 460 to turn on and off. This helps the musician who is auditioning the different pickup configurations with the programmable Menu POT 425 to listen and see a coinciding change take place with the light pipe display system. Each time a new sound is presented, the LED light pipe display 455 toggles between LED1 465 and LED2 460. A neck four-wire humbucking pickup 470 is attached to the guitar 405 by standard adjustment screws 410. A middle position pickup 475 is attached to the guitar 405 by standard adjustment screws 410. A lower bridge position four-wire humbucking pickup 480 is attached to the guitar 405 by standard adjustment screws 410. It is to be noted that the programmable Pickup Director is operable to provide different modes of series and parallel combinations between bridge, middle and neck position pickups being used together, and are not limited to the bridge, middle and neck position pickups alone. In accordance with aspects of the invention, the volume (V) control POT 415 and/or the tone (T) control POT 435 can be backlit such that the numbers on the knob, shapes or patterns on the knobs themselves light up and can be seen in low stage light levels according to aspects of the present invention.

FIG. 5 illustrates an exemplary front view pickup configuration of a six-string guitar 505 equipped with a Pickup Director according to aspects of the present invention. It shows a six-string guitar 505 with a body and with a neck. The guitar 505 is configured with the programmable Pickup Director system. A bridge saddle 550 is mounted on the guitar 505. The guitar includes a volume (V) control POT (or knob) 515, the programmable Pickup Director switching system and Menu POT (PD) 525, a three position BANK selector switch 530, a tone (T) control POT 535, a main output jack 545 and a five position blade switch 520. A neck four-wire humbucking pickup 555 is attached to the guitar 505 by one or more transparent fastening screws 560, 565 and one or more standard adjustment screws 510.

An LED (not shown) having any desired color is mounted below the transparent fastening screw (e.g., 560, 565) and, when illuminated depending on color, provides a series or parallel combination of mode indication for the neck position pickup 555. A middle position pickup 570 is attached to the guitar 505 by a transparent fastening screw 575 and a standard adjustment screw 510. An LED having any desired color is mounted below the transparent fastening screw 575 and, when illuminated, provides a series or parallel combination of mode indication for the middle pickup 570. A lower bridge position four-wire humbucking pickup 580 is attached to the guitar 505 by one or more transparent fastening screws 585, 590 and one or more standard adjustment screws 510. An LED having any desired color is mounted below the transparent fastening screws (e.g., 585, 590) and, when illuminated, provides a series or parallel combination of mode indication for the bridge pickup 580. As described above, due to the great number of programmable pickup combinations and configurations, the indication or display system visually indicates the pickups' on/off status and mode status as series, in parallel or a combination of both series and parallel depending on color. This display system is done in an elegant manner, and is non-intrusive to the instrument's natural look and appearance. In accordance with aspects of the invention, by replacing the standard fastening screws used to hold the pickup element(s) in place on an instrument with the transparent screws 560, 565, 575, 585, 590, the screws continue to function in the usual fastening manner but now also take on the new function of allowing light from LED's under the screw to propagate as an indication of the on or off status of each particular pickup, as well as in a decorative manner. The screws continue to fasten the pickup to the instrument, provide an ability to adjust the pickup height relative to the string as is common place, but now also provide an indication of which pickups are ON or OFF by lighting up in different colors or by lighting ON and shining through the transparent screw for a pickup which is on or not shining through the transparent screw for a pickup which is OFF. It is to be noted that the programmable Pickup Director is able to provide different modes of series and parallel combinations between bridge, middle and neck position pickups being used together and are not limited to the bridge, middle and neck position pickups alone. In accordance with aspects of the invention, the volume (V) control POT 515 and/or the tone (T) control POT 535 can be backlit such that the numbers on the knob, shapes or patterns on the knobs themselves light up and can be seen in low stage light levels according to aspects of the present invention.

Figure 6:
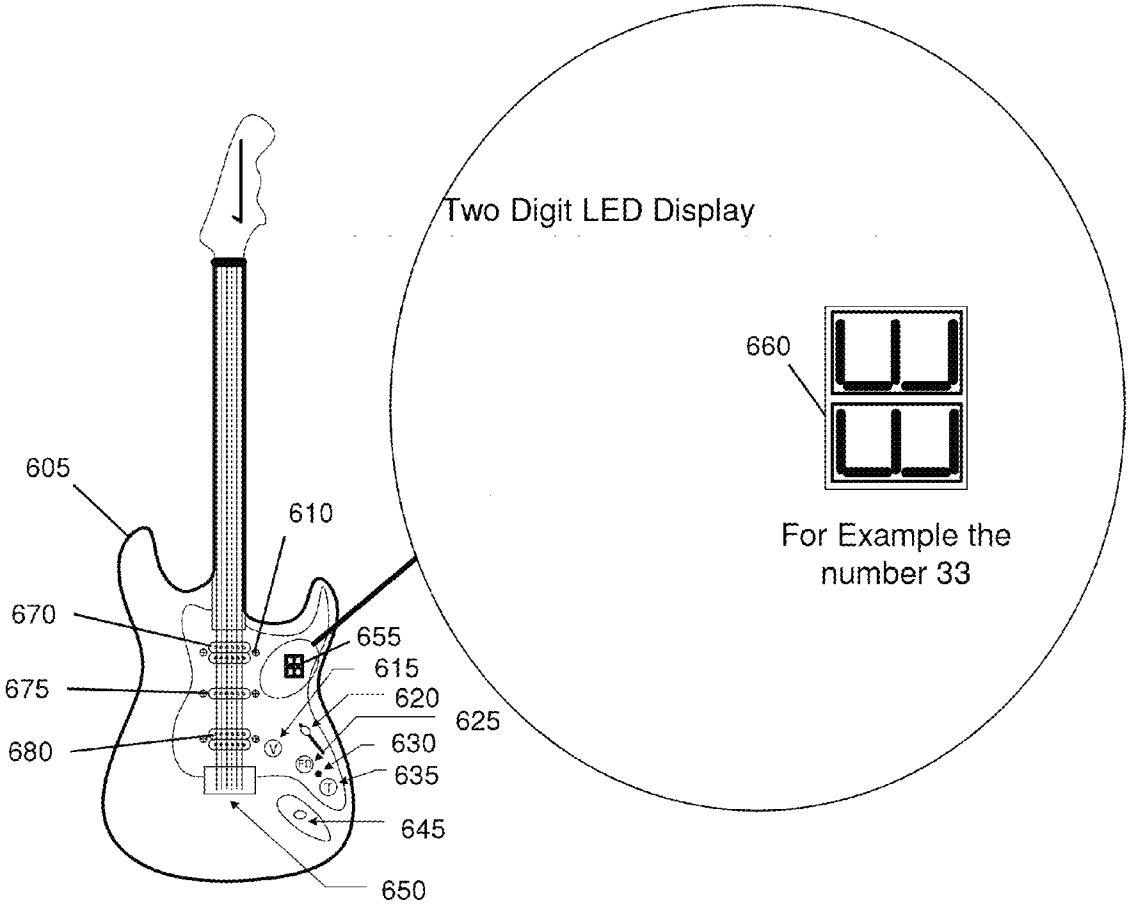
FIG. 6 illustrates an exemplary front view pickup configuration of a six-string guitar equipped with a Pickup Director with optional two seven segment LED display system and optional illuminated POTs for volume and tone controls that are also backlit by LEDs according to aspects of the present invention.

FIG. 6 illustrates an exemplary front view pickup configuration of a six-string guitar 605 equipped with a Pickup Director according to the present invention. It shows a six-string guitar 605 with a body and with a neck. The guitar 605 is configured with the programmable Pickup Director system. A bridge saddle 650 is mounted on the guitar 605. The guitar 605 includes a volume (V) control POT 615, the programmable Pickup Director switching system and Menu knob (PD) POT (or switch) 625, a three position BANK selector switch 630, a tone (T) control POT 635, a main output jack 645, and a five position blade switch 620. In accordance with the illustrated embodiment, a two-digit seven segment LED display 655 is shown positioned on the guitar 605. In embodiments, the two-digit display 655 is mounted on the guitar 605 in landscape fashion such that the two digits face the musician as he/she is playing the instrument. This display option displays the numeric number of pickup configurations within the Menu structure of the Pickup Director. When the Menu Push/Pull POT 625 is pulled to the up position and rotating, a number shows up on the display relative to the number of programmable pickup configurations programmed into the Pickup Director's Menu selector. For example, in embodiments, a number between twelve and forty-nine pickup configurations may be accessed by turning the Menu POT 625 and causing the number (e.g., corresponding to a particular pickup configuration) to be displayed on the two digit display system 655. This helps the musician who is auditioning the different pickup configurations with the programmable Menu structure to listen and see a number on the display 655 take place coinciding with a particular pickup configuration within the range or the number of pickup or sounds provided by the programmable Menu POT. In accordance with aspects of the invention, each time a new sound is presented, the two digit display 655 shows the number 660 the user is currently positioned at within the range of the Menu selection POT or control.

A neck four-wire humbucking pickup 670 is attached to the guitar 605 by standard adjustment screws 610. A middle position pickup 675 is attached to the guitar 605 by standard adjustment screws 610. A lower bridge position four-wire humbucking pickup 680 is attached to the guitar 605 by standard adjustment screws 610. It is to be noted that the programmable Pickup Director is able to provide different modes of series and parallel combinations between bridge, middle and neck position pickups being used together and are not limited to the bridge, middle and neck position pickups alone. In accordance with aspects of the invention, the volume (V) control POT 615 and/or the tone (T) control POT 635 may be backlit such that the numbers on the knob, shapes or patterns on the knobs themselves light up and can be seen in low stage light levels according to aspects of the present invention.

Figure 7:
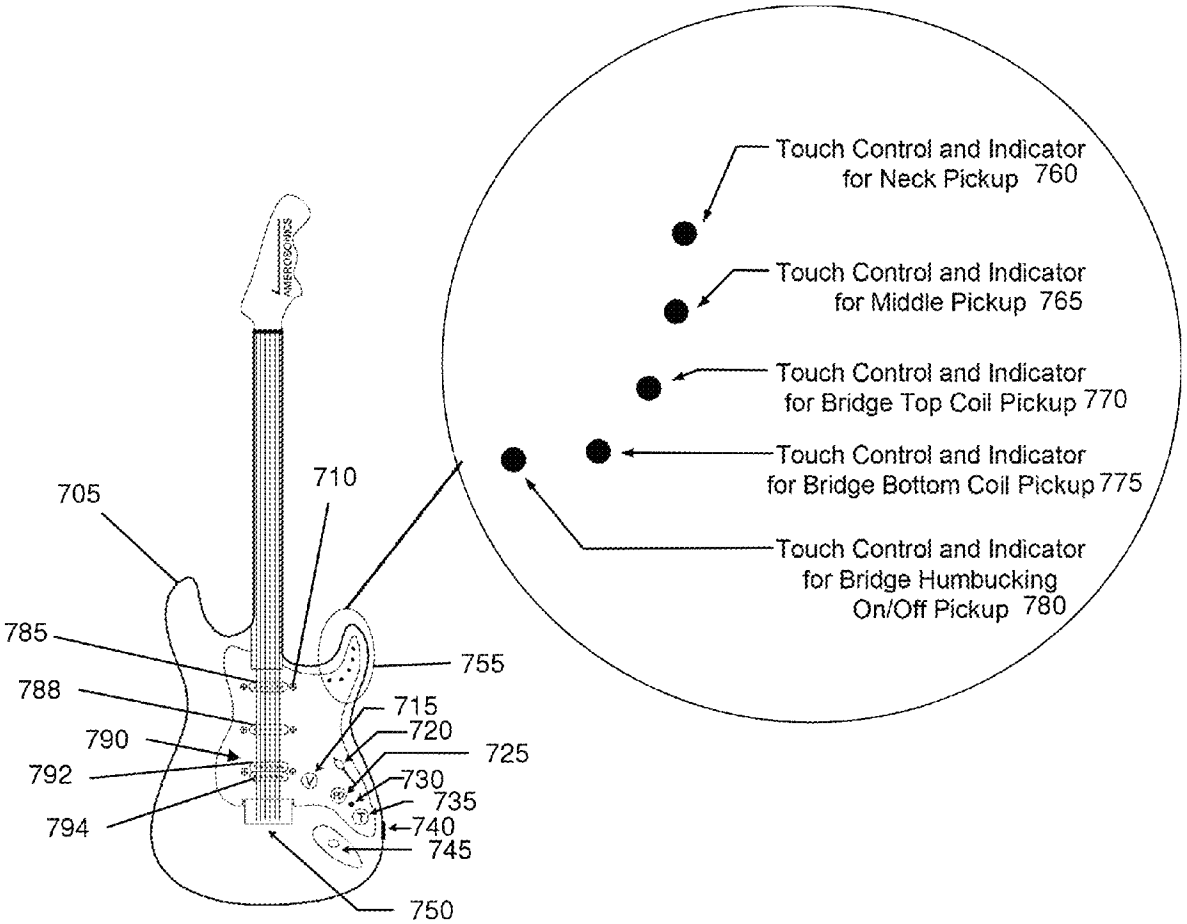
FIG. 7 illustrates an exemplary view of a six-string guitar equipped with a Pickup Director with optional touch sensitive system programmable touch sensitive indicators and optional illuminated POTs according to aspects of the present invention.

FIG. 7 illustrates an exemplary front view pickup configuration of a six-string guitar 705 equipped with a Pickup Director according to the present invention. It shows a six-string guitar 705 with a body and with a neck. The guitar 705 is configured with the programmable Pickup Director system. A bridge saddle 750 is mounted on the guitar 705. The guitar 705 includes a volume (V) control POT 715, the programmable Pickup Director switching system and Menu knob (PD) 725, a three position BANK selector switch 730, a tone (T) control POT 735, an optional programming computer port 740 for the Pickup Director, a main output jack 745, and a five position blade switch 720. Additionally, with the illustrated exemplary embodiment, a touch-sensitive system 755 includes five touch sensitive controller/indicators 760, 765, 770, 775, and 780 having backlit light pipes as shown, allowing a musician to "touch" the tops of each light pipe individually or at the same time to turn on or off different pickups at will. As the respective controller/indicators 760, 765, 770, 775, and 780 are touched, an LED of desired color backlights the respective light pipe to allow illumination of the respective touch controller/indicators 760, 765, 770, 775, and 780. In embodiments, when the Menu Push/Pull POT 725 is pulled to the up position, the touch sensitive system 755 operates in a touch sensitive mode, allowing the musician to touch which pickups he/she wants to turn on via the controller/indicators 760, 765, 770, 775, and 780. This helps the musician to directly audition the different pickup configurations by touching the controller/indicators 760, 765, 770, 775, and 780, to control which pickups to turn on or off. In an exemplary and non-limiting embodiment, the respective controller/indicators can correspond to each pickup in the following manner. The touch controller/indicator 760 on the top point of the lower guitar horn may turn on or off the top guitar pickup 785 located in the neck position. The touch controller/indicator 765 one down from the top point of the lower guitar horn may turn on or off the middle guitar pickup 788 located in the middle position. The touch controller/indicator 770 two down from the top point of the lower guitar horn may turn on or off the top coil 792 of the four-wire humbucking guitar pickup 790 (located in the top position of the bridge humbucking pickup 790). The touch controller/indicator 775 three down from the top point of the lower guitar horn may turn on or off the bottom coil 794 of the four-wire humbucking guitar pickup 790 (located in the bottom position of the bridge humbucking pickup 790). Finally, the last touch controller/indicator 780 located fourth down from the top point (or first sensor) of the lower guitar horn can toggle the four-wire bridge guitar pickup 790 between humbucking mode or single coil modes of operation. When the Menu Push/Pull POT 725 is pushed down, the current touch sensitive system settings are stored into memory at the current positions of the five position blade switch 720 and the three position BANK select switch 730 and the touch sensitive operation is discontinued. Only the indicator modes (i.e., the on-off status of the LEDs) of the touch controller/indicators remain intact. When the blade switch 720 and/or the BANK select switch 730 are moved, the pickup settings can be instantly recalled for the new positions. Each time a new position is presented on either the five position blade switch or the three position Bank select switch, the LEDs under the light pipes will display the pickup positions that are set to the ON conditions. With this exemplary embodiment, the touch sensitive system touch sensitive mode may only be re-enabled once the Menu Push/Pull POT (or switch) 725 is pulled in the up position again. The neck single coil pickup 785 is attached to the guitar 705 by standard adjustment screws 710. The middle position single coil pickup 788 is attached to the guitar 705 by standard adjustment screws 710. The lower bridge position four-wire humbucking pickup 790 is attached to the guitar 705 by standard adjustment screws 710. In embodiments, the volume (V) control POT 715 and/or the tone (T) control POT 735 can be backlit such that the numbers on the knob, shapes or patterns on the knobs themselves light up and can be seen in low stage lighting levels according to aspects of the present invention.

In embodiments, one or more, for example, five and up to eight different touch sensitive controller/indicators that control as well as indicate a selection of pickup on/off positions can be used in conjunction with the Pickup Director. This option allows musicians to select pickup configurations as a more visual and touch sensitive application and approach. One or more of the touch sensitive controller/indicators can also be configured to operate as wireless generic controls to turn on or off switches remotely located, for example, up to three to ten meters away from the instrument.

FIG. 8 illustrates an exemplary alternative lighting and display system 810 for a guitar 805, which includes five display LED backlit light pipe indicators 812, located adjacent to and approximately parallel with the five position blade switch 814, from below the pickguard or wood on the PCB 815 itself, for ease of installation and the elimination of any requirement for transparent hardware. By way of example, all LED backlit light pipe indicators 812 are shown in a lighted condition. Of course, in embodiments, the number of LED backlit light pipe indicators 812 could be greater or fewer, as could the individual colors of the LEDs, for example, related to the number and/or type of pickups on the instrument. With the exemplary illustrated embodiment, as the five position blade switch 814 is moved throughout its positions, the corresponding LED light pipes (e.g., 820, 825 and/or 830) can be illuminated or not, indicating which coils are energized and/or what modes (e.g., series, parallel, or series/parallel) the pickup coils are in.

Figure 9:
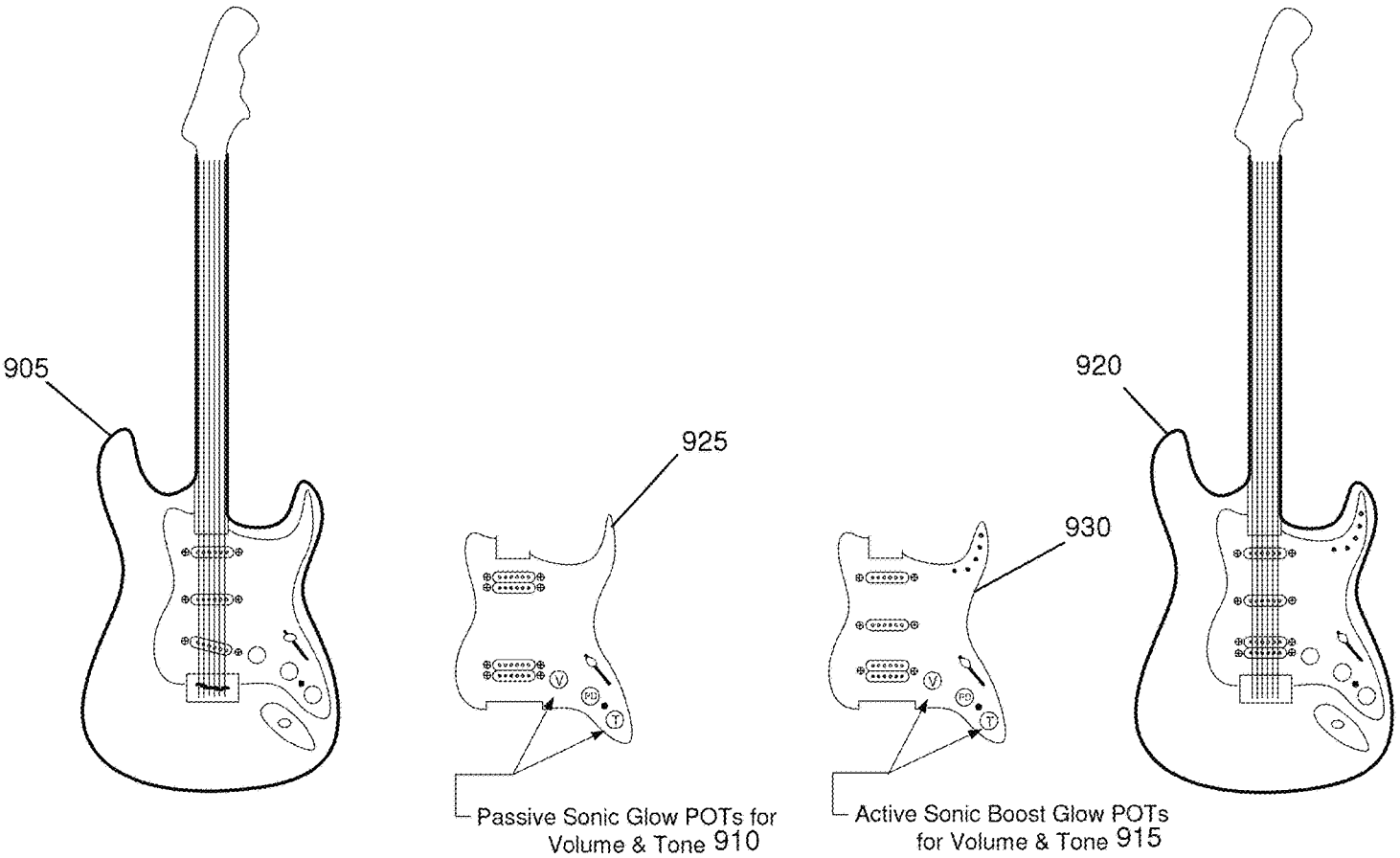
FIG. 9 illustrates an exemplary view of two six-string guitars and one pickguard assembly containing a Pickup Director switching system and optional illuminated POTs and the other pickguard assembly containing a Pickup Director switching system, optional illuminated POTs and touch sensitive control/indicators for installation as complete pickguard assemblies installed into other existing guitars (or retrofitted) according to aspects of the present invention.

FIG. 9 illustrates an exemplary front view of two six-string guitars 905, 920 each equipped with a Pickup Director according to aspects of the present invention. The Pickup Director electronics and controls are not limited to an entire guitar alone. The sub-assembly pickguard 925 or 930 itself can be used as an upgrade to retrofit existing guitars of similar form factor. In the case of guitar with no pickguards to which pickup director system components may be attached (e.g., as shown with pickguard 925 or 930), the Pickup Director can still be installed in a cavity behind the top wood of a guitar, for example, using the shaft of the Menu Push/Pull POT passing through a bore in the top wood of the guitar, with the POT being attached to the PCB board, thus holding the entire assembly in place (i.e., is "self-securing"). In embodiments, the illuminated POT controls may also be "self-securing," and these too can stand alone in a guitar system with a pickguard (e.g., fastened to the pickguard), or without a pickguard (for example, with the shaft of the POT passing through a bore in the top wood of the guitar and holding the illuminated POT board assembly in place), so as to be installed separately and, for example, as a stand alone upgrade.

Figure 10:
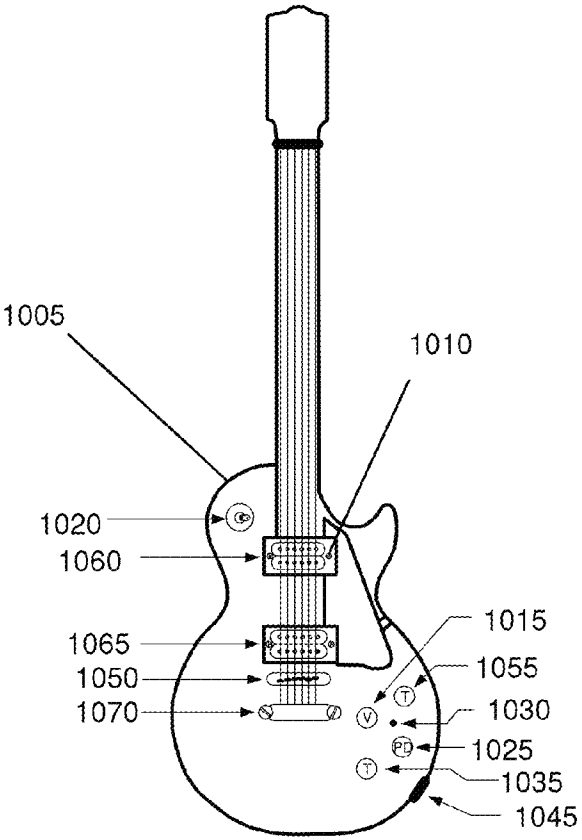
FIG. 10 illustrates an exemplary front view pickup configuration of a six-string guitar of another popular style equipped with a Pickup Director and optional volume, bass and treble control illuminated POTs according to aspects of the present invention.

FIG. 10 illustrates an exemplary front view pickup configuration of a six-string guitar 1005 equipped with a Pickup Director according to aspects of the present invention. FIG. 10 shows a six-string guitar 1005 with a body and with a neck. The guitar 1005 is configured with the programmable Pickup Director system. A tail piece 1070 and bridge saddle 1050 are mounted on the guitar 1005. The guitar 1005 includes a volume (V) control POT 1015, the programmable Pickup Director switching system and Menu knob (PD) 1025, a three position BANK selector switch 1030, a bass tone (T) control POT 1055, a treble tone (T) control POT 1035, a main output jack 1045 with options for remote power supply feed, and a three position master guitar pickup switch 1020. A neck four-wire humbucking pickup 1060 is attached to the guitar 1005 by standard adjustment screws 1010. A bridge position four-wire humbucking pickup 1065 is attached to the guitar 1005 by standard adjustment screws 1010. It is to be noted that the programmable Pickup Director is able to provide different modes of series and parallel combinations between bridge and neck position pickups being used together and are not limited to the bridge and neck position pickups alone. In embodiments, the volume (V) control POT 1015, the bass tone (T) control POT 1055 and the treble tone (T) control POT 1035 may be backlit such that the numbers on the knob, shapes or patterns on the knobs themselves light up and can be seen in low stage light levels according to aspects of the present invention.

Figure 11A:
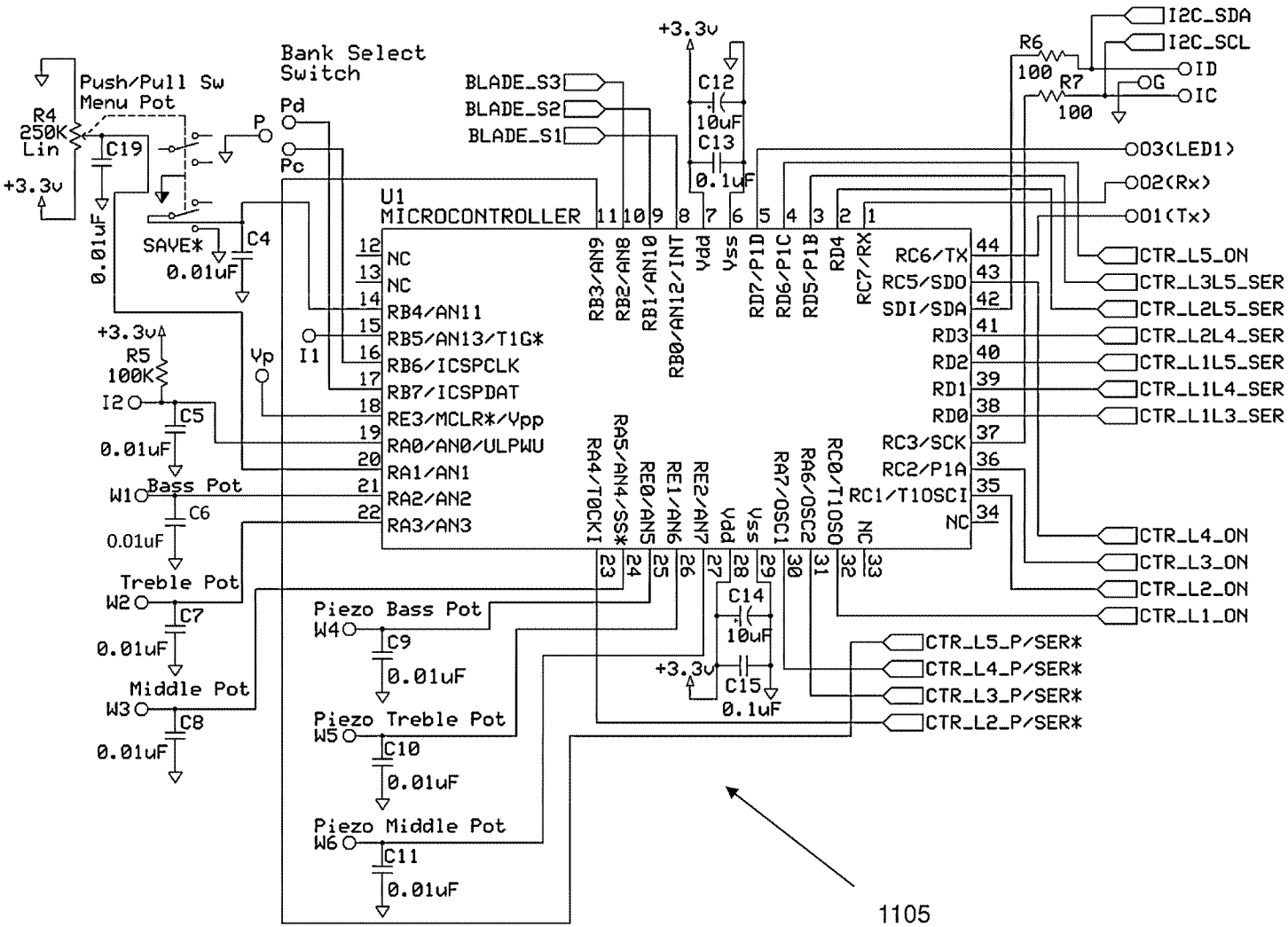
FIGS. 11*a* and 11*b* illustrate an exemplary schematic diagram of Pickup Director's circuitry and micro-controller with Input/Output (I/O) port allocations according to aspects of the present invention.
Figure 11B:
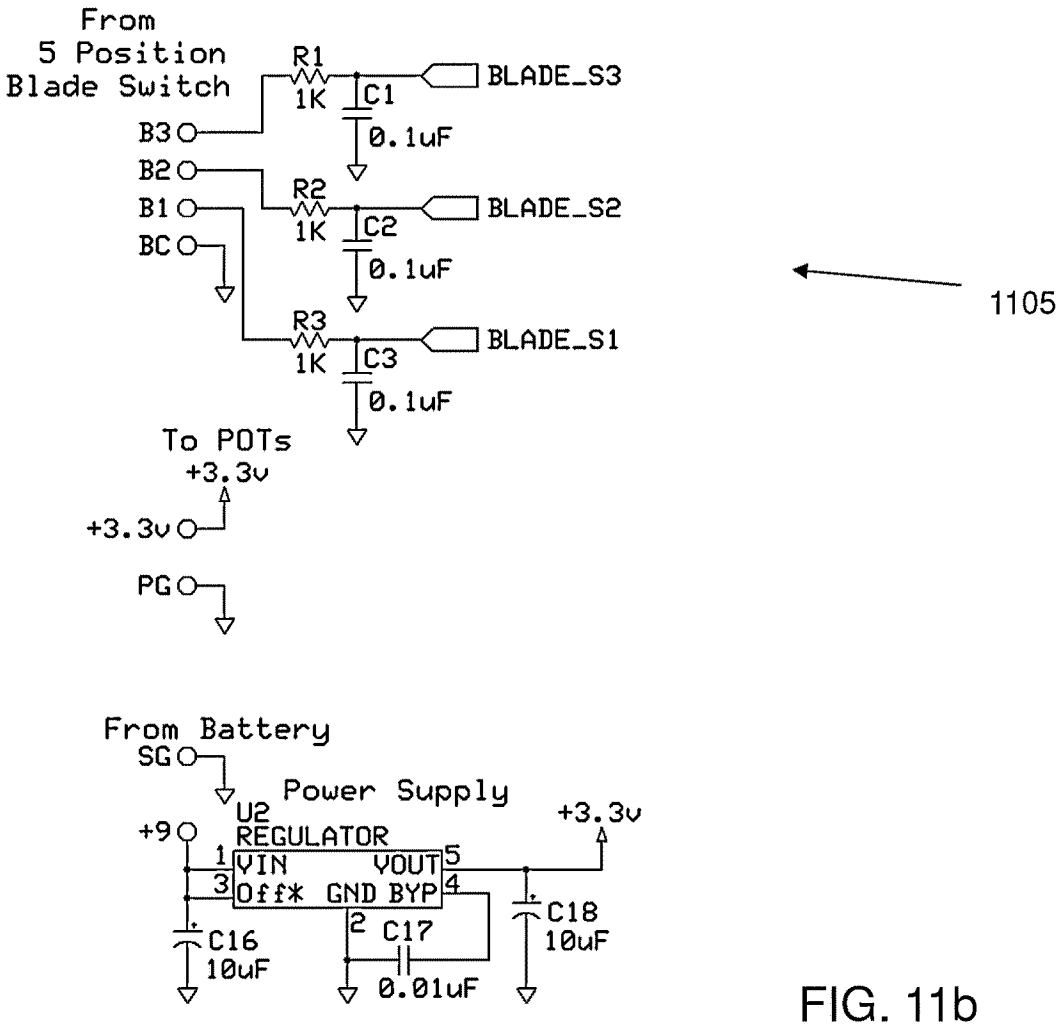

FIGS. 11*a* and 11*b* illustrate an exemplary schematic diagram of Pickup Director's circuitry 1105 and microcontroller with Input/Output (I/O) port allocations according to aspects of the present invention. This Pickup Directors circuitry 1105, hereinafter a control Logic PCB, includes a pickup matrix and interfaces with switches, inputs, power supply, I2C serial control, computer serial control and potentiometers to perform Pickup Director functions. The values shown in FIGS. 11*a* and 11*b* are exemplary and non-limiting values.

Figure 12:
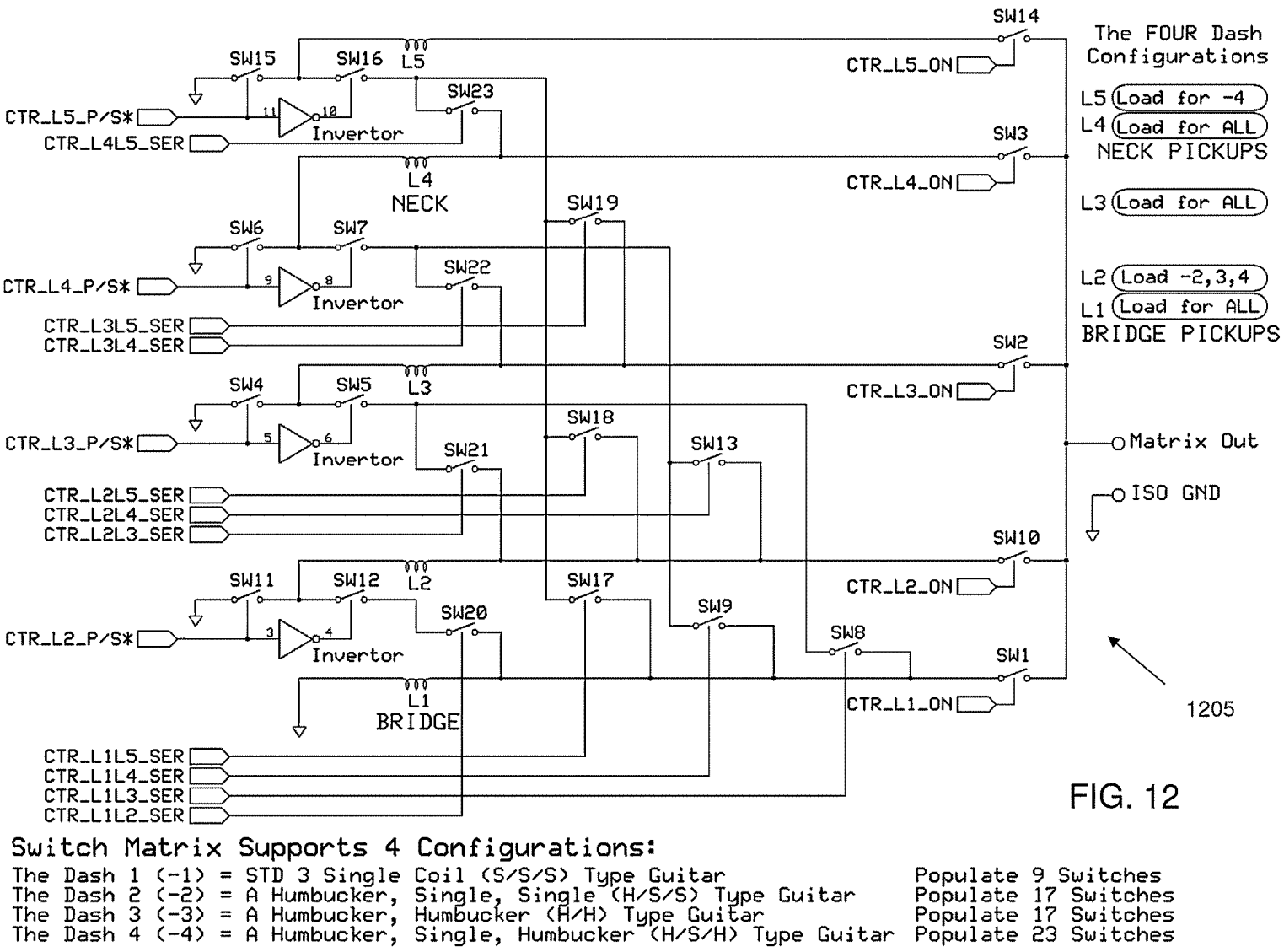
FIG. 12 illustrates an exemplary schematic diagram of Pickup Director's circuitry and switch matrix accommodating the many different pickup configurations shown in FIG. 2 above according to aspects of the present invention.

FIG. 12 illustrates an exemplary schematic diagram of Pickup Director's circuitry and switch matrix 1205 accommodating the many different pickup configurations shown in FIG. 2 above according to aspects of the present invention. The Pickup Director circuitry and switch matrix 1205 connects to any of two to five pickups to provide a multi-selection of pickup sounds in a musician friendly way and with great efficiency. This exemplary pickup matrix 1205 supports dash one through dash four configurations by populating the required circuitry depending on the pickup configuration of the type of guitar the system is to be used with, as explained further below.

Figure 13:
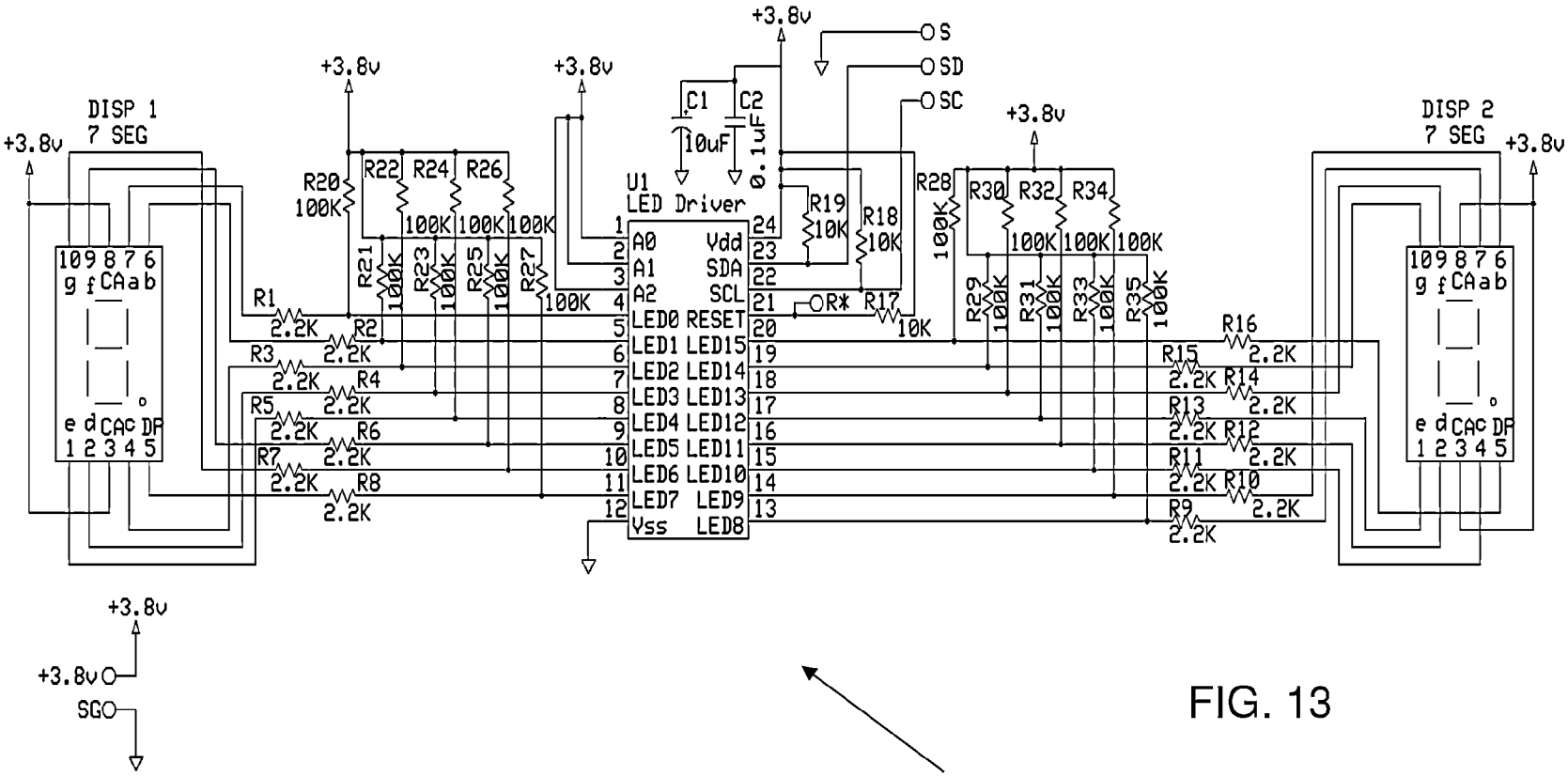
FIG. 13 illustrates an exemplary schematic diagram of the optional two seven segment LED display system module used in conjunction with a Pickup Director according to aspects of the present invention.

FIG. 13 illustrates an exemplary schematic diagram of the optional two seven segment LED display system module 1305 used in conjunction with a Pickup Director according to the present invention. The I2C serial control driver IC drives the various segments of a seven segment display such that the point of view of the performing musician can see what number program he/she has active.

Figure 14:
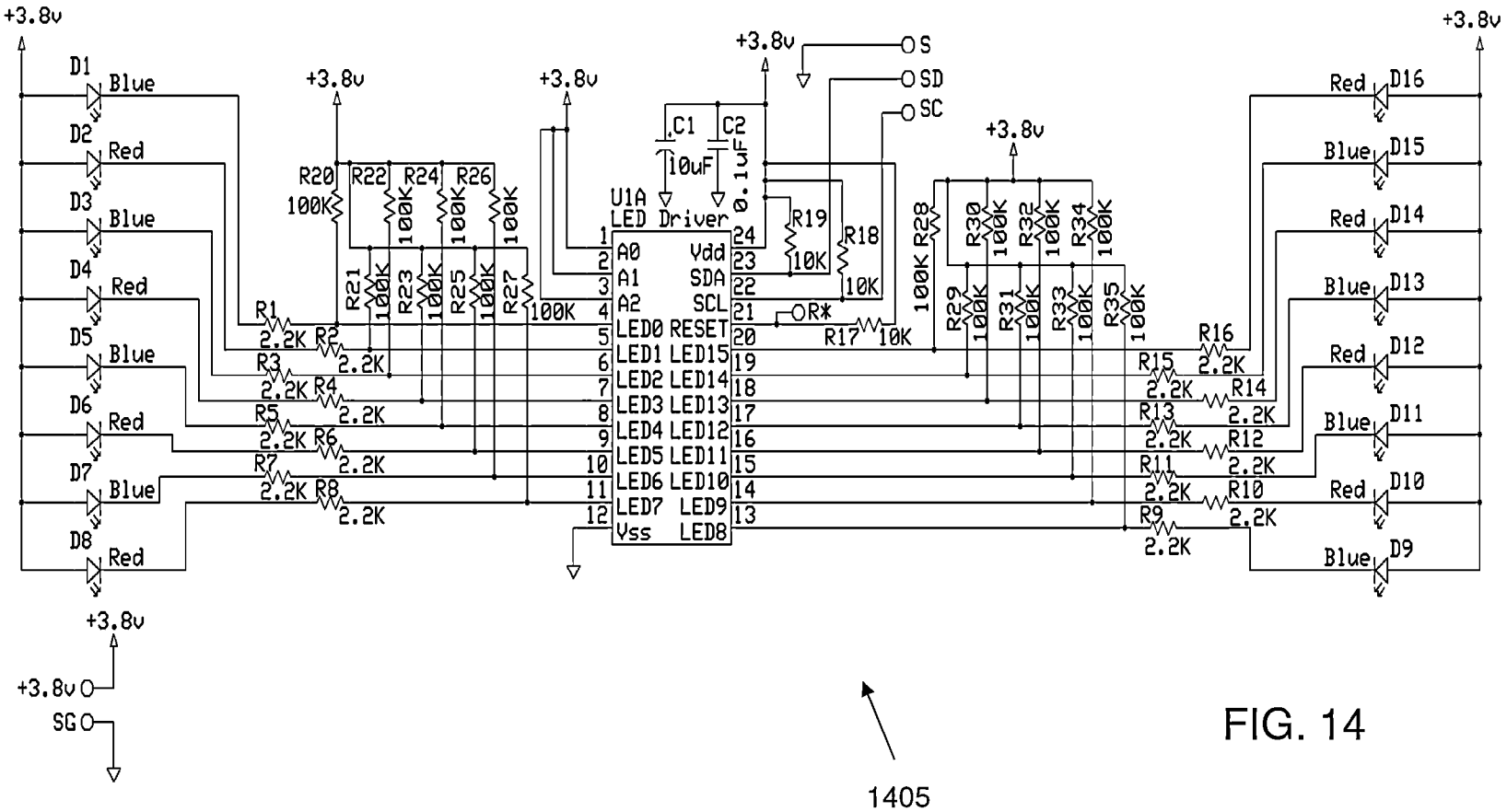
FIG. 14 illustrates an exemplary schematic diagram of the optional backlit light pipe or transparent screw display system used in conjunction with a Pickup Director according to aspects of the present invention.

FIG. 14 illustrates an exemplary schematic diagram of the optional backlit light pipe or transparent screw display system 1405 used in conjunction with a Pickup Director according to the present invention. With this exemplary embodiment, the I2C serial control driver IC can drive up to sixteen discrete LED objects that can indicate which pickup coils are on or off and which modes they are programmed to i.e. series, parallel or series/parallel modes of pickup configurations.

Figure 15:
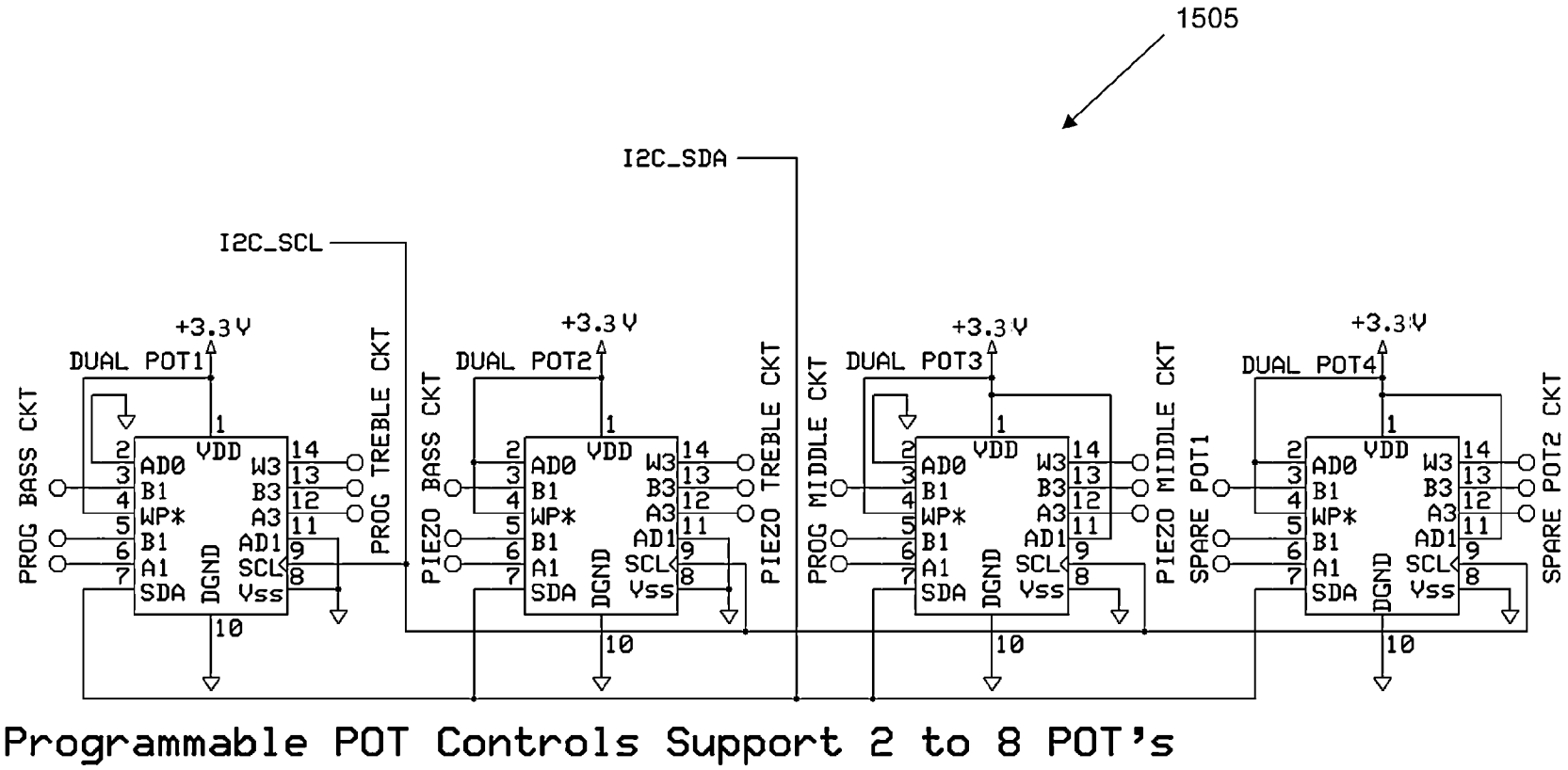
FIG. 15 illustrates an exemplary schematic diagram of the optional I2C electronic potentiometer control system for equalization adjustments for the guitar or bass guitar tone controls according to aspects of the present invention.

FIG. 15 illustrates an exemplary schematic diagram of the optional I2C electronic potentiometer control system 1505 for equalization adjustments for the guitar or bass guitar tone controls according to aspects of the present invention. Up to eight different electrical programmable potentiometers can be adjusted by the Pickup Director to alter the equalization of electric guitar or electric bass guitars.

Figure 16:
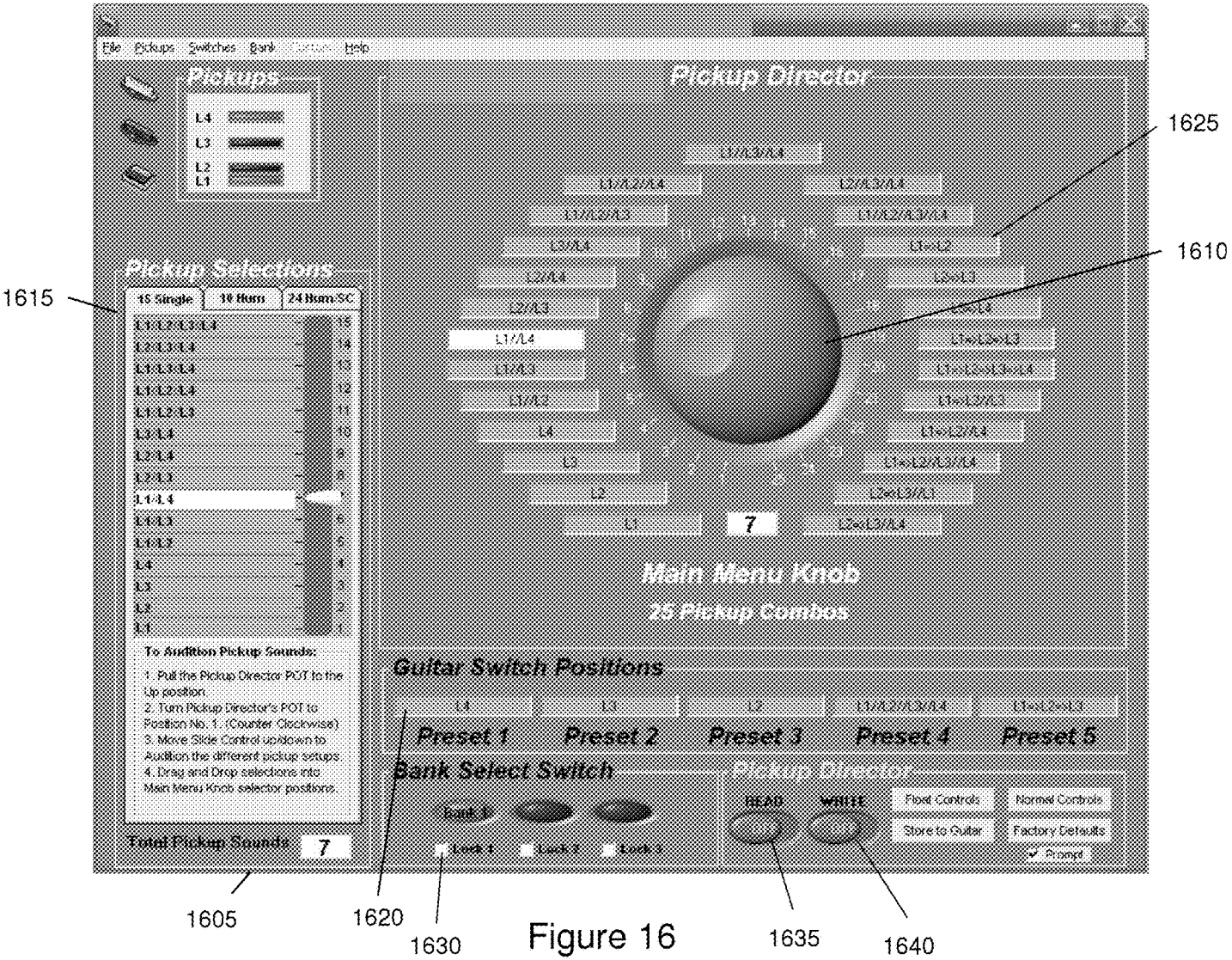
FIGS. 16-18 illustrate exemplary views of a user interface software application according to aspects of the present invention.

FIG. 16 illustrates a view 1605 of an exemplary user interface software application, which may be used to reconfigure firmware to control Pickup Director's functions from a computer with a USB port according to aspects of the present invention. The large round knob 1610 represents the Pickup Director's MENU Push/Pull POT knob. Pickup selections, for example, are then Dragged & Dropped by the musician from a pickup selection window 1615 to one of the positions 1625 selectable by knob 1610 and/or one of the positions 1620, which represent the storage locations designated by the guitar select switch (e.g., the five-position or three position main guitar switch) and bank select switch. In accordance with aspects of the invention, many different files may be saved with different setups of guitar pickup configurations. The user interface additionally includes lock actuators 1630 configured to lock the selected pickup configurations (e.g., the five selected pickup configurations) for each respective bank (e.g., "Bank 1"). A write switch 1635 and a read switch 1640 are operable to actuate a write mode and a read mode, respectively. In accordance with aspects of the invention, when the read mode is active, the user interface is operable to "read" and display the currently selected and/or stored pickup configurations of the connected instrument (e.g., in real-time). When the write mode is active, user interface is operable to "write" the user selections set and displayed via the user interface 1605 to the connected musical instrument, e.g., in real-time. In this manner, a user can easily audition different pickup configuration selections and/or program the guitar to store particular pickup configuration selections, e.g., for later recall. In an exemplary and non-limiting embodiment, in accordance with aspects of the invention, once an instrument is connected to a computer processor (e.g., via a USB cable) having the user interface (e.g., stored on a tangible storage medium), a software communication mode for the instrument may be activated by pulling the push/pull POT to an up position and rotating the push/pull POT fully counter clockwise, which initializes the USB hardware.

Figure 17:
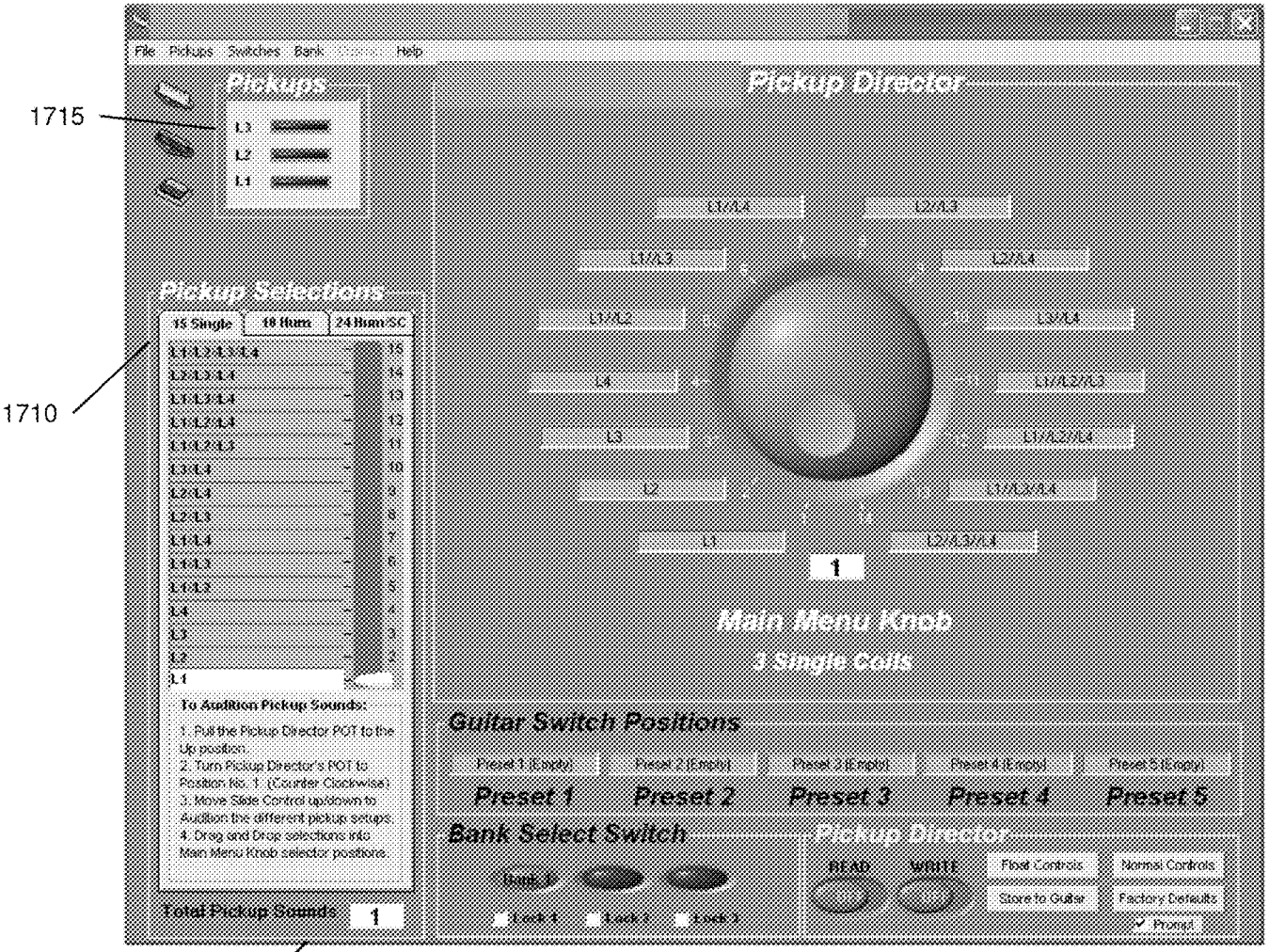

FIG. 17 illustrates another view 1705 of an exemplary user interface software application used to re-configure firmware to control Pickup Director's functions from a computer with a USB port. As shown in FIG. 17 (for example as compared to FIGS. 16 and 18), in accordance with aspects of the in invention, the menu POT on Pickup Director is re-scalable or re-configurable and can be set to allow for a smaller number of pickup sounds (with this illustrated example, 14 total sounds) and different pickup selections. The slide bar control 1710 on the left of the screen auditions the different pickup configurations in a logical manner i.e. single coil sounds, humbucking sounds and finally a mixture of humbucking and single coil pickup configurations or sounds mixed together. The display box labeled "Pickups" 1715 show by color which pickups are selected on and which modes they are programmed in (e.g., series, parallel or series/parallel combinations).

Figure 18:
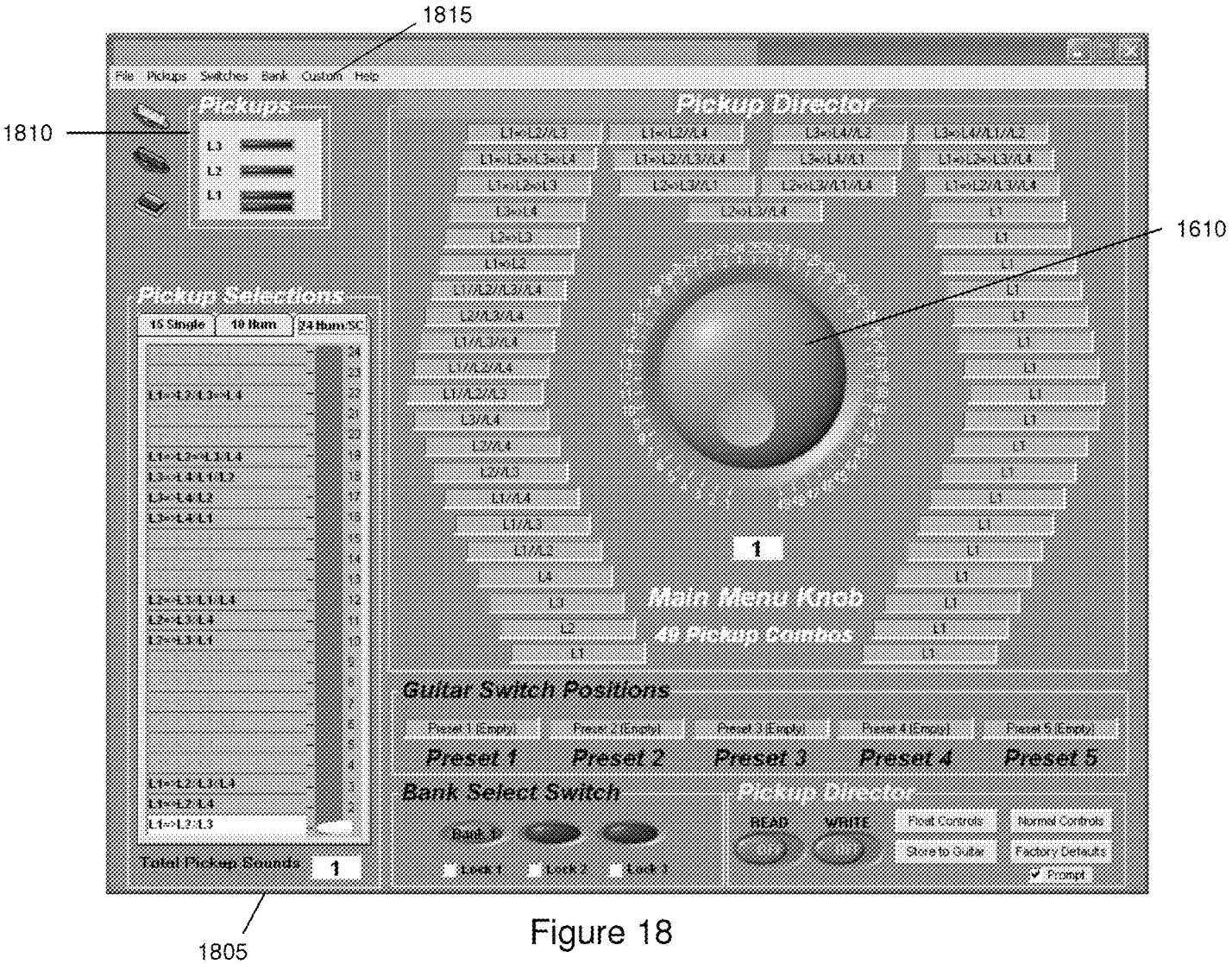

FIG. 18 illustrates another exemplary view 1805 of a user interface software application used to re-configure firmware to control Pickup Director's functions from a computer with a USB port. As shown in FIG. 18 (for example as compared to FIGS. 16 and 17), in accordance with aspects of the in invention, the menu POT on Pickup Director is re-scalable or re-configurable and can be set to allow a larger number of pickup sounds (with this illustrated example 49 total sounds) and different pickup selections within the menu of which Pickup Director supports over 150 total pickup selections according to the present invention. As discussed further below, particular different pickup configurations (e.g., S/S/S, S/S/H, H/H, H/S/H, S/S/S/S), by nature of the number of total coils, have differing respective total numbers of pickup combinations/selections. In embodiments, with a "default" mode, the user interface may be scaled so that the knob 1610 may select all of the available pickup combinations/selections for the particular configuration (e.g., S/S/S, S/S/H, H/H, H/S/H, S/S/S/S). In contrast, with a "custom" mode, a user may configure (or scale) the interface to provide less positions selectable by the knob 1610. In embodiments, for example, a custom mode may be activated using a drop down menu 1815. For example, in comparing FIG. 18 with FIG. 16, both interfaces indicate the same exemplary S/S/H pickup configuration. While FIG. 18, illustrates the "default" mode, providing the forty-nine available S/S/H pickup combinations/selections selectable by the knob 1610, FIG. 16 illustrates the "custom" mode, providing twenty-five pickup combinations/selections selectable by the knob 1610. In this manner, in accordance with aspects of the invention, a user may program the programmable pickup director switching system, and scale the push/pull POT of the guitar. Again, as the pickup configuration (e.g., S/S/S, S/S/H, H/H, H/S/H or S/S/S/S) changes, for example, depending on the style of guitar, so does the pickup setup and is illustrated by the "Pickups" display box 1810. In embodiments, for example, a blue color can represent a single coil sound type and a red color can represent a humbucking sound type.

Figure 19:
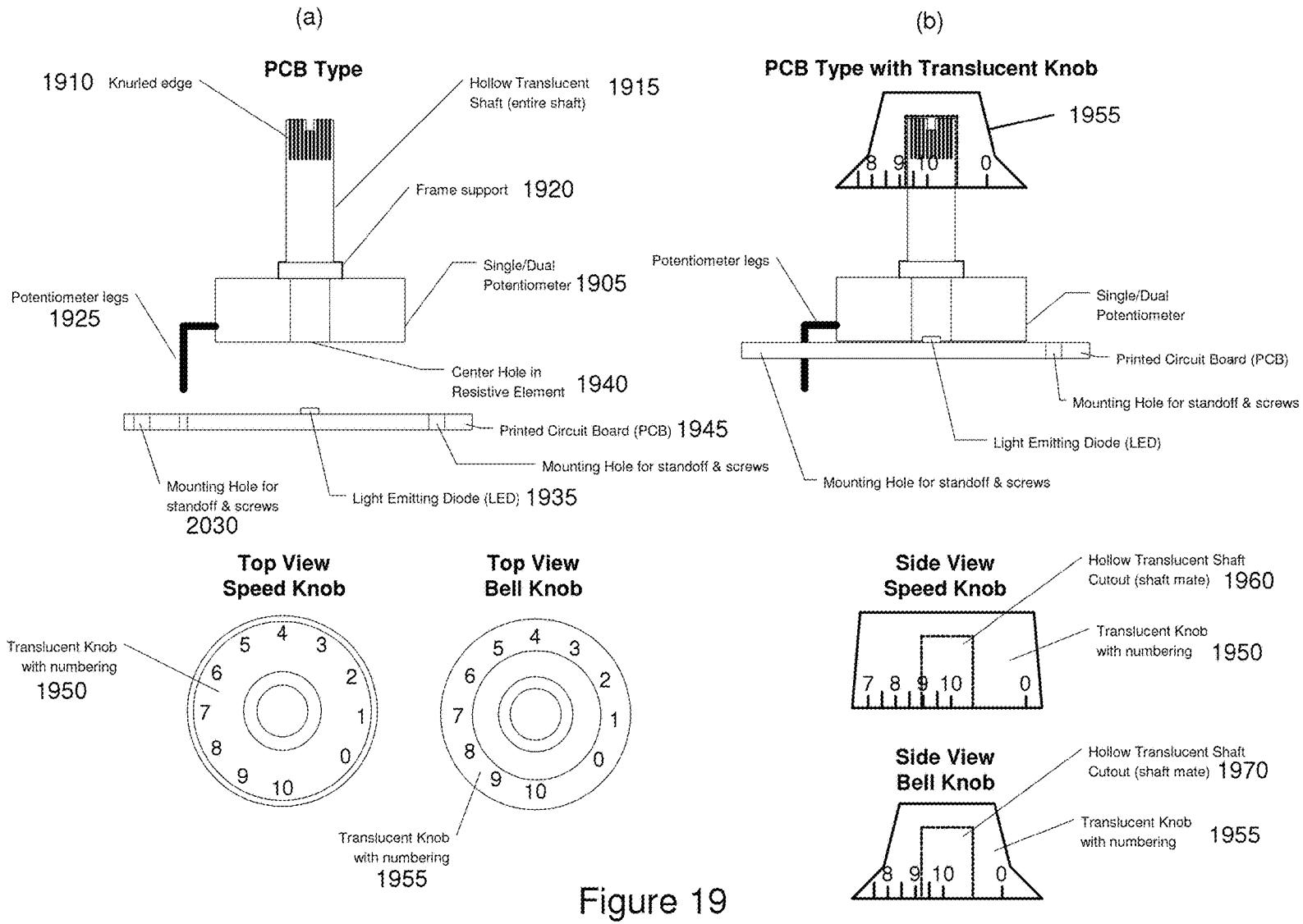
FIG. 19 illustrates exemplary views of a illuminated POT (without bushing threads) mounted into a PCB with transparent "Speed" knobs or transparent "Bell" knobs according to aspects of the present invention.

FIG. 19 illustrates various views of an exemplary illuminated POT (without bushing threads) mounted into a PCB with transparent "Speed" knobs or transparent "Bell" knobs in accordance with aspects of the present invention. FIG. 19(*a*) shows a view of a horizontal Printed Circuit Board (PCB) 1945 having mounting holes 1930, and containing a least one LED 1935 that aligns with a center hole 1940 in a potentiometer 1905 and with a hollow translucent shaft 1915 (e.g., having a knurled edge 1910) thereby lighting up the shaft 1915 and any clear, translucent, or opaque control knob 1950, 1955 pushed onto the translucent shaft 1915 (e.g., via the hollow translucent shaft cutout 1960, 1970). The illuminated POT also includes a frame support 1920. FIG. 19(*b*) shows the mated potentiometer 1905 to the horizontal PCB 1945 containing a least one LED 1935 aligned under a potentiometer 1905 with a hollow translucent shaft 1915. Connections allow the potentiometer leads or legs 1925 and the LED/LEDs 1935 to connect within a system and light up the translucent shaft 1915 and any clear, translucent, or opaque control knob 1950, 1955 pushed onto the translucent shaft 1915 in favor of an optional display function for use in a stand alone visible Sonic Glow POT control display system and/or in conjunction with a Pickup Director according to aspects of the present invention. The Sonic Glow POTs can be easily seen in dim or low stage light levels allowing the musician to know what his/her volume, tone and equalization settings are set to. Using a single PCB for mounting the potentiometer and the LED/LEDs as one unit, the attached control knob can be transparent, clear or opaque and still provide adequate backlighting from this less complicated lighting assembly.

Figure 20:
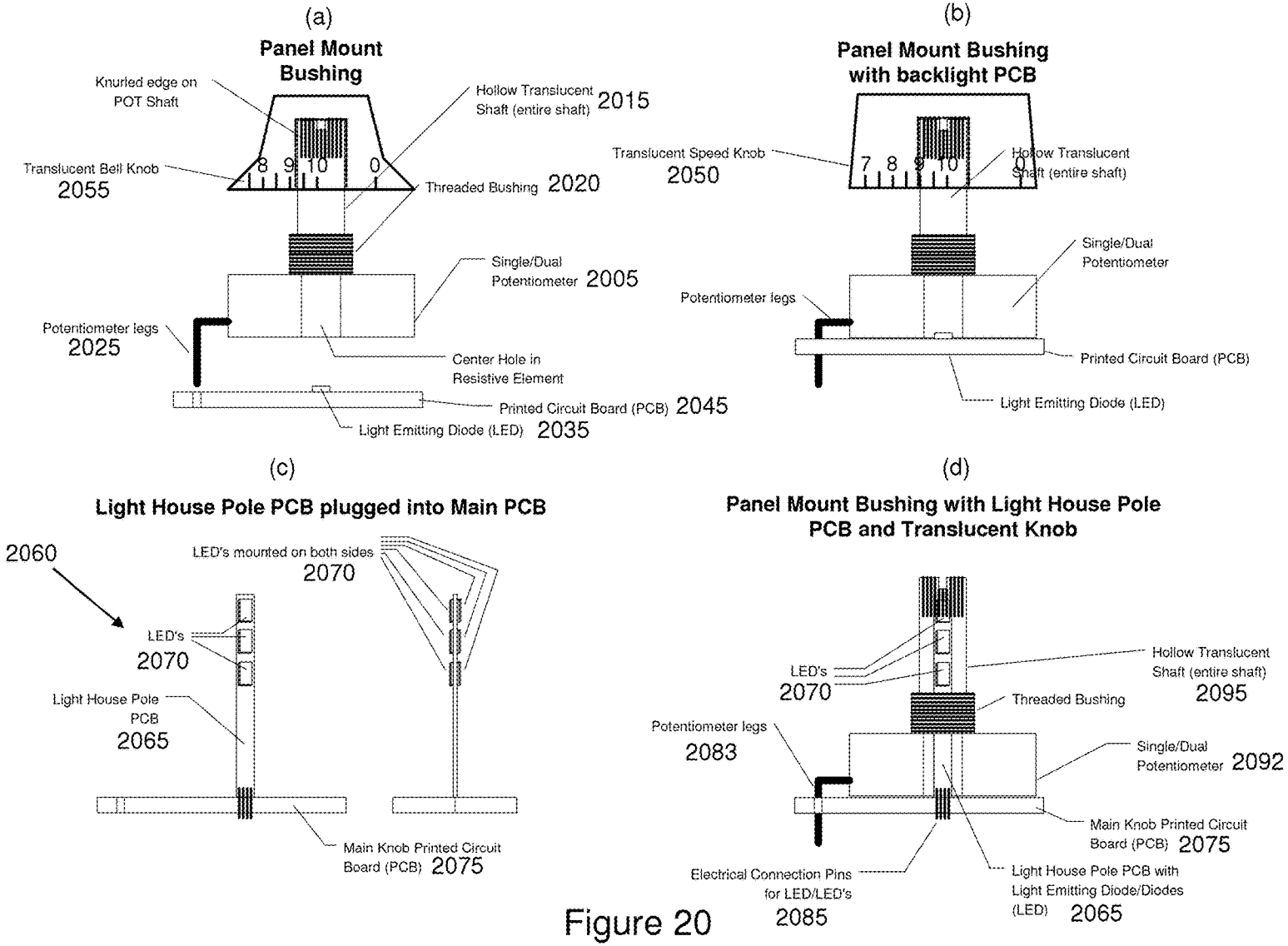
FIG. 20 illustrates exemplary views of a illuminated POT (with bushing threads) mounted into a PCB with transparent "Speed" knobs or transparent "Bell" knobs according to aspects of the present invention.

FIG. 20 illustrates exemplary views of an illuminated POT (with threaded bushing 2020) mounted into a PCB 2045 with transparent "Speed" knobs 2050 or transparent "Bell" knobs 2055. FIG. 20(*a*) shows a view of a horizontal Printed Circuit Board (PCB) 2045 containing a least one LED 2035 that aligns with a center hole 2040 in a potentiometer 2005 and with a hollow translucent shaft 2015 (e.g., having a knurled edge 2010) thereby lighting up the shaft 2015 and any clear, translucent, or opaque control knob 2050, 2055 pushed onto the translucent shaft 2015 (e.g., via the hollow translucent shaft cutout 2060, 2070). The illuminated POT also includes a frame support 2020. FIG. 20(*b*) shows the mated potentiometer 2005 to the horizontal PCB 2045 containing a least one LED 2035 aligned under a potentiometer 2005 with a hollow translucent shaft 2015. FIG. 20(*c*) shows a light pipe tower system 2060 that inserts up into the hollow transparent shaft 2015 of a Glow POT for multi-color lighting. Shown in the lower left side is a view of a vertical lighthouse Printed Circuit Board (PCB) 2065 containing, for example, one to six LEDs 2070. In embodiments, the vertical lighthouse Printed Circuit Board (PCB) 2065 can contain LEDs mounted on both sides for increased lighting efficiency. The vertical lighthouse PCB 2065 is then mounted to a main horizontal PCB 2075 providing support and power connections to the lighthouse PCB 2065. FIG. 20(*d*) shows the mated lighthouse PCB 2065 and main PCB 2075 inserted into a potentiometer 2092 with a hollow translucent shaft 2095 with circuitry connections 2085, 2090 for the potentiometer leads or legs 2083 and the LEDs 2070 to light up the translucent shaft and any clear, translucent, or opaque control knob pushed onto the translucent shaft with different colored LEDs in favor of an optional display function for use in a stand alone visible Sonic Glow POT control display system and/or in conjunction with a Pickup Director according to aspects of the present invention. The control knob can be transparent, clear or opaque and still provide adequate backlighting from this highly efficient lighting technique (e.g. through and/or around the control knob). In this exemplary embodiment, the light house pole is shown with up to a total of six SMT LEDs 2070 that can allow large brightness levels, different colors to be displayed, moving colors as the POT is rotated and/or LED sequencing for special performing and lighting stage effects. In embodiments, the LED lighting is spread throughout the translucent Bell, Speed or other shaped control knob.

Figure 21:
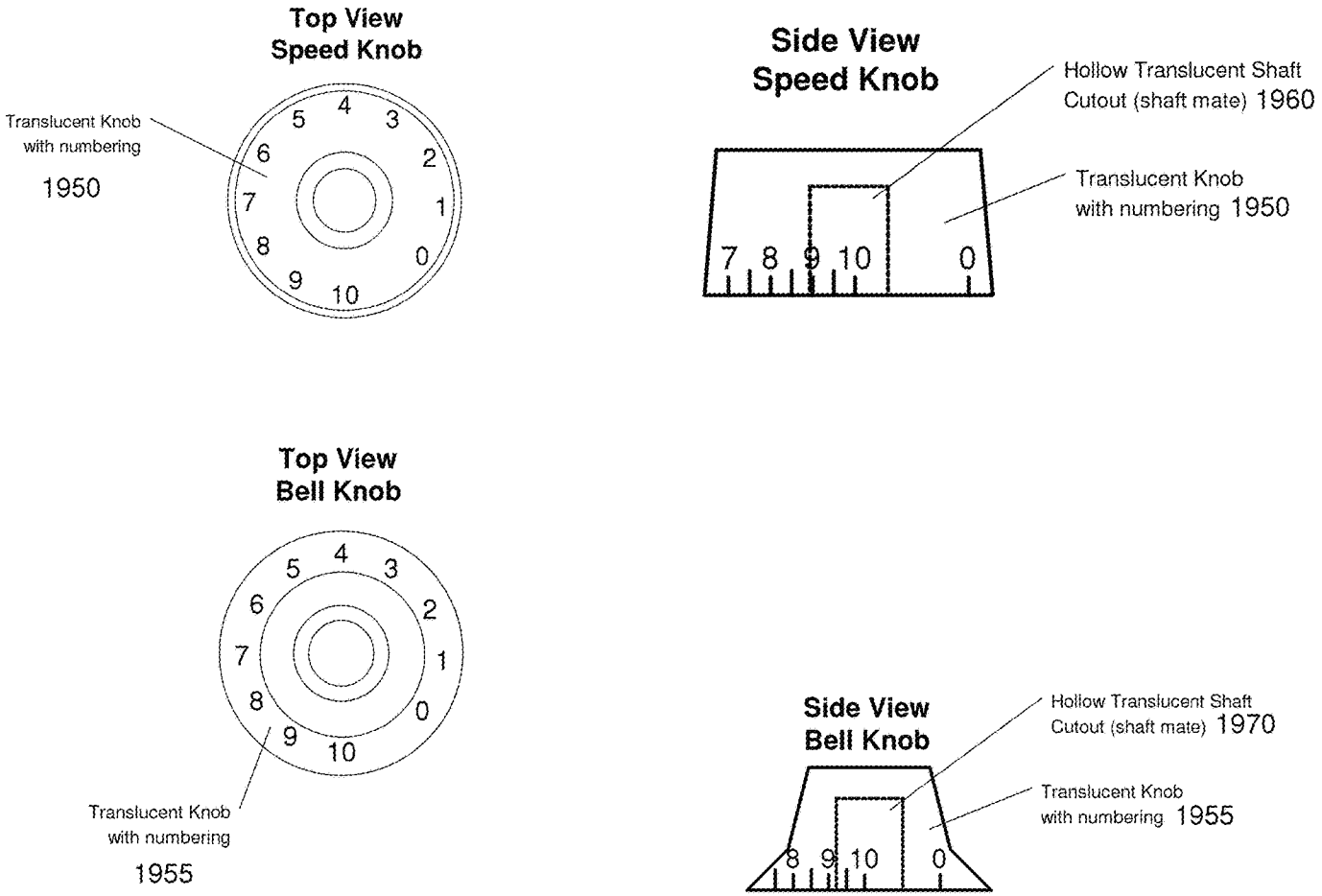
FIG. 21 illustrates exemplary views of transparent control knobs in both "Speed Knob" and "Bell Knob" form used to insert on top of the illuminated POT's shaft according to aspects of the present invention.

FIG. 21 illustrates exemplary views of transparent control knobs in both "Speed Knob" 1950 and "Bell Knob" 1955 form used to insert on top of the illuminated POT's shaft in accordance with aspects of the invention. These transparent, clear or opaque control knobs attach to a potentiometer with a hollow translucent shaft allowing the backlighting to take place according to the present invention. The LED lighting is spread throughout the translucent Bell, Speed or other shaped control knob.

Figure 22:
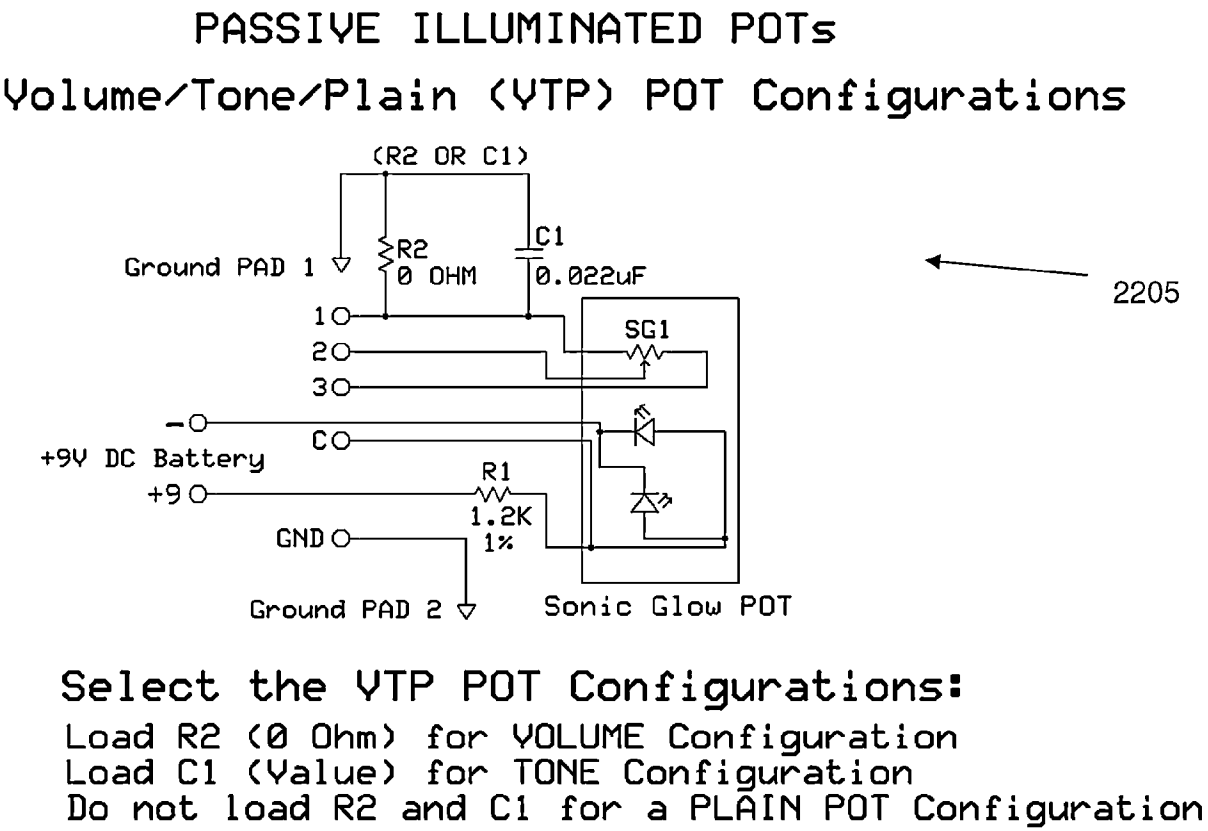
FIG. 22 illustrates an exemplary schematic diagram of the illuminated potentiometer circuitry with passive audio sound pass-through used on a passive illuminated POT PCB according to aspects of the present invention.

FIG. 22 illustrates an exemplary schematic diagram 2205 of the illuminated POT circuitry with passive audio sound pass-through used on a passive illuminated POT PCB (e.g., for a tone or volume control) according to aspects of the present invention. The terminals numbered 1, 2 and 3 are wired for volume or tone applications. By utilizing (e.g., loading) R2, the zero ohm resistor, the POT can become hardwired for a passive volume control. Or, by utilizing C1, the capacitor, the POT can become hardwired for a passive tone control operation. R1 is the current limiting resistor that sets the current flow level of light brightness level into the LEDs. In embodiments, these illuminated POT are designed to operate near 10 volts and illuminate down to about the 2 volt level but at a dimmer state.

Figure 23:
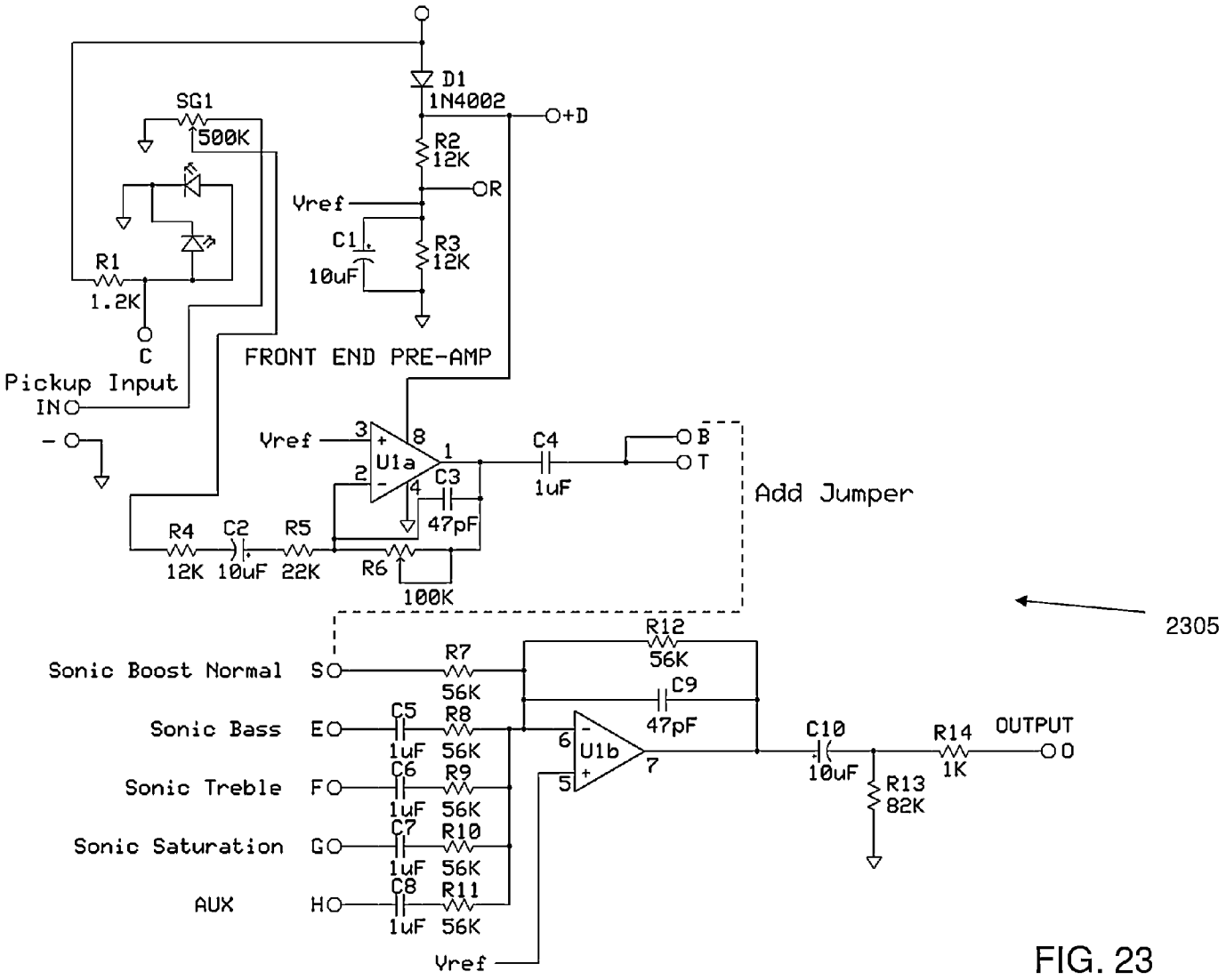
FIG. 23 illustrates an exemplary schematic diagram of the Sonic Glow Boost circuitry with active audio sound used on an active illuminated POT PCB according to aspects of the present invention.

FIG. 23 illustrates an exemplary schematic diagram 2305 of the illuminated Boost circuitry with active audio sound used on an active illuminated POT PCB according to aspects of the present invention. The illuminated Boost POT provides an active solution for "Boosting" the original signal level of an instrument. The gain can be set by adjusting R6 clockwise or counter-clockwise depending on the desired attenuation or gain required by the musician and the style of guitar and pickup type. The five summing amp inputs allow the active illuminated POTs to be added to an instrument and cascaded such that a musician can add an individual illuminated Bass POT, an individual illuminated Treble POT, and individual illuminated saturation or distortion POT and finally an individual illuminated AUX or Middle EQ POT. The active illuminated POT's are designed to be very flexible within the Pickup Director switching system or as a stand alone option to upgrade musical instruments.

Figure 24:
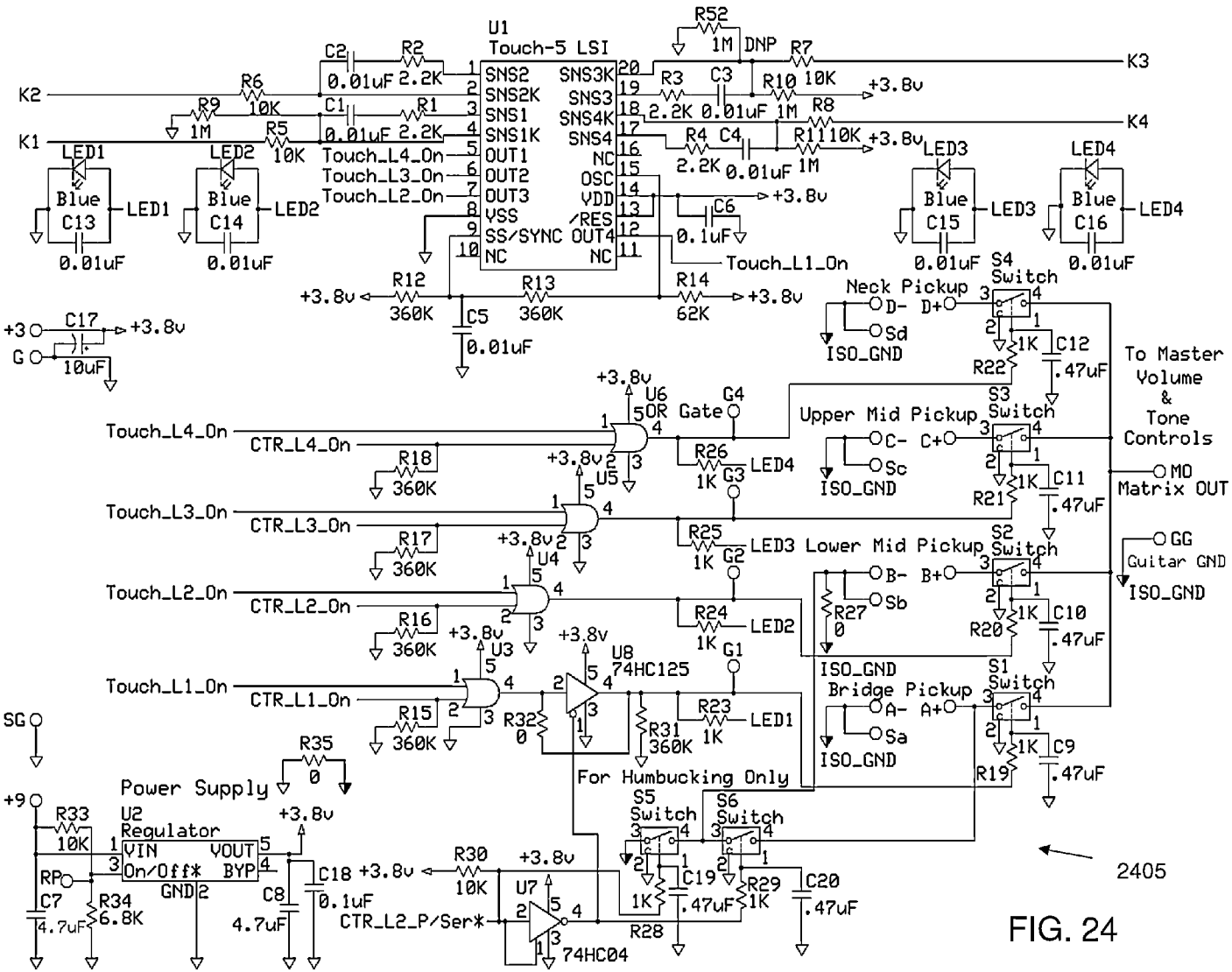
FIG. 24 illustrates an exemplary schematic diagram of an optional touch sensitive control surface and indicator that controls outputs to turn on or off different pickup selections according to aspects of the present invention.

FIG. 24 illustrates an exemplary schematic diagram 2405 of an optional touch sensitive control surface and indicator that controls outputs to turn on or off different pickup selections. Likewise, these outputs can be configured to control other on-board circuitry with the musical instrument. The outputs can also be used in conjunction with a wireless transceiver module that send switch commands wirelessly to a corresponding transceiver on stage to control an amplifier's control modes, effects pedals or other electronics from the musical instrument according to aspects of the present invention.

Figure 25:
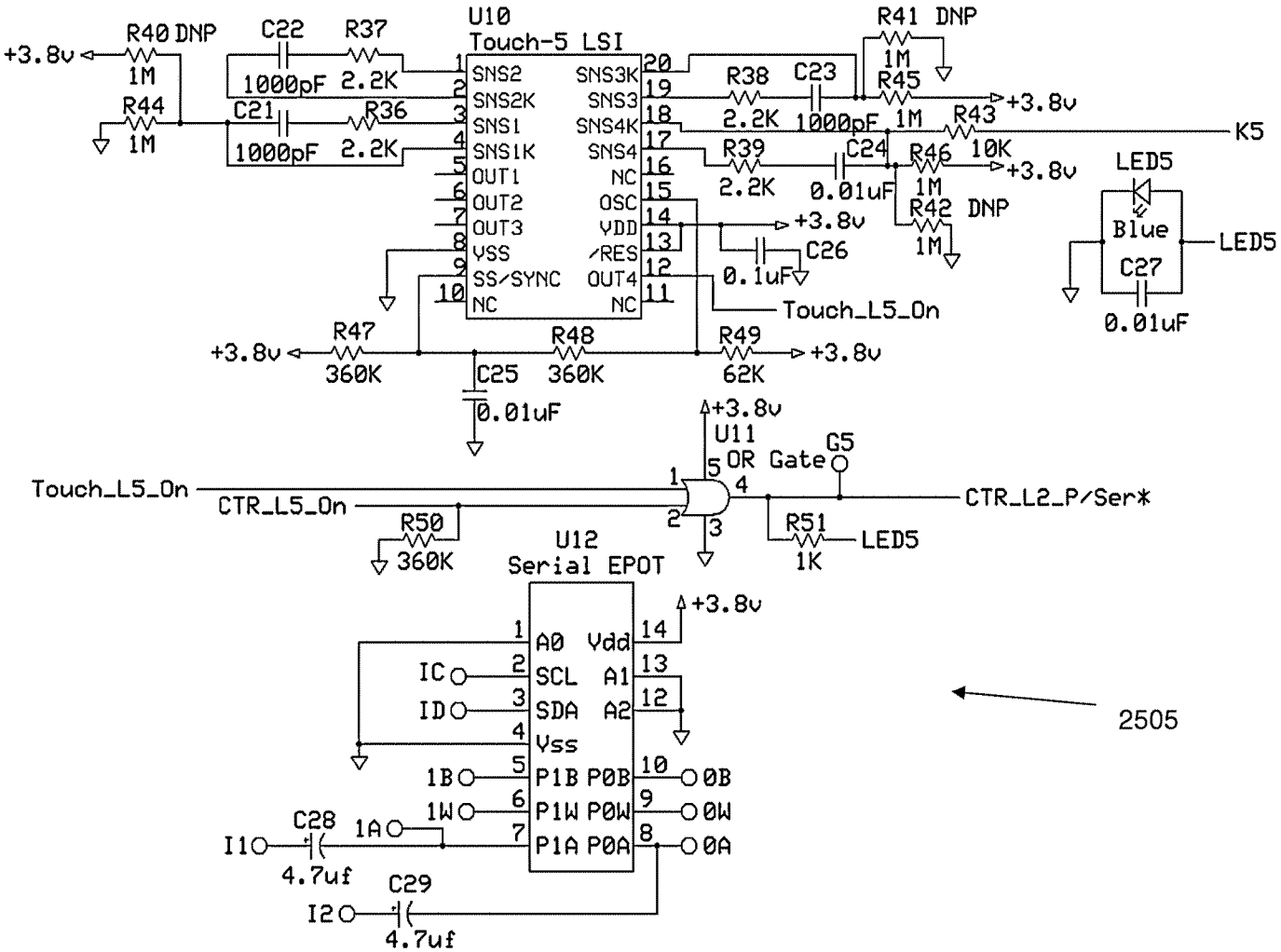
FIG. 25 is the continued exemplary schematic diagram of the optional touch sensitive control surface and indicator shown in FIG. 24 above and according to aspects of the present invention.

FIG. 25 is the continued exemplary schematic diagram 2505 of the optional touch sensitive control surface and indicator shown in FIG. 24 above and according to the present invention. FIG. 25 illustrates the fifth touch control and indicator channel with a two channel electronic pot for programmable tone and brightness level.

Figure 26:
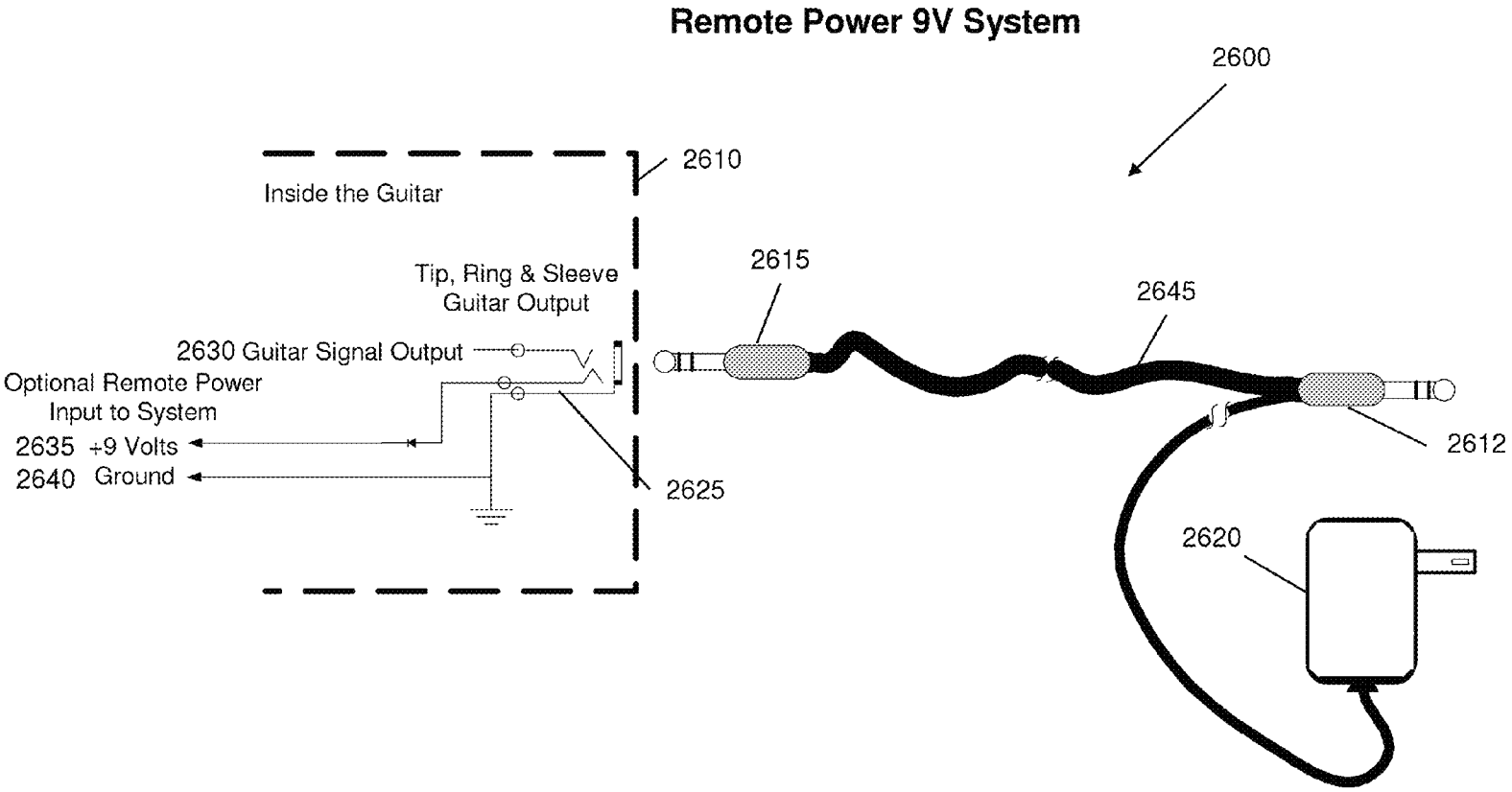
FIG. 26 illustrates an exemplary view of an optional Remote Power System for a musical instrument according to aspects of the present invention.

FIG. 26 illustrates an exemplary view of an optional Remote Power System 2600 for one or more components of a musical instrument (e.g., a pickup controller, an illuminated potentiometer, a touch sensitive system, a display system and/or a preamp) in accordance with aspects of the invention. FIG. 26 illustrates a power adaptor 2620, e.g., a 120V AC to +9V DC adaptor, connected into a quarter inch connection (or plug) 2612, where the +9 volt output is brought out on the "Ring" connector of a "Tip", "Ring" and "Sleeve" (TRS) cable 2645 according to the present invention. With an alternative contemplated embodiment (not shown) the power adaptor 2620 may be a 120V AC to +12V DC power adapter and the plug 2612 may include a micro-sized PCB inside that contains a +12V DC to +9V DC regulator (not shown). In embodiments, the small +12V DC to +9V DC regulator (not shown) may be installed in either end of the Tip, Ring & Sleeve (TRS) connection plug end. Quality three conductor wire then connects to another TRS connector 2615 at the opposite end of the cable 2645 providing via connection jack 2625 in instrument 2610 both a quality audio connection path for a musical instrument sound signal 2630, a quality low noise +9 volt power output 2635 to power electronic circuitry (e.g., a pickup controller, an illuminated potentiometer, a touch sensitive system, a display system and/or a preamp), and a ground 2640 according to aspects of the present invention.

As described above, due to the great number of programmable pickup combinations and configurations, the indication or display systems visually indicates the pickups' on/off status and mode status as series, in parallel or a combination of both series and parallel depending on color. This display systems are done in an elegant manner, and is non-intrusive to the instrument's natural look and appearance.

As described above, in embodiments, the programmable Pickup Director switching system includes a MENU Push/Pull POT control attached to a control logic PCB, a five position blade switch connected to the control logic PCB with a plurality of pickups/transducers connected to the control logic PCB, a micro-sized three position Bank Select Switch connected to the control logic PCB and a display system option using LED's with light pipes for indication of pickup modes and selections, which serves as an entire system for selecting and controlling the many different sounds a plurality of pickups and/or transducers provided within a given musical instrument.

As is the case with many existing switching methods, providing many (more than 10) combinations with respect to the number of coils populated on the instrument of selected pickup sounds is not commonplace. This system not only provides many (for example, in embodiments, up to 49 on board and programmable for up to 140+ other sounds) combinations of the quantity of pickup and transducer sounds, the present invention allows for instant (e.g., real-time) or pseudo random access of these pickup configurations in programmable manners whereby the settings are remembered even after the application of power is removed or if the battery life is exceeded. In other such switching systems the setting of jumpers, dip switches and the like are required and not conducive to a musician's live performance.

The system is designed to be easily operated during a real time performance and user friendly to a musician by using similar switches for which the performer is already familiar. In embodiments, the system can be used in one of two ways. The system can select the many different pickup combinations of, e.g., three or four or five pickups, by the musician rotating the MENU POT while in the up position. This process can be repeated over and over again by the continuous rotation of the MENU POT control.

A second way to use the system is to place the five position blade switch to a particular position, pull up and rotate the MENU POT control until a desired sound or pickup selection is achieved, then push the MENU POT control down to SAVE that particular setting to memory for recall at a later time. The next time the five position switch is returned to this same particular position, the setting is remembered for instant recall. This process can be repeated for each of the five positions offered by the familiar five position blade switch common in the arts, with blade switches having any number of positions contemplated by the invention. Additional BANKS of five position locations can be achieved by moving a three position switch from it's UP position to its next position (center) thereby providing five new locations for access of pickup selections made by turning the Menu POT control. Now the three position switch can then be placed in its DOWN position allowing five more selections to be made and stored to memory for access during a performance. Thus, this exemplary embodiments, achieves fifteen locations to store the different pickup sounds and configurations. With another exemplary embodiment, twenty-five locations can be achieved by replacing the three position switch with an additional five position switch.

Due to the many other styles of electrified musical instruments on the market, the applicability is the same except that implementation and locations of this invention's control methods may be accommodated with even greater ease because of not having to fit into a particular form factor such as the type Stratocaster guitar.

Because the additional amount of pickup combinations may be difficult to remember to the performing musician, all kinds of display methods have been used such as LCD Displays, DOT Matrix type displays and other bulky displays. In the case of this invention, several elegant methods of displaying which pickups are selected are provided for. In this unique approach, transparent screws are used in place of the standard screws for fastening the pickups to the instrument. The screws are functional in three ways: (1) fastening the pickups to the instrument for placement; (2) adjusting the high of the pickup relative to the strings of the instrument for amplitude or output level adjustment; and (3) providing transparency such that an LED from beneath the screw indicates whether a particular pickup is selected or not by the LED being on or off or indicated by a difference in color. Also in embodiments, transparent light pipe inserts may be used in place of screws but located next to a standard mounting screw for an easier installation and production method. The backlit light pipe display allows identification of pickup modes and pickup on/off status.

The programmable pickup and transducer switching system provides a new and useful method for selecting, for example, seven to thirty-seven different pickup selections and is simpler in construction, more universally usable by musicians of all types and more versatile in operation than any known apparatus. Furthermore, the ease of use in the programmable mode of operation, programming the pickups selection and manual mode of operation, a performing musician can adjust while playing the instrument, his/her preferences as they perform live as well as prior to the performance.

Referring to all of the various configurations described above, the transparent screws and associated LEDs can be configured in any color, and can be placed on any side of the associated pickup (e.g., left, right, or both sides), and they can be used whether they are used in a pickup guard plate or no plate at all. Also, the LEDs can also be mounted directly into the pickups and transducers themselves for the indications of which pickups are on or off. The LEDs can also be arranged within the pickup retaining ring that surrounds the pickup or pickups. In embodiments, the display LEDs may also be located by and parallel to the five position blade switch from below the pickguard or wood on the PCB board itself for ease of installation and not require transparent hardware whatsoever. In addition, in embodiments, for example, photovoltaic MOSFETs can be used as the switching elements for the magnetic pickups and/or piezo type transducers. The photovoltaic MOSFETs can be mounted directly into the pickups and transducers themselves for switching the sounds on and off. In addition, linear photo voltaic MOSFETs can be used to control the amplitude (output level) or frequency (tone) of each pickup or piezo element inside the instrument or instruments pickups.

The controls involved in the programmable Pickup Director system can be ergonomically configured in accordance with the desires of the user. Pickups and/or transducers can be associated with any position of a five position or multi-position blade switch, or a three positions blade switch or a GIBSON® style three position switch according to the desires of the user. (Gibson is a trademark of the Gibson Guitar Corp.)

Additionally, in embodiments, musical instruments can be configured with a passive mechanical rotary encoder for selection of multiple pickups or transducers for the selection of sounds or tones produced. The use of the switching system for control of built in digital signal processing effects such as reverb, chorus, distortion, equalization, or external MIDI control functions can be provided via an assignable MIDI output five position switch. Use of the Touch-5 technology in embodiments can be used to control on-board digital signal processing (DSP) preamps for effects at your finger tips, amount of distortion level, equalization of guitar or bass guitar tone controls like bass, middle, treble, piezo bass, piezo middle and piezo treble type controls.

The Pickup Director switching system provides easy selection of multiple pickup or transducer selections not able to be easily selected from before and to provide programmability of a user specified order of selection relevant to a familiar five position control switch that can overcome deficiencies of prior art devices.

In embodiments, the Pickup Director switching system includes a remote power supply system, which allows the system to be remotely powered by a power source outside the instrument and bypass the on board battery (if any). In embodiments, the programmable Pickup Director switching system provides programmable memory that is non-volatile and can retain pre-set data even after the removal of power or if the battery life of a battery is exceeded.

In embodiments, the programmable Pickup Director switching system provides a programmable pickup selection device that can accommodate a plurality of pickups, pickup configurations and transducers on any given musical instrument. In embodiments, the programmable Pickup Director switching system provides a programmable pickup selection device whose integral five position switch and PCB subsystem installs into existing body cavity of type Stratocaster with little or no additional drilling or routing of wood for clearance.

The programmable Pickup Director switching system provides a musician friendly pickup switching device that is also programmable and displays selections for ear training of all new tonalities that is more universally functional in today's market than prior art devices.

The programmable Pickup Director switching system provides programmable configurations that are programmable in real time by the user during a musical performance for the selection of different tonalities, sounds and pickup arrangements not able to be easily selected from on a musical instrument before. By providing a minimal of controls to the instrument, the functionality is user friendly and easy to use in both the programming and playing modes of operation. The programmable Pickup Director switching system resides within an instrument and is interchangeable in many cases with existing switching systems common in the arts, thereby providing ease of installation. The system is applicable to a vast number of musical instruments using magnetic and piezo pickups, and can provide inspiration to musicians and performers by allowing them to express a whole new dimension of sounds from within their new or existing instruments with great ease of use.

Pick-Up Switching System with Push/Pull Pot

The Programmable Pickup Director is a musician's multi-pickup selector that installs into standard Stratocaster and other guitars with 5-Position and 3-Position type switches allowing 15 instant locations to access up to 40+ pickup combinations. The Pickup Director can also be used with standard Gibson type 3-Position selector switches for programmable 3 selections and up to 9 selections using an optional mini 3-position toggle switch. The mini toggle switch is a simple 3-Position toggle switch with the center position as "off" or as typically known as an On-Off-On three position switch. By using the mini toggle switch as a "Bank Select" switch, 9 different pickup selections can be selected from and stored within the switch In accordance with aspects of the invention as discussed further below and with reference to FIG. 2, in embodiments, a dash 1 version is for use with a standard 3 single coil (S/S/S) pickup configuration 205, a dash 2 version is for use with a Hum, Single, Single (H/S/S) pickup configuration 210, a dash 3 version is for use with a Hum, Hum (H/H) configuration 215 or 4 single coil pickup configuration 225 and a dash 4 version is for use with a Hum, Single, Hum (H/S/H) pickup configuration 220. In embodiments, the programmable pickup director may use a standard 5-Position Blade switch for up to 15 instant pickup selections. Additionally, in embodiments, the programmable pickup director system may use a standard 3-Position On-Off-On Mini Toggle switch as a Bank Selection switch. In embodiments, the programmable pickup director may also be used with a standard Witchcraft or other 3-position guitar switch for up to 9 instant pickup selections. With reference to FIG. 1, in embodiments, the programmable pickup director 100 uses a Standard 250K or 500K push/pull potentiometer (or pot) as the push/pull POT 115 for the Main Selector Menu Programmable Pickup Control.

According to an aspect of the invention, pickup selections can be programmed in any order the musician desires. A single switch instantly (e.g., in real time) selects and activates the pre-programmed pickup tonality.

Furthermore, in embodiments, the system supports and uses:

Up to 7 Potentiometers to memorize Active EQ preamp settings for Magnetic and Piezo settings including the Main Selector Menu control.

The pickup director is designed to be very easy to use for live performance and/or for studio applications. The pickup director is also easy to install and will fit into standard STRAT® type guitars without guitar cavity modifications. (Strat is a registered trademarks of Fender Musical Instruments Corporation in the United States and other countries.) In embodiments, there are four versions or dash numbers of Pickup Directors that cover guitars from three single coils to two humbuckers plus a middle single coil pickup configuration. The Pickup Director includes a printed circuit board that accommodates all four dash versions. In embodiments, the pickup director installs with two right angle mounting brackets and included #6 screws that allow the board to mounted using the same two screw holes that hold the original five-position blade switch into the pickguard. With reference to FIG. 3, in embodiments, the pickup director push/pull POT can replace the existing tone control, for example, in a middle position (as shown in FIG. 3), or in the last or furthest position of the guitar. An optional 3-position mini-toggle bank switch 330 can be added to the pick guard to provide the bank select switch function allowing for, with this exemplary embodiment, 3 banks of 5-position blade switch selections for a total of 15 instant pickup selections. By pulling up on the menu push/pull POT 325, the Pickup Director goes into programmable mode and allows the player to audition, for example, 40+ different parallel, series and combos of parallel and series pickup sound selections. Once a player finds a sound they like they simply push the push/pull POT 325 down, and the pickup selection is stored to the position that the 5-position guitar select switch 320 and the bank select switch 330 are in. The selection remains there until the player over writes the selection with a different selected pickup sound. The selections are stored in the processor's non-volatile memory.

The present invention also has the ability to memorize up to eight different potentiometer settings on a guitar or bass with active preamp circuitry. The main menu selection pot can be used to control something else in the system when the push/pull pot is down and not in programming menu mode. In embodiments, the preamp's standard pots can be replaced with electronically controlled pots, e.g., having 10K, 50K or 100K linear resistance values.

With reference to the exemplary and non-limiting embodiment of FIG. 11, in embodiments, the pickup director uses a MICRO-CONTROLLER as the heart of the system. A 44-pin TQFP Surface Mount Technology package is used as a single chip solution for this application. In embodiments, use of the processor's non-volatile memory may be used to store the Master Menu selections and the user selected pickup selections and locations. The serial I2C functionally can be utilized for advanced operations of, for example, active and/or passive pot applications. In embodiments, the Serial UART TTL level Tx and Rx ports can be used for reconfiguring the operation of the Pickup Director by offering a few simple choices for the number of sounds to include, auditioning the different pickup sounds, making the selections and allowing four different ordering of sounds within the Menu selector. For example, the ordering can be from single coil sounds to humbucking sounds, humbucking sounds to single coil sounds, darker tonality sounds to lighter tonality sounds or by lighter tonality sounds to darker tonality sounds.

With reference to the exemplary and non-limiting embodiment of FIG. 11, the following is an exemplary pin for pin hardware functional description of each pin on the processor and describes the details of its operations, use and includes spare I/O pins.

Menu POT

With this exemplary embodiment, the RA1 pin 20 is used to read an analog voltage between 0 volts and 3.3 volts from the wiper of a standard 250K or 500K Push/Pull POT switch called the Menu POT. This Menu POT reads different groupings of windowed voltage ranges based on the total number of pickup selections, e.g., including code that is scalable to read different amounts or groupings of analog voltage readings based from 0 v to 3.3 v dc and dividing up the ranges with hysteresis (15 mV) to assign processor outputs to operate electronic switches connected to the pickups. Examples discussed below show the differences between the -1 and -2 versions of the Pickup Director. This ability is important because -3, -4 versions of Pickup Directors may require other different pickup configurations and the scalable code keeps coding and software changes simple and easy to implement.

Menu Push/Pull Switch

Additionally with this exemplary embodiment, the RB4 pin 14 can be used to detect the Push/Pull switch mechanically connected to the Menu POT to enter into Programming Mode (switch or pot pulled out) or normal Pickup Director operations (switch or pot pushed in). In Programming Mode, the turning of the Menu POT will select the different pickup configurations. The order of selection may be user programmable and, in embodiments, should follow a logical method (e.g., all the single coil sounds first followed by all the series humbucking pickup selection sounds followed by the different single coil and series humbucking combinations together).

Alternatively, the hardware can support the use of RA0 pin 19 via jumpers as the method to enter into Programming Mode with the added ability for an ultra low power wakeup feature to save power. RA0 is otherwise considered a SPARE I/O pin, which can be configured as a spare switch input, spare POT1 input or as a spare output control.

Blade Switch Positions

With this exemplary embodiment, the RB0 pin 8, RB1 pin 9 and RB2 pin 10 are configured as interrupt-on-change input pins used to detect the changing positions of the 5-position blade switch for selecting the different pickup combinations and memory locations. Only one pole of the blade switch is required to detect the changing blade switch positions. The selected switch change takes effect on immediate changing of the switch operation. In embodiments, the other pole may optionally be used for a "dead battery" feature that allowing for a back-up switching mode of a basic guitar switching scheme. This would require a normally closed electronic switch and a control line to implement the feature. For reading the 5-position blade switch and to minimize noise, polling is not preferred and therefore the interrupt-on-change method is very much preferred. FIG. 7 shows an exemplary dual pole 5-position blade switch for reference.

Bank Select Switch

With this exemplary embodiment, the RB6 pin 16 and RB7 pin 17 are configured as interrupt-on-change input pins used to detect the changing positions of a mini 3-position ON-OFF-ON switch for selecting three different "BANKS" of pickup sound memory locations. The Bank Select switch takes effect on immediate changing of the switch operation. When RB6 and RB7 read in as "1" and "0," respectively, this is considered BANK 1 and 5 other locations from the 5-position blade switch can be used to control output lines to the switch matrix for selecting different pickup sounds. When RB6 and RB7 read in as "1" and "1," respectively, this is considered BANK 2 and 5 additional other locations from the 5-position blade switch can be used to control output lines to the switch matrix for selecting different pickup sounds. When RB6 and RB7 read in as "0" and "1," respectively, this is considered BANK 3 and 5 additional locations from the 5-position blade switch for a total of 3 BANKS of 5-position Blade switch settings for 3×5 or 15 locations of preset pickup locations for selecting different pickup sounds from the switch matrix.

Bass POT

With this exemplary embodiment, the RA2 pin 21 is used to read an analog voltage between 0 volts and 3.3 volts from the wiper of a standard POT called the Bass POT. The voltage corresponding to the wiper position of the Bass POT shall be sent out as digital data from the I2C interface of the processor to an I2C non-volatile digital POT for controlling the amount of Bass cut or Bass boost level on a preamp for guitar or bass guitar. In embodiments, the Bass POT is optionally used for magnetic type pickup control on a preamp assembly.

Treble POT

With this exemplary embodiment, the RA3 pin 22 is used to read an analog voltage between 0 volts and 3.3 volts from the wiper of a standard POT called the Treble POT. The voltage corresponding to the wiper position of the Treble POT shall be sent out as digital data from the I2C interface of the processor to an I2C non-volatile digital POT for controlling the amount of Treble cut or Treble boost level on a preamp for guitar or bass guitar. In embodiments, the Treble POT is optionally used for magnetic type pickup control on a preamp assembly.

Middle POT

With this exemplary embodiment, the RA5 pin 24 is used to read an analog voltage between 0 volts and 3.3 volts from the wiper of a standard POT called the Middle POT. The voltage corresponding to the wiper position of the Middle POT shall be sent out as digital data from the I2C interface of the processor to an I2C non-volatile digital POT for controlling the amount of Middle cut or Middle boost level on a preamp for guitar or bass guitar. The Middle POT is used for magnetic type pickup control on a preamp assembly and if no Middle control exists, the input is still active but does nothing and is held in a stable or static condition by the capacitor or can become a SPARE I/O.

Piezo Bass POT

With this exemplary embodiment, the RE0 pin 25 shall be used to read an analog voltage between 0 volts and 3.3 volts from the wiper of a standard POT called the Piezo Bass POT. The voltage corresponding to the wiper position of the Piezo Bass POT shall be sent out as digital data from the I2C interface of the processor to an I2C non-volatile digital POT for controlling the amount of Piezo Bass cut or Piezo Bass boost level on a preamp for guitar or bass guitar. In embodiments, the Piezo Bass POT is optionally used for piezo type pickup control on a preamp assembly.

Piezo Treble POT

With this exemplary embodiment, the RE1 pin 26 is used to read an analog voltage between 0 volts and 3.3 volts from the wiper of a standard POT called the Piezo Treble POT. The voltage corresponding to the wiper position of the Piezo Treble POT shall be sent out as digital data from the I2C interface of the processor to an I2C non-volatile digital POT for controlling the amount of Piezo Treble cut or Piezo Treble boost level on a preamp for guitar or bass guitar. In embodiments, the Piezo Treble POT is optionally used for piezo type pickup control on a preamp assembly.

Piezo Middle POT

With this exemplary embodiment, the RE2 pin 27 is used to read an analog voltage between 0 volts and 3.3 volts from the wiper of a standard POT called the Piezo Middle POT. The voltage corresponding to the wiper position of the Piezo Middle POT shall be sent out as digital data from the I2C interface of the processor to an I2C non-volatile digital POT for controlling the amount of Piezo Middle cut or Piezo Middle boost level on a preamp for guitar or bass guitar. The Piezo Middle POT is used for piezo type pickup control on a preamp assembly and if no Piezo Middle control exists, the input is still active but does nothing and is held in a stable or static condition by the capacitor or can become a SPARE I/O.

Processor Pin Operations for Control (CTR) Outputs

Referring to FIG. 1, and the Pickup Director schematics of the Switch Matrix shown in FIG. 12, shown in the top right of FIG. 12 are exemplary definitions for pickup coils L1 through L5. FIG. 12 shows how all the different configurations of "L" coils can be switched and controlled by the processor to obtain a huge selection of pickup tonal variations.

1. Parallel/Series Pickup Control of Switch Matrix

This section describes exemplary output signals for controlling the parallel or series operations of pickups.

L2 Coil

With continued reference to the exemplary and non-limiting embodiment of FIG. 11, with this exemplary embodiment, the RA4 pin 23 is used as an Active Low output signal named CTR_L2_P/Ser* and is used for controlling the switch matrix. When the signal is asserted Low the switch matrix is connected for the SERIES mode of L2 pickup control operation. The (*) asterisk at the end of the signal name indicates an asserted Low control signal.

L3 Coil

With this exemplary embodiment, the RA6 pin 31 is used as an Active Low output signal named CTR_L3_P/Ser* and is used for controlling the switch matrix. When the signal is asserted Low the switch matrix is connected for the SERIES mode of L3 pickup control operation. The (*) asterisk at the end of the signal name indicates an asserted Low control signal.

L4 Coil

With this exemplary embodiment, the RA7 pin 30 is used as an Active Low output signal named CTR_L4_P/Ser* and is used for controlling the switch matrix. When the signal is asserted Low the switch matrix is connected for the SERIES mode of L4 pickup control operation. The (*) asterisk at the end of the signal name indicates an asserted Low control signal.

L5 Coil

With this exemplary embodiment, the RB3 pin 11 is used as an Active Low output signal named CTR_L5_P/Ser* and is used for controlling the switch matrix. When the signal is asserted Low the switch matrix is connected for the SERIES mode of L5 pickup control operation. The (*) asterisk at the end of the signal name indicates an asserted Low control signal.

2. Master on/Off Pickup Control of Switch Matrix

This section describes exemplary output signals for controlling the main output signals of pickups within the pickup switch matrix.

L1 Coil

With this exemplary embodiment, the RC0 pin 32 is used as an active High output signal named CTR_L1_On and is used for controlling the switch matrix. This signal controls the final output signal of a Single Coil Bridge position pickup (or the single coil portion of a humbucking pickup) of L1 and allows the L1 pickup to be turned on or off. The lack of having an asterisk (*) in the signal name indicates that this is an asserted High control signal.

L2 Coil

With this exemplary embodiment, the RC1 pin 35 is used as an active High output signal named CTR_L2_On and is used for controlling the switch matrix. This signal controls the final output signal of a Humbucking Bridge position pickup (or the single coil portion of a humbucking pickup) of L2 and allows the L2 pickup to be turned on or off. The lack of having an asterisk (*) in the signal name indicates that this is an asserted High control signal.

L3 Coil

With this exemplary embodiment, the RC2 pin 36 is used as an active High output signal named CTR_L3_On and is used for controlling the switch matrix. This signal controls the final output signal of a Single Coil Middle position pickup of L3 and allows the L3 pickup to be turned on or off. The lack of having an asterisk (*) in the signal name indicates that this is an asserted High control signal.

L4 Coil

With this exemplary embodiment, the RC5 pin 43 is used as an active High output signal named CTR_L4_On and is used for controlling the switch matrix. This signal controls the final output signal of a Single Coil Neck position pickup (or the single coil portion of a humbucking pickup) of L4 and allows the L4 pickup to be turned on or off. The lack of having an asterisk (*) in the signal name indicates that this is an asserted High control signal.

L5 Coil

With this exemplary embodiment, the RD6 pin 4 shall is as an active High output signal named CTR_L5_On and is used for controlling the switch matrix. This signal controls the final output signal of a Humbucking Neck position pickup (or the single coil portion of a humbucking pickup) of L5 and allows the L5 pickup to be turned on or off. The lack of having an asterisk (*) in the signal name indicates that this is an asserted High control signal.

3. Series Pickup Configuration Control of Switch Matrix

This section describes exemplary controlling "L" coil signals for various series operation of one pickup with that of another pickup within the pickup switch matrix.

L1 in Series with L3 Coil

With this exemplary embodiment, the RD0 pin 38 is used as an active High output signal named CTR_L1L3_Ser and is used for controlling the switch matrix for SERIES operation of any single coil or humbucking pickup with any other single coil or humbucking pickup elements. The lack of having an asterisk (*) in the signal name indicates that this is an asserted High control signal.

L1 in Series with L4 Coil

With this exemplary embodiment, the RD1 pin 39 is used as an active High output signal named CTR_L1L4_Ser and is used for controlling the switch matrix for SERIES operation of any single coil or humbucking pickup with any other single coil or humbucking pickup elements. The lack of having an asterisk (*) in the signal name indicates that this is an asserted High control signal.

L1 in Series with L5 Coil

With this exemplary embodiment, the RD2 pin 40 is used as an active High output signal named CTR_L1L5_Ser and is used for controlling the switch matrix for SERIES operation of any single coil or humbucking pickup with any other single coil or humbucking pickup elements. The lack of having an asterisk (*) in the signal name indicates that this is an asserted High control signal.

L2 in Series with L4 Coil

With this exemplary embodiment, the RD3 pin 41 is used as an active High output signal named CTR_L2L4_Ser and is used for controlling the switch matrix for SERIES operation of any single coil or humbucking pickup with any other single coil or humbucking pickup elements. The lack of having an asterisk (*) in the signal name indicates that this is an asserted High control signal.

L2 in Series with L5 Coil

With this exemplary embodiment, the RD4 pin 2 is used as an active High output signal named CTR_L2L5_Ser and is used for controlling the switch matrix for SERIES operation of any single coil or humbucking pickup with any other single coil or humbucking pickup elements. The lack of having an asterisk (*) in the signal name indicates that this is an asserted High control signal.

L3 in Series with L5 Coil

With this exemplary embodiment, the RD5 pin 3 is used as an active High output signal named CTR_L3L5_Ser and is used for controlling the switch matrix for SERIES operation of any single coil or humbucking pickup with any other single coil or humbucking pickup elements. The lack of having an asterisk (*) in the signal name indicates that this is an asserted High control signal.

4. Processor Control (CTR) Outputs & Serial Data

RC6 Output

RC6 pin 44 can be used as a Spare Output 1 or for Serial TX Data.

RC7 Output

RC7 pin 1 can be used as a Spare Output 2 or for Serial RX Data.

Spare RD7 Output

RD7 pin 5 can be used as a Spare Output 3 or to drive an additional LED.

5. Serial Data Control in an I2C Format for 7 Digital Control POTs

This portion defines an exemplary I2C allocation for controlling digital POTs.

I2C Serial Clock

With this exemplary embodiment, the RC3 pin 37 is used as an I2C serial Clock line to a digital I2C Control POT.

I2C Serial Data

With this exemplary embodiment, the RC4 pin 42 is used as an I2C serial Data line to a digital I2C Control POT.

6. Serial Data Control in an I2C Format for 2 Seven Segment Digital Displays or LED's This portion defines the I2C allocation for controlling a two digit 7 segment digital LED display. The I2C display chip is a single chip driver device. FIG. 13 illustrates an exemplary schematic for the display.

A brief programming example shows how the driver chip may be used to set the LED's on a display.

```
Program sequence I2C-bus
START S
PCA9532 address with A0 to A2 = LOW C0h
PSC0 subaddress + Auto-Increment 12h
Set prescaler PSC0 to achieve a period of 1 second:
PSC0 = 151
97h
Set PWM0 duty cycle to 50 %:
PWM0 = 128
80h
Set prescaler PCS1 to dim at maximum frequency:
PSC1 = 0
00h
Set PWM1 output duty cycle to 25 %:
PWM1 = 64
40h
Set LED0 to LED3 on 55h
Set LED4 and LED5 to PWM0, and LED6 or LED7 to PWM1 FAh
Set LED8 to LED11 off 00h
Set LED12 to LED15 off 00h
STOP P
```

FIG. 13 shows in more detail how to use this display to drive two 7 segment displays in the I2C Schematic A. With an exemplary embodiment, when incrementing the numbers on the main Pickup Director's menu control, the first fully counter clockwise position (control turned all the way down) shall show a "1" on the two digit display. It will display such that the first digit (left) is blank or not lit up and the second digit (right) displays a "1". As the menu control in increased clockwise, the display increments to "2" and "3" and so on up to "99". Once 99 goes to 100, the decimal point on the first (left) display shall light up indicating the number 100. The decimal dot alone shall indicate the 100. Then the two digit display shall use the decimal dot with "01" to indicate the number 101. This can continue up to the maximum indicated number of 199. I2C Schematic B can be used if the system option is to backlight indicators near the pickups or pickup selector using LED's to indicate series or parallel operation of the pickups. In embodiments, a Blue color indicates parallel wiring while a Red color indicates pickups wired in series just as indicated by the pickup controller interface software, which is a further aspect of the present invention. In embodiments, the pickup controller interface software, discussed below, is a software application, which may be used to program and setup the entire Pickup Director hardware.

7. Serial Programming of the MICRO-CONTROLLER using VB, VCP & USB Cable Driver

Tx Serial Data Output

In embodiments, the Pickup Director uses the 232 type serial UART Tx interface to communicate with a host PC using the Visual Basic application pickup controller interface software. The CTR_Spare_1 (Tx) port is used for the serial transmitter communication.

Rx Serial Data Input

In embodiments, the Pickup Director uses the 232 type serial UART Rx interface to communicate with a host PC using the Visual Basic application pickup controller interface software. The CTR_Spare_2 (Rx) port is used for the serial receiver communication.

LED Menu Knob Indicator

In embodiments, a display using two individual LED's indicates the transition from each voltage range on the main menu POT control. In the case of the -1 configuration with 14 step changes, each alternate step change shall light up a different color LED. This will help the player "see" where the different pickup sounds transition from. The basic LED display shall work going forward and backward and shall be controlled inside the hysteresis points for a clean transition of LED operation.

In embodiments, the CTR_Spare_3 (RD7) and the RB5 or RE3 (Vp) ports could be used to drive the two LED's.

8. Dash 1 Configuration

This section describes a dash 1 configuration for a three single coil pickup type guitar in accordance with aspects of the present invention. This configuration is representative of most standard Strat guitars in the industry without a S1 push on switch. Referring to the below Switch Matrix for a -1 (S/S/S), operations will be described for operating three single coil pickups with the Pickup Director.

The Dash 1 Switch Matrix Schematic

With reference to FIG. 2, this is representative of the simplest form of the switch matrix used for a Single, Single, Single coil (S/S/S) pickup arrangement 205, for example, in a typical STRAT type guitar.

To be compatible with Pickup Director-1, -2, -3 and -4 versions the definitions of pickup coils L1 through L5 include S/S/S, H/S/S, H/H, S/S/S/S and H/S/H type pickup configurations. In this case for a S/S/S, only L1, L3 and L4 represent the 3 single coil pickup type guitar.

Description of a -1 Operation Pickup Director

The -1 operation of the Menu POT selects pickup combinations for a S/S/S setup. In a S/S/S configuration with a Pickup Director, 14 total pickup combinations are possible. The 10 BIT ADC full scale volts per counts are calculated by $2^{10}$ bits=1024−1 for 1023 total counts. At +3.80V DC divided by 1023 full scale counts=3.714 mV per count. The envisioned power supply rail regulated from a +9 V battery is +3.8 V DC. +3.8V DC/14 combinations is 271.4 mV per step change not including a 44.57 mV (12 counts) hysteresis "lock out" between the 12 in-between voltage changes from the menu pot. No hysteresis is required at the full up +3.8V or full down 0V menu pot positions.

The -1 Step Changes when the Menu POT is Pulled Up

Note that positions 1 through 5 are the same as the original standard Strat "hard wired" 5-position blade switch positions.

When the menu pot is turned fully clockwise or all the up, it will see +3.3V DC and shall select the L4 neck single coil pickup alone.

As the menu pot is decreased or turned down (counter-clockwise) to the next lower step change not including hysteresis the L4 and L3 coils in parallel shall be selected.

The next lower step change not including hysteresis shall select the L3 coil alone.

The next lower step change not including hysteresis shall select the L3 and L1 coils in parallel.

The next lower step change not including hysteresis shall select the L1 coil alone.

The next lower step change not including hysteresis shall select the L4 and L1 coils in parallel.

The next lower step change not including hysteresis shall select the L4, L3 and L1 coils in parallel.

The next lower step change not including hysteresis shall select the L3 in series with the L4 coils.

The next lower step change not including hysteresis shall select the L1 in series with the L3 coils.

The next lower step change not including hysteresis shall select the L1 in series with the L4 coils.

The next lower step change not including hysteresis shall select the L1 in series with the L3 in series with the L4 coils.

The next lower step change not including hysteresis shall select the L3 in series with the L4 in parallel with the L1 coils.

The next lower step change not including hysteresis shall select the L1 in series with the L3 in parallel with the L4 coils.

The next and final lowest step change not including hysteresis shall select the L1 in series with the L4 in parallel with the L3 coils.

In keeping with the order of the 14 pickup selections above, Table 3, which is an exemplary Dash 1 table, is shown below that defines all the individual bits from the MICRO-CONTROLLER ports to control the pickup matrix. See the legend below for a description of "series" and "parallel" symbols that decode the dash 1 table.

Legend:

The Symbol "=>" defines pickups wired in series.

The Symbol "//" defines pickups wired in parallel.

TABLE 3

The Dash 1 Table~Single coil parallel, series and parallel/series sounds 3 Single Coils

| Sound | Pickup Coil Configurations This section only is in Gray Code | RA4 | RA6 | RA7 | RB3 | RC0 | RC1 | RC2 | RC5 | RD0 |
|---|---|---|---|---|---|---|---|---|---|---|
| 1 | L4 | 1 | 1 | 1 | 1 | 0 | 0 | 0 | 1 | 0 |
| 2 | L3//L4 | 1 | 1 | 1 | 1 | 0 | 0 | 1 | 1 | 0 |
| 3 | L3 | 1 | 1 | 1 | 1 | 0 | 0 | 1 | 0 | 0 |

TABLE 3-continued

| The Dash 1 Table~Single coil parallel, series and parallel/series sounds 3 Single Coils | | | | | | | | | | |
|---|---|---|---|---|---|---|---|---|---|---|
| 4 | L1//L3 | 1 | 1 | 1 | 1 | 1 | 0 | 1 | 0 | 0 |
| 5 | L1 | 1 | 1 | 1 | 1 | 1 | 0 | 0 | 0 | 0 |
| 6 | L1//L4 | 1 | 1 | 1 | 1 | 1 | 0 | 0 | 1 | 0 |
| 7 | L1//L3//L4 | 1 | 1 | 1 | 1 | 1 | 0 | 1 | 1 | 0 |
| 8 | L3 => L4 | 1 | 1 | 0 | 1 | 0 | 0 | 0 | 1 | 0 |
| 9 | L1 => L3 | 1 | 0 | 1 | 1 | 0 | 0 | 1 | 0 | 1 |
| 10 | L1 => L4 | 1 | 1 | 0 | 1 | 0 | 0 | 0 | 1 | 0 |
| 11 | L1 => L3 | 1 | 0 | 1 | 1 | 0 | 0 | 1 | 0 | 1 |
| 12 | L3 => L4 | 1 | 1 | 0 | 1 | 0 | 0 | 0 | 1 | 0 |
| 13 | L1 => L3//L4 | 1 | 0 | 1 | 1 | 0 | 0 | 1 | 1 | 1 |
| 14 | L1 => L4//L3 | 1 | 1 | 0 | 1 | 0 | 0 | 1 | 1 | 0 |
| Sound | RD1 | RD2 | RD3 | RD4 | RD5 | RD6 | Other | Other | Other | Other |
| 1 | 0 | 0 | 0 | 0 | 0 | 0 | | | | |
| 2 | 0 | 0 | 0 | 0 | 0 | 0 | | | | |
| 3 | 0 | 0 | 0 | 0 | 0 | 0 | | | | |
| 4 | 0 | 0 | 0 | 0 | 0 | 0 | | | | |
| 5 | 0 | 0 | 0 | 0 | 0 | 0 | | | | |
| 6 | 0 | 0 | 0 | 0 | 0 | 0 | | | | |
| 7 | 0 | 0 | 0 | 0 | 0 | 0 | | | | |
| 8 | 0 | 0 | 0 | 0 | 0 | 0 | | | | |
| 9 | 0 | 0 | 0 | 0 | 0 | 0 | | | | |
| 10 | 1 | 0 | 0 | 0 | 0 | 0 | | | | |
| 11 | 0 | 0 | 0 | 0 | 0 | 0 | | | | |
| 12 | 0 | 0 | 0 | 0 | 0 | 0 | | | | |
| 13 | 0 | 0 | 0 | 0 | 0 | 0 | | | | |
| 14 | 1 | 0 | 0 | 0 | 0 | 0 | | | | |

Likewise incrementing the menu pot back up to the +3.8V level, the specified combinations shall take place with the hysteresis acting to eliminate any oscillations between pickup sounds or switch chatter. Moving the menu pot up and down shall operate quickly and smoothly.

Step Changes Menu POT Pushed Down

With this exemplary embodiment, the Menu Pot, while pushed down, does nothing.

Menu POT Save

During the menu push/pull POT selection for programming of the 14 sounds and while the menu pot is pulled up, pushing the menu pot down shall store and save the current selection to the position of the 5-position blade switch and position of the optional 3-position mini toggle "Bank Select" switches.

When the menu pot is down, moving the 5-position blade switch or bank select switch shall recall the programmed selection on-the-fly for a Pickup Director operation of the pickup sounds.

5-Position Blade Switch

The 5-position blade switch is the main switch for selecting pickup sounds. When used with the optional 3-position bank select switch, it allows 5×3 or 15 positions to store or access pickup sounds from. When the menu pot is pulled up/out the programming mode is active and when pushing the menu pot down, the position of the 5-position blade switch is saved. In perform mode when the 5-position blade switch is moved to any new position, the new location shall be is read in and the new sound accessed.

Bank Select Switch

In embodiments, an optional 3-position mini toggle switch (On-Off-On) may be used as a "Bank Select" switch to allow 3×5 or 15 positions to store or access pickup sounds from. When the menu pot is pulled up/out the programming mode is active and when pushing the menu pot down, the position of the bank select switch is saved as well. Like wise, in perform mode when the bank switch is moved to any new position, the new location shall be is read in and the new sound accessed.

A -1 Factory Default Configuration for Pickup Director

An exemplary factory default configuration for a dash 1 Pickup Director can be achieved as follows:

Place the 5-position switch to the Neck position.

Place the bank select switch to the center position.

Pull the menu POT push/pull switch to the up position.

Turn the menu POT to the full clock-wise direction.

Push the menu POT down, wait ~1 sec and pull back up for ~1 sec.

Push the menu POT back to complete the factory default -1 configuration.

With this exemplary embodiment, the above operation will default to the standard Strat type pickup selections for all bank positions.

9. Dash 2 Configuration

With reference to FIG. 2, this section describes an exemplary dash 2 configuration for a two single coil pickup and one humbucking pickup type of guitar. This (H/S/S) configuration 210 is representative of a FAT Strat guitar in the industry without a S1 push on switch. Referring to the below Switch Matrix for a -2 (H/S/S), exemplary operations will be described for operating two single coil pickups and one humbucking pickup with the Pickup Director.

The Dash 2 Switch Matrix Schematic

To be compatible with Pickup Director-1, -2, -3 and -4 versions the definitions of pickup coils L1 through L5 include S/S/S, H/S/S, H/H and H/S/H type pickup configurations. In this case for a H/S/S, L1, L2, L3 and L4 represent a Humbucking pickup in the bridge position with a single coil pickup in the middle position and a single coil pickup in the neck position of a guitar.

Description of a -2 Operation Pickup Director with Hum, Single, Single Pickups

The -2 operation of the Menu POT actually selects pickup combinations for a H/S/S setup (-2), four individual Single Coil pickups and Humbucker/Humbucker pickup configurations (-3). Using Pickup Director, there are a total of 49 in phase sounds available from these three pickup configurations.

The total numbers of sounds are from three groups of wiring configurations. These are coils or pickups wired in parallel, series and parallel/series combinations.

The 10 BIT ADC full scale volts per counts are calculated by $2^{10}$ bits=1024−1 for 1023 total counts. At +3.80V DC divided by 1023 full scale counts=3.714 mV per count. In embodiments, the power supply rail regulated from a +9 V battery is +3.8 V DC. +3.8V DC/14 combinations is 271.4 mV per step change not including a 44.57 mV (12 counts) hysteresis "lock out" between the 12 in-between voltage changes from the menu pot. No hysteresis is required at the full up +3.8V or full down 0V menu pot positions.

The -2 Step Changes when the Menu POT is Pulled Up:

Legend:

The Symbol "=>" defines pickups wired in series.

The Symbol "//" defines pickups wired in parallel.

As shown in Table 4, starting with parallel, 2 coil positions (On/Off) raised to the $4^{th}$ power is 16 combinations including all coils OFF. Table 1 defines all the single coil parallel sounds and indicates the individual bit positions required from each MICRO-CONTROLLER port. Excluding any absence of sound, subtract 1 from the 16 parallel sounds allows for 15 parallel single coil type sounds. There are 15 different parallel pickup sounds available.

TABLE 4

~Single coil parallel sounds using 4 Coils~

| Sound | Pickup Coil Configurations | RA4 | RA6 | RA7 | RB3 | RC0 | RC1 | RC2 | RC5 | RD0 |
|---|---|---|---|---|---|---|---|---|---|---|
| 1 | L1 | 1 | 1 | 1 | 1 | 1 | 0 | 0 | 0 | 0 |
| 2 | L1//L2 | 1 | 1 | 1 | 1 | 1 | 1 | 0 | 0 | 0 |
| 3 | L2 | 1 | 1 | 1 | 1 | 0 | 1 | 0 | 0 | 0 |
| 4 | L2//L3 | 1 | 1 | 1 | 1 | 0 | 1 | 1 | 0 | 0 |
| 5 | L1//L2//L3 | 1 | 1 | 1 | 1 | 1 | 1 | 1 | 0 | 0 |
| 6 | L1//L3 | 1 | 1 | 1 | 1 | 1 | 0 | 1 | 0 | 0 |
| 7 | L3 | 1 | 1 | 1 | 1 | 0 | 0 | 1 | 0 | 0 |
| 8 | L3//L4 | 1 | 1 | 1 | 1 | 0 | 0 | 1 | 1 | 0 |
| 9 | L1//L3//L4 | 1 | 1 | 1 | 1 | 1 | 0 | 1 | 1 | 0 |
| 10 | L1//L2//L3 //L4 | 1 | 1 | 1 | 1 | 1 | 1 | 1 | 1 | 0 |
| 11 | L2//L3//L4 | 1 | 1 | 1 | 1 | 0 | 1 | 1 | 1 | 0 |
| 12 | L2//L4 | 1 | 1 | 1 | 1 | 0 | 1 | 0 | 1 | 0 |
| 13 | L1//L2//L4 | 1 | 1 | 1 | 1 | 1 | 1 | 0 | 1 | 0 |
| 14 | L1//L4 | 1 | 1 | 1 | 1 | 1 | 0 | 0 | 1 | 0 |
| 15 | L4 | 1 | 1 | 1 | 1 | 0 | 0 | 0 | 1 | 0 |

| Sound | RD1 | RD2 | RD3 | RD4 | RD5 | RD6 | Other | Other | Other | Other |
|---|---|---|---|---|---|---|---|---|---|---|
| 1 | 0 | 0 | 0 | 0 | 0 | 0 | | | | |
| 2 | 0 | 0 | 0 | 0 | 0 | 0 | | | | |
| 3 | 0 | 0 | 0 | 0 | 0 | 0 | | | | |
| 4 | 0 | 0 | 0 | 0 | 0 | 0 | | | | |
| 5 | 0 | 0 | 0 | 0 | 0 | 0 | | | | |
| 6 | 0 | 0 | 0 | 0 | 0 | 0 | | | | |
| 7 | 0 | 0 | 0 | 0 | 0 | 0 | | | | |
| 8 | 0 | 0 | 0 | 0 | 0 | 0 | | | | |
| 9 | 0 | 0 | 0 | 0 | 0 | 0 | | | | |
| 10 | 0 | 0 | 0 | 0 | 0 | 0 | | | | |
| 11 | 0 | 0 | 0 | 0 | 0 | 0 | | | | |
| 12 | 0 | 0 | 0 | 0 | 0 | 0 | | | | |
| 13 | 0 | 0 | 0 | 0 | 0 | 0 | | | | |
| 14 | 0 | 0 | 0 | 0 | 0 | 0 | | | | |
| 15 | 0 | 0 | 0 | 0 | 0 | 0 | | | | |

Furthermore, as shown in Tables 5-7, the different Series pickup sounds are defined. Any number of coils; 2, 3 and 4 "In Series" sounds are defined in these tables and provide for the series type or humbucking type pickup sounds. Again, all the individual bit positions are defined for the Pickup Director's matrix. There are 10 different series pickup sounds available.

TABLE 5

~Series sounds using 2 Coils~

| Sound | Pickup Coil Configurations | RA4 | RA6 | RA7 | RB3 | RC0 | RC1 | RC2 | RC5 | RD0 |
|---|---|---|---|---|---|---|---|---|---|---|
| 16 | L1 => L2 | 0 | 1 | 1 | 1 | 0 | 1 | 0 | 0 | 0 |
| 17 | L1 => L3 | 1 | 0 | 1 | 1 | 0 | 0 | 1 | 0 | 1 |
| 18 | L1 => L4 | 1 | 1 | 0 | 1 | 0 | 0 | 0 | 1 | 0 |
| 19 | L2 => L3 | 1 | 0 | 1 | 1 | 0 | 0 | 1 | 0 | 0 |
| 20 | L2 => L4 | 1 | 1 | 0 | 1 | 0 | 0 | 0 | 1 | 0 |
| 21 | L3 => L4 | 1 | 1 | 0 | 1 | 0 | 0 | 0 | 1 | 0 |

TABLE 5-continued

| ~Series sounds using 2 Coils~ | | | | | | | | | | |
|---|---|---|---|---|---|---|---|---|---|---|
| Sound | RD1 | RD2 | RD3 | RD4 | RD5 | RD6 | Other | Other | Other | Other |
| 16 | 0 | 0 | 0 | 0 | 0 | 0 | | | | |
| 17 | 0 | 0 | 0 | 0 | 0 | 0 | | | | |
| 18 | 1 | 0 | 0 | 0 | 0 | 0 | | | | |
| 19 | 0 | 0 | 0 | 0 | 0 | 0 | | | | |
| 20 | 1 | 0 | 0 | 0 | 0 | 0 | | | | |
| 21 | 0 | 0 | 0 | 0 | 0 | 0 | | | | |

TABLE 6

| ~Series sounds using 3 Coils~ | | | | | | | | | | |
|---|---|---|---|---|---|---|---|---|---|---|
| Sound | Pickup Coil Configurations | RA4 | RA6 | RA7 | RB3 | RC0 | RC1 | RC2 | RC5 | RD0 |
| 22 | L1 => L2 => L3 | 0 | 0 | 1 | 1 | 0 | 0 | 1 | 0 | 0 |
| 23 | L1 => L2 => L4 | 0 | 1 | 0 | 1 | 0 | 0 | 0 | 1 | 0 |
| 24 | L1 => L3 => L4 | 1 | 0 | 0 | 1 | 0 | 0 | 0 | 1 | 1 |
| Sound | RD1 | RD2 | RD3 | RD4 | RD5 | RD6 | Other | Other | Other | Other |
| 22 | 0 | 0 | 0 | 0 | 0 | 0 | | | | |
| 23 | 0 | 0 | 1 | 0 | 0 | 0 | | | | |
| 24 | 0 | 0 | 0 | 0 | 0 | 0 | | | | |

TABLE 7

| ~Series sounds using 4 Coils~ | | | | | | | | | | |
|---|---|---|---|---|---|---|---|---|---|---|
| Sound | Pickup Coil Configurations | RA4 | RA6 | RA7 | RB3 | RC0 | RC1 | RC2 | RC5 | RD0 |
| 25 | L1 => L2 => L3 => L4 | 0 | 0 | 0 | 1 | 0 | 0 | 0 | 1 | 0 |
| Sound | RD1 | RD2 | RD3 | RD4 | RD5 | RD6 | Other | Other | Other | Other |
| 25 | 0 | 0 | 0 | 0 | 0 | 0 | | | | |

Finally, the different Parallel/Series pickup combinations sounds are defined in Tables 8 through 19. These tables provide the parallel/series type of pickup sounds available and their respective bit positions from the MICRO-CONTROLLER port hardware. There are 24 different series/parallel pickup sounds available.

TABLE 8

| ~L1 in series L2 (two series coils) plus all others~ | | | | | | | | | | |
|---|---|---|---|---|---|---|---|---|---|---|
| Sound | Pickup Coil Configurations | RA4 | RA6 | RA7 | RB3 | RC0 | RC1 | RC2 | RC5 | RD0 |
| 26 | L1 => L2//L3 | 0 | 1 | 1 | 1 | 0 | 1 | 1 | 0 | 0 |
| 27 | L1 => L2//L4 | 0 | 1 | 1 | 1 | 0 | 1 | 0 | 1 | 0 |
| 28 | L1 => L2//L3//L4 | 0 | 1 | 1 | 1 | 0 | 1 | 1 | 1 | 0 |
| Sound | RD1 | RD2 | RD3 | RD4 | RD5 | RD6 | Other | Other | Other | Other |
| 26 | 0 | 0 | 0 | 0 | 0 | 0 | | | | |
| 27 | 0 | 0 | 0 | 0 | 0 | 0 | | | | |
| 28 | 0 | 0 | 0 | 0 | 0 | 0 | | | | |

TABLE 9

~L1 in series L3 (two series coils) plus all others~

| Sound | Pickup Coil Configurations | RA4 | RA6 | RA7 | RB3 | RC0 | RC1 | RC2 | RC5 | RD0 |
|---|---|---|---|---|---|---|---|---|---|---|
| 29 | L1 => L3//L2 | 1 | 0 | 1 | 1 | 0 | 1 | 1 | 0 | 1 |
| 30 | L1 => L3//L4 | 1 | 0 | 1 | 1 | 0 | 0 | 1 | 1 | 1 |
| 31 | L1 => L3//L2//L4 | 1 | 0 | 1 | 1 | 0 | 1 | 1 | 1 | 1 |

| Sound | RD1 | RD2 | RD3 | RD4 | RD5 | RD6 | Other | Other | Other | Other |
|---|---|---|---|---|---|---|---|---|---|---|
| 29 | 0 | 0 | 0 | 0 | 0 | 0 | | | | |
| 30 | 0 | 0 | 0 | 0 | 0 | 0 | | | | |
| 31 | 0 | 0 | 0 | 0 | 0 | 0 | | | | |

TABLE 10

~L1 in series L4 (two series coils) plus all others~

| Sound | Pickup Coil Configurations | RA4 | RA6 | RA7 | RB3 | RC0 | RC1 | RC2 | RC5 | RD0 |
|---|---|---|---|---|---|---|---|---|---|---|
| 32 | L1 => L4//L2 | 1 | 1 | 0 | 1 | 0 | 1 | 0 | 1 | 0 |
| 33 | L1 => L4//L3 | 1 | 1 | 0 | 1 | 0 | 0 | 1 | 1 | 0 |
| 34 | L1 => L4//L2//L3 | 1 | 1 | 0 | 1 | 0 | 1 | 1 | 1 | 0 |

| Sound | RD1 | RD2 | RD3 | RD4 | RD5 | RD6 | Other | Other | Other | Other |
|---|---|---|---|---|---|---|---|---|---|---|
| 32 | 1 | 0 | 0 | 0 | 0 | 0 | | | | |
| 33 | 1 | 0 | 0 | 0 | 0 | 0 | | | | |
| 34 | 1 | 0 | 0 | 0 | 0 | 0 | | | | |

TABLE 11

~L2 in series L3 (two series coils) plus all others~

| Sound | Pickup Coil Configurations | RA4 | RA6 | RA7 | RB3 | RC0 | RC1 | RC2 | RC5 | RD0 |
|---|---|---|---|---|---|---|---|---|---|---|
| 35 | L2 => L3//L1 | 1 | 0 | 1 | 1 | 1 | 0 | 1 | 0 | 0 |
| 36 | L2 => L3//L4 | 1 | 0 | 1 | 1 | 0 | 0 | 1 | 1 | 0 |
| 37 | L2 => L3//L1//L4 | 1 | 0 | 1 | 1 | 1 | 0 | 1 | 1 | 0 |

| Sound | RD1 | RD2 | RD3 | RD4 | RD5 | RD6 | Other | Other | Other | Other |
|---|---|---|---|---|---|---|---|---|---|---|
| 35 | 0 | 0 | 0 | 0 | 0 | 0 | | | | |
| 36 | 0 | 0 | 0 | 0 | 0 | 0 | | | | |
| 37 | 0 | 0 | 0 | 0 | 0 | 0 | | | | |

TABLE 12

~L2 in series L4 (two series coils) plus all others~

| Sound | Pickup Coil Configurations | RA4 | RA6 | RA7 | RB3 | RC0 | RC1 | RC2 | RC5 | RD0 |
|---|---|---|---|---|---|---|---|---|---|---|
| 38 | L2 => L4//L1 | 1 | 1 | 0 | 1 | 1 | 0 | 0 | 1 | 0 |
| 39 | L2 => L4//L3 | 1 | 1 | 0 | 1 | 0 | 0 | 1 | 1 | 0 |
| 40 | L2 => L4//L1//L3 | 1 | 1 | 0 | 1 | 1 | 0 | 1 | 1 | 0 |

| Sound | RD1 | RD2 | RD3 | RD4 | RD5 | RD6 | Other | Other | Other | Other |
|---|---|---|---|---|---|---|---|---|---|---|
| 38 | 0 | 0 | 1 | 0 | 0 | 0 | | | | |
| 39 | 0 | 0 | 1 | 0 | 0 | 0 | | | | |
| 40 | 0 | 0 | 1 | 0 | 0 | 0 | | | | |

TABLE 13

| ~L3 in series L4 (two series coils) plus all others~ | | | | | | | | | | |
|---|---|---|---|---|---|---|---|---|---|---|
| Sound | Pickup Coil Configurations | RA4 | RA6 | RA7 | RB3 | RC0 | RC1 | RC2 | RC5 | RD0 |
| 41 | L3 => L4//L1 | 1 | 1 | 0 | 1 | 1 | 0 | 0 | 1 | 0 |
| 42 | L3 => L4//L2 | 1 | 1 | 0 | 1 | 0 | 1 | 0 | 1 | 0 |
| 43 | L3 => L4//L1//L2 | 1 | 1 | 0 | 1 | 1 | 1 | 0 | 1 | 0 |

| Sound | RD1 | RD2 | RD3 | RD4 | RD5 | RD6 | Other | Other | Other | Other |
|---|---|---|---|---|---|---|---|---|---|---|
| 41 | 0 | 0 | 0 | 0 | 0 | 0 | | | | |
| 42 | 0 | 0 | 0 | 0 | 0 | 0 | | | | |
| 43 | 0 | 0 | 0 | 0 | 0 | 0 | | | | |

TABLE 14

| ~L1 in series L2 in series L3 (three series coils) plus other~ | | | | | | | | | | |
|---|---|---|---|---|---|---|---|---|---|---|
| Sound | Pickup Coil Configurations | RA4 | RA6 | RA7 | RB3 | RC0 | RC1 | RC2 | RC5 | RD0 |
| 44 | L1 => L2 => L3//L4 | 0 | 0 | 1 | 1 | 0 | 0 | 1 | 1 | 0 |

| Sound | RD1 | RD2 | RD3 | RD4 | RD5 | RD6 | Other | Other | Other | Other |
|---|---|---|---|---|---|---|---|---|---|---|
| 44 | 0 | 0 | 0 | 0 | 0 | 0 | | | | |

TABLE 15

| ~L1 in series L2 in series L4 (three series coils) plus other~ | | | | | | | | | | |
|---|---|---|---|---|---|---|---|---|---|---|
| Sound | Pickup Coil Configurations | RA4 | RA6 | RA7 | RB3 | RC0 | RC1 | RC2 | RC5 | RD0 |
| 45 | L1 => L2 => L4//L3 | 0 | 1 | 0 | 1 | 0 | 0 | 1 | 1 | 0 |

| Sound | RD1 | RD2 | RD3 | RD4 | RD5 | RD6 | Other | Other | Other | Other |
|---|---|---|---|---|---|---|---|---|---|---|
| 45 | 0 | 0 | 1 | 0 | 0 | 0 | | | | |

TABLE 16

| ~L1 in series L3 in series L4 (three series coils) plus other~ | | | | | | | | | | |
|---|---|---|---|---|---|---|---|---|---|---|
| Sound | Pickup Coil Configurations | RA4 | RA6 | RA7 | RB3 | RC0 | RC1 | RC2 | RC5 | RD0 |
| 46 | L1 => L3 => L4//L2 | 1 | 0 | 0 | 1 | 0 | 1 | 0 | 1 | 1 |

| Sound | RD1 | RD2 | RD3 | RD4 | RD5 | RD6 | Other | Other | Other | Other |
|---|---|---|---|---|---|---|---|---|---|---|
| 46 | 0 | 0 | 0 | 0 | 0 | 0 | | | | |

TABLE 17

| ~L1 in series L2 in parallel L3 in series L4 (two & two series coils)~ | | | | | | | | | | |
|---|---|---|---|---|---|---|---|---|---|---|
| Sound | Pickup Coil Configurations | RA4 | RA6 | RA7 | RB3 | RC0 | RC1 | RC2 | RC5 | RD0 |
| 47 | L1 => L2//L3 => L4 | 0 | 1 | 0 | 1 | 0 | 1 | 0 | 1 | 0 |

| Sound | RD1 | RD2 | RD3 | RD4 | RD5 | RD6 | Other | Other | Other | Other |
|---|---|---|---|---|---|---|---|---|---|---|
| 47 | 0 | 0 | 0 | 0 | 0 | 0 | | | | |

TABLE 18

| ~L1 in series L3 in parallel L2 in series L4 (two & two series coils)~ | | | | | | | | | | | |
|---|---|---|---|---|---|---|---|---|---|---|---|
| Sound | Pickup Coil Configurations | | | RA4 | RA6 | RA7 | RB3 | RC0 | RC1 | RC2 | RC5 | RD0 |
| 48 | L1 => L3//L2 => L4 | | | 1 | 0 | 0 | 1 | 0 | 0 | 1 | 1 | 1 |
| Sound | RD1 | RD2 | RD3 | RD4 | RD5 | RD6 | Other | Other | Other | Other | | |
| 48 | 0 | 0 | 1 | 0 | 0 | 0 | | | | | | |

TABLE 19

| ~L1 in series L4 in parallel L2 in series L3 (two & two series coils)~ | | | | | | | | | | | |
|---|---|---|---|---|---|---|---|---|---|---|---|
| Sound | Pickup Coil Configurations | | | RA4 | RA6 | RA7 | RB3 | RC0 | RC1 | RC2 | RC5 | RD0 |
| 49 | L1 => L4//L2 => L3 | | | 1 | 0 | 0 | 1 | 0 | 0 | 1 | 1 | 0 |
| Sound | RD1 | RD2 | RD3 | RD4 | RD5 | RD6 | Other | Other | Other | Other | | |
| 49 | 1 | 0 | 0 | 0 | 0 | 0 | | | | | | |

By incrementing the menu pot back up to the +3.8V level, the specified combinations take place with the hysteresis acting to eliminate any oscillations between pickup sounds or switch chatter. Moving the menu pot up and down shall operate quickly and smoothly.

Step Changes Menu POT Pushed Down

With this exemplary embodiment, the Menu Pot, while pushed down, does nothing.

The Menu POT Save, 5-position Blade Switch and Bank Select Switch all operate in the same manner as described in the -1 configuration.

10. Dash 3 Configuration

With reference to FIG. 2, this section describes an exemplary dash 3 configuration for two humbucking pickups (H/H) 215, one 4-wire humbucking pickup in the bridge position and one 4-wire humbucking pickup in the neck position of a guitar. Also, four individual single coil pickups (S/S/S/S) 225 are supported using this same configuration. This configuration is indicative of a Les Paul or SG type guitar in the industry. Referring to the below Switch Matrix for a -3 (H/H), operations will be described for operating two 4-wire humbucking pickups with the Pickup Director.

The Dash 3 Switch Matrix Schematic

To be compatible with Pickup Director-1, -2, -3 and -4 versions the definitions of pickup coils L1 through L5 include S/S/S, H/S/S, H/H, S/S/S/S and H/S/H type pickup configurations. In this case for a H/H, L1 with L2 represent a Humbucking pickup in the bridge position and L3 with L4 represent a Humbucking pickup in the neck position of a guitar.

Description of a -3 Operation Pickup Director with Hum/Hum or 4 Single Coil Pickups The -3 operation of the Menu POT selects pickup combinations for a H/H setup. In a H/H configuration with a Pickup Director, 49 total pickup combinations are possible. The 10 BIT ADC full scale volts per counts are calculated by $2^{10}$ bits=1024−1 for 1023 total counts. At +3.80V DC divided by 1023 full scale counts=3.714 mV per count. The envisioned power supply rail regulated from a +9 V battery is +3.8 V DC. +3.8V DC/14 combinations is 271.4 mV per step change not including a 44.57 mV (12 counts) hysteresis "lock out" between the 12 in-between voltage changes from the menu pot. No hysteresis is required at the full up +3.8V or full down 0V menu pot positions.

The -3 Step Changes when the Menu POT is Pulled Up

The SAME tables used in the -2 section above (Hum/Single/Single) shall be used for the -3 Pickup Director menu and VB application to operate the hardware matrix.

Incrementing the menu pot back up to the +3.8V level, the specified combinations shall take place with the hysteresis acting to eliminate any oscillations between pickup sounds or switch chatter. Moving the menu pot up and down shall operate quickly and smoothly.

Step Changes Menu POT Pushed Down

With this exemplary embodiment, the Menu Pot, while pushed down, does nothing.

The Menu POT Save, 5-position Blade Switch and Bank Select Switch all operate in the same manner as described above in the -1 configuration.

11. Dash 4 Configuration

With reference to FIG. 2, this section describes an exemplary dash 4 configuration for a humbucking, single coil and humbucking pickup (H/S/H) 220 configuration guitar. A 4-wire humbucking pickup in the bridge position with a single coil pickup in the middle position with another 4-wire humbucking pickup in the neck position of a guitar. This configuration is representative of a Brian Moore type guitar in the industry. Referring to the below Switch Matrix for a -4 (H/S/H), operations will be described for operating two 4-wire humbucking pickups with an additional single coil pickup in the middle position of a guitar using the Pickup Director.

Dash 4 Switch Matrix Schematic

To be compatible with Pickup Director-1, -2, -3 and -4 versions the definitions of pickup coils L1 through L5 include S/S/S, H/S/S, H/H and H/S/H type pickup configurations. In this case for a H/S/H, L1, L2, L3, L4 and L5 represent a 4-wire humbucking pickup in the bridge position with a single coil pickup in the middle position and an additional 4-wire humbucking pickup in the neck position of a guitar.

Description of a -4 Operation Pickup Director with Hum Single Hum Pickups

The -4 operation of the Menu POT selects pickup combinations for a H/S/H setup. In a H/S/H configuration with a Pickup Director, at least 168 pickup combinations are possible. The 10 BIT ADC full scale volts per counts are calculated by $2^{10}$ bits=1024−1 for 1023 total counts. At +3.80V DC divided by 1023 full scale counts=3.714 mV per count. The envisioned power supply rail regulated from a +9 V battery is +3.8 V DC. +3.8V DC/14 combinations is 271.4 mV per step change not including a 44.57 mV (12 counts) hysteresis "lock out" between the 12 in-between voltage changes from the menu pot. No hysteresis is required at the full up +3.8V or full down 0V menu pot positions.

The -4 Step Changes when the Menu POT is Pulled Up

There are at least 168 in phase sounds available from a Hum/Single/Hum pickup configuration. The total numbers of sounds are from three groups of wiring configurations. These are coils or pickups wired in parallel, series and parallel/series combinations.

The 168 definitions are defined in terms of parallel, series and parallel/series table and need conversion to the actual bit level tables as was done for the -1 and -2 pickup configurations.

Legend:

The Symbol "=>" defines pickups wired in series.

The Symbol "//" defines pickups wired in parallel.

As shown in Table 20, starting with parallel, 2 coil positions (On/Off) raised to the $5^{th}$ power is 32 including all coils OFF. Excluding any absence of sound, subtract 1 from the 32 parallel sounds allows for 31 parallel coil type sounds. Table 20 defines the single coil parallel sounds. There are 31 different parallel pickup sounds available.

TABLE 20

~Single coil parallel sounds using 5 Coils~

| Position | Configuration | Number of Coils | Sound Type |
|---|---|---|---|
| 1 | L1 | 5 | Parallel |
| 2 | L1//L2 | 5 | Parallel |
| 3 | L2 | 5 | Parallel |
| 4 | L2//L3 | 5 | Parallel |
| 5 | L1//L2//L3 | 5 | Parallel |
| 6 | L1//L3 | 5 | Parallel |
| 7 | L3 | 5 | Parallel |
| 8 | L3//L4 | 5 | Parallel |
| 9 | L1//L3//L4 | 5 | Parallel |
| 10 | L1//L2//L3//L4 | 5 | Parallel |
| 11 | L2//L3//L4 | 5 | Parallel |
| 12 | L2//L4 | 5 | Parallel |
| 13 | L1//L2//L4 | 5 | Parallel |
| 14 | L1//L4 | 5 | Parallel |
| 15 | L4 | 5 | Parallel |
| 16 | L4//L5 | 5 | Parallel |
| 17 | L1//L4//L5 | 5 | Parallel |
| 18 | L1//L2//L4//L5 | 5 | Parallel |
| 19 | L2//L4//L5 | 5 | Parallel |
| 20 | L2//L3//L4//L5 | 5 | Parallel |
| 21 | L1//L2//L3//L4//L5 | 5 | Parallel |
| 22 | L1//L3//L4//L5 | 5 | Parallel |
| 23 | L3//L4//L5 | 5 | Parallel |
| 24 | L3//L5 | 5 | Parallel |
| 25 | L1//L3//L5 | 5 | Parallel |
| 26 | L1//L2//L3//L5 | 5 | Parallel |
| 27 | L2//L3//L5 | 5 | Parallel |
| 28 | L2//L5 | 5 | Parallel |
| 29 | L1//L2//L5 | 5 | Parallel |
| 30 | L1//L5 | 5 | Parallel |
| 31 | L5 | 5 | Parallel |

All the different Series pickup sounds are defined next. Any number of coils; 2, 3, 4 and 5 "In Series" sounds are defined in Tables 2 through 5 that provide for the series type or humbucking type pickup sounds and configurations. There are 20 different series pickup sounds available.

TABLE 21

~Series sounds using 2 Coils~

| Position | Configuration | Number of Coils | Sound Type |
|---|---|---|---|
| 32 | L1 => L2 | 2 | Series |
| 33 | L1 => L3 | 2 | Series |
| 34 | L1 => L4 | 2 | Series |
| 35 | L1 => L5 | 2 | Series |
| 36 | L2 => L3 | 2 | Series |
| 37 | L2 => L4 | 2 | Series |
| 38 | L2 => L5 | 2 | Series |
| 39 | L3 => L4 | 2 | Series |
| 40 | L3 => L5 | 2 | Series |
| 41 | L4 => L5 | 2 | Series |

TABLE 22

~Series sounds using 3 Coils~

| Position | Configuration | Number of Coils | Sound Type |
|---|---|---|---|
| 42 | L1 => L2 => L3 | 3 | Series |
| 43 | L1 => L2 => L4 | 3 | Series |
| 44 | L1 => L2 => L5 | 3 | Series |
| 45 | L1 => L3 => L4 | 3 | Series |
| 46 | L1 => L3 => L5 | 3 | Series |
| 47 | L1 => L4 => L5 | 3 | Series |

TABLE 23

~Series sounds using 4 Coils~

| Position | Configuration | Number of Coils | Sound Type |
|---|---|---|---|
| 48 | L1 => L2 => L3 => L4 | 4 | Series |
| 49 | L1 => L3 => L4 => L5 | 4 | Series |
| 50 | L2 => L3 => L4 => L5 | 4 | Series |

TABLE 24

~Series sounds using 5 Coils~

| Position | Configuration | Number of Coils | Sound Type |
|---|---|---|---|
| 51 | L1 => L2 => L3 => L4 => L5 | 5 | Series |

Finally, the different Parallel/Series pickup combinations sounds are defined last. Using all 5 coils in different parallel and series combinations are defined in Tables 25 through 69. They provide for the parallel/series type of pickup sounds available. There are about 126+ different series/parallel pickup sounds available.

TABLE 25

~L1 in series L2 (two series coils) plus all others~

| Position | Configuration | Number of Coils | Sound Type |
|---|---|---|---|
| 52 | L1 => L2//L3 | All | Parallel/Series |
| 53 | L1 => L2/L4 | All | Parallel/Series |
| 54 | L1 => L2//L5 | All | Parallel/Series |
| 55 | L1 => L2//L3//L4 | All | Parallel/Series |
| 56 | L1 => L2//L3//L5 | All | Parallel/Series |
| 57 | L1 => L2//L3//L4//L5 | All | Parallel/Series |
| 58 | L1 => L2//L4//L5 | All | Parallel/Series |

TABLE 26

~L1 in series L3 (two series coils) plus all others~

| Position | Configuration | Number of Coils | Sound Type |
|---|---|---|---|
| 59 | L1 => L3//L2 | All | Parallel/Series |
| 60 | L1 => L3//L4 | All | Parallel/Series |
| 61 | L1 => L3//L5 | All | Parallel/Series |
| 62 | L1 => L3//L2//L4 | All | Parallel/Series |
| 63 | L1 => L3//L4//L5 | All | Parallel/Series |
| 64 | L1 => L3//L2//L4//L5 | All | Parallel/Series |
| 65 | L1 => L3//L4//L5 | All | Parallel/Series |

TABLE 27

~L1in series L4 (two series coils) plus all others~

| Position | Configuration | Number of Coils | Sound Type |
|---|---|---|---|
| 66 | L1 => L4//L2 | All | Parallel/Series |
| 67 | L1 => L4//L3 | All | Parallel/Series |
| 68 | L1 => L4//L5 | All | Parallel/Series |
| 69 | L1 => L4//L2//L3 | All | Parallel/Series |
| 70 | L1 => L4//L2//L5 | All | Parallel/Series |
| 71 | L1 => L4//L2//L3//L5 | All | Parallel/Series |
| 72 | L1 => L4//L3//L5 | All | Parallel/Series |

TABLE 28

~L1 in series L5 (two series coils) plus all others~

| Position | Configuration | Number of Coils | Sound Type |
|---|---|---|---|
| 73 | L1 => L5//L2 | All | Parallel/Series |
| 74 | L1 => L5//L3 | All | Parallel/Series |
| 75 | L1 => L5//L4 | All | Parallel/Series |
| 76 | L1 => L5//L2//L3 | All | Parallel/Series |
| 77 | L1 => L5//L2//L5 | All | Parallel/Series |
| 78 | L1 => L5//L2//L3//L4 | All | Parallel/Series |
| 79 | L1 => L5//L3//L4 | All | Parallel/Series |

TABLE 29

~L2 in series L3 (two series coils) plus all others~

| Position | Configuration | Number of Coils | Sound Type |
|---|---|---|---|
| 80 | L2 => L3//L1 | All | Parallel/Series |
| 81 | L2 => L3//L4 | All | Parallel/Series |
| 82 | L2 => L3//L5 | All | Parallel/Series |
| 83 | L2 => L3//L1//L4 | All | Parallel/Series |
| 84 | L2 => L3//L1//L5 | All | Parallel/Series |

TABLE 29-continued

~L2 in series L3 (two series coils) plus all others~

| Position | Configuration | Number of Coils | Sound Type |
|---|---|---|---|
| 85 | L2 => L3//L1//L4//L5 | All | Parallel/Series |
| 86 | L2 => L3//L3//L5 | All | Parallel/Series |

TABLE 30

~L2 in series L4 (two series coils) plus all others~

| Position | Configuration | Number of Coils | Sound Type |
|---|---|---|---|
| 87 | L2 => L4//L1 | All | Parallel/Series |
| 88 | L2 => L4//L3 | All | Parallel/Series |
| 89 | L2 => L4//L5 | All | Parallel/Series |
| 90 | L2 => L4//L1//L3 | All | Parallel/Series |
| 91 | L2 => L4//L1//L5 | All | Parallel/Series |
| 92 | L2 => L4//L1//L3//L5 | All | Parallel/Series |
| 93 | L2 => L4//L3//L5 | All | Parallel/Series |

TABLE 31

~L2 in series L5 (two series coils) plus all others~

| Position | Configuration | Number of Coils | Sound Type |
|---|---|---|---|
| 94 | L2 => L5//L1 | All | Parallel/Series |
| 95 | L2 => L5//L3 | All | Parallel/Series |
| 96 | L2 => L5//L4 | All | Parallel/Series |
| 97 | L2 => L5//L1//L3 | All | Parallel/Series |
| 98 | L2 => L5//L1//L4 | All | Parallel/Series |
| 99 | L2 => L5//L1//L2//L4 | All | Parallel/Series |
| 100 | L2 => L5//L3//L4 | All | Parallel/Series |

TABLE 32

~L3 in series L4 (two series coils) plus all others~

| Position | Configuration | Number of Coils | Sound Type |
|---|---|---|---|
| 101 | L3 => L4//L1 | All | Parallel/Series |
| 102 | L3 => L4//L2 | All | Parallel/Series |
| 103 | L3 => L4//L5 | All | Parallel/Series |
| 104 | L3 => L4//L1//L2 | All | Parallel/Series |
| 105 | L3 => L4//L1//L5 | All | Parallel/Series |
| 106 | L3 => L4//L1//L2//L5 | All | Parallel/Series |
| 107 | L3 => L4//L2//L5 | All | Parallel/Series |

TABLE 33

~L3 in series L5 (two series coils) plus all others~

| Position | Configuration | Number of Coils | Sound Type |
|---|---|---|---|
| 108 | L3 => L5//L1 | All | Parallel/Series |
| 109 | L3 => L5//L2 | All | Parallel/Series |
| 110 | L3 => L5//L4 | All | Parallel/Series |
| 111 | L3 => L5//L1//L2 | All | Parallel/Series |
| 112 | L3 => L5//L1//L4 | All | Parallel/Series |
| 113 | L3 => L5//L1//L2//L4 | All | Parallel/Series |
| 114 | L3 => L5//L2//L4 | All | Parallel/Series |

TABLE 34

~L4 in series L5 (two series coils) plus all others~

| Position | Configuration | Number of Coils | Sound Type |
|---|---|---|---|
| 115 | L4 => L5//L1 | All | Parallel/Series |
| 116 | L4 => L5//L2 | All | Parallel/Series |
| 117 | L4 => L5//L3 | All | Parallel/Series |
| 118 | L4 => L5//L1//L2 | All | Parallel/Series |
| 119 | L4 => L5//L1//L3 | All | Parallel/Series |
| 120 | L4 => L5//L1//L2//L3 | All | Parallel/Series |
| 121 | L4 => L5//L2//L3 | All | Parallel/Series |

TABLE 35

~L1 in series L2 in series L3 (three series coils) plus all others~

| Position | Configuration | Number of Coils | Sound Type |
|---|---|---|---|
| 122 | L1 => L2 => L3//L4 | All | Parallel/Series |
| 123 | L1 => L2 => L3//L5 | All | Parallel/Series |
| 124 | L1 => L2 => L3//L4//L5 | All | Parallel/Series |

TABLE 36

~L1 in series L2 in series L4 (three series coils) plus all others~

| Position | Configuration | Number of Coils | Sound Type |
|---|---|---|---|
| 125 | L1 => L2 => L4//L3 | All | Parallel/Series |
| 126 | L1 => L2 => L4//L5 | All | Parallel/Series |
| 127 | L1 => L2 => L4//L3//L5 | All | Parallel/Series |

TABLE 37

~L1 in series L2 in series L5 (three series coils) plus all others~

| Position | Configuration | Number of Coils | Sound Type |
|---|---|---|---|
| 128 | L1 => L2 => L5//L3 | All | Parallel/Series |
| 129 | L1 => L2 => L5//L4 | All | Parallel/Series |
| 130 | L1 => L2 => L5//L3//L4 | All | Parallel/Series |

TABLE 38

~L1 in series L3 in series L4 (three series coils) plus all others~

| Position | Configuration | Number of Coils | Sound Type |
|---|---|---|---|
| 131 | L1 => L3 => L4//L2 | All | Parallel/Series |
| 132 | L1 => L3 => L4//L5 | All | Parallel/Series |
| 133 | L1 => L3 => L4//L2//L5 | All | Parallel/Series |

TABLE 39

~L1 in series L3 in series L5 (three series coils) plus all others~

| Position | Configuration | Number of Coils | Sound Type |
|---|---|---|---|
| 134 | L1 => L3 => L5//L2 | All | Parallel/Series |
| 135 | L1 => L3 => L5//L4 | All | Parallel/Series |
| 136 | L1 => L3 => L5//L2//L4 | All | Parallel/Series |

TABLE 40

~L1 in series L4 in series L5 (three series coils) plus all others~

| Position | Configuration | Number of Coils | Sound Type |
|---|---|---|---|
| 137 | L1 => L4 => L5//L2 | All | Parallel/Series |
| 138 | L1 => L4 => L5//L3 | All | Parallel/Series |
| 139 | L1 => L4 => L5//L2//L3 | All | Parallel/Series |

TABLE 41

~L1 in series L2 in series L3 in series L4 (four series coils) plus one other~

| Position | Configuration | Number of Coils | Sound Type |
|---|---|---|---|
| 140 | L1 => L2 => L3 => L4//L5 | All | Parallel/Series |

TABLE 42

~L1 in series L3 in series L4 in series L5 (four series coils) plus one other~

| Position | Configuration | Number of Coils | Sound Type |
|---|---|---|---|
| 141 | L1 => L3 => L4 => L5//L2 | All | Parallel/Series |

TABLE 43

~L2 in series L3 in series L4 in series L5 (four series coils) plus one other~

| Position | Configuration | Number of Coils | Sound Type |
|---|---|---|---|
| 142 | L2 => L3 => L4 => L5//L1 | All | Parallel/Series |

TABLE 44

~L1 in series L2 in series L3 in series L4 in series L5 (five series coils)~

| Position | Configuration | Number of Coils | Sound Type |
|---|---|---|---|
| 143 | L1 => L2 => L3 => L4 => L5 | All | ALL/Series |

TABLE 45

~L1 in series L2 in parallel L3 in series L4 (two & two series coils)~

| Position | Configuration | Number of Coils | Sound Type |
|---|---|---|---|
| 144 | L1 => L2//L4 => L5 Must have selection as BMG type | All | Parallel/Series |

TABLE 46

~L1 in series L3 in parallel L2 in series L4 (two & two series coils)~

| Position | Configuration | Number of Coils | Sound Type |
|---|---|---|---|
| 145 | L1 => L2//L3 => L4 | All | Parallel/Series |

TABLE 47

| ~L1 in series L2 in parallel L3 in series L5 (two & two series coils)~ | | | |
|---|---|---|---|
| Position | Configuration | Number of Coils | Sound Type |
| 146 | L1 => L2//L3 => L5 | All | Parallel/Series |

TABLE 48

| ~L1 in series L3 in parallel L2 in series L4 (two & two series coils)~ | | | |
|---|---|---|---|
| Position | Configuration | Number of Coils | Sound Type |
| 147 | L1 => L3//L2 => L4 | All | Parallel/Series |

TABLE 49

| ~L1 in series L3 in parallel L2 in series L5 (two & two series coils)~ | | | |
|---|---|---|---|
| Position | Configuration | Number of Coils | Sound Type |
| 148 | L1 => L3//L2 => L5 | All | Parallel/Series |

TABLE 50

| ~L1 in series L3 in parallel L4 in series L5 (two & two series coils)~ | | | |
|---|---|---|---|
| Position | Configuration | Number of Coils | Sound Type |
| 149 | L1 => L3//L4 => L5 | All | Parallel/Series |

TABLE 51

| ~L1 in series L4 in parallel L2 in series L3 (two & two series coils)~ | | | |
|---|---|---|---|
| Position | Configuration | Number of Coils | Sound Type |
| 150 | L1 => L4//L2 => L3 | All | Parallel/Series |

TABLE 52

| ~L1 in series L4 in parallel L2 in series L5 (two & two series coils)~ | | | |
|---|---|---|---|
| Position | Configuration | Number of Coils | Sound Type |
| 151 | L1 => L4//L2 => L5 | All | Parallel/Series |

TABLE 53

| ~L1 in series L4 in parallel L3 in series L5 (two & two series coils)~ | | | |
|---|---|---|---|
| Position | Configuration | Number of Coils | Sound Type |
| 152 | L1 => L4//L3 => L5 | All | Parallel/Series |

TABLE 54

| ~L1 in series L4 in parallel L3 in series L5 (two & two series coils)~ | | | |
|---|---|---|---|
| Position | Configuration | Number of Coils | Sound Type |
| 153 | L1 => L5//L2 => L3 | All | Parallel/Series |

TABLE 55

| ~L1 in series L4 in parallel L3 in series L5 (two & two series coils)~ | | | |
|---|---|---|---|
| Position | Configuration | Number of Coils | Sound Type |
| 154 | L1 => L5//L2 => L4 | All | Parallel/Series |

TABLE 56

| ~L1 in series L4 in parallel L3 in series L5 (two & two series coils)~ | | | |
|---|---|---|---|
| Position | Configuration | Number of Coils | Sound Type |
| 155 | L1 => L5//L3 => L4 | All | Parallel/Series |

TABLE 57

| ~L1 in series L2 in parallel L3 in series L4 in parallel L3 (two & two series coils+)~ | | | |
|---|---|---|---|
| Position | Configuration | Number of Coils | Sound Type |
| 156 | L1 => L2//L4 => L5//L3 Have selection as BMG type | All | Parallel/Series |

TABLE 58

| ~L1 in series L3 in parallel L2 in series L4 in parallel L5 (two & two series coils+)~ | | | |
|---|---|---|---|
| Position | Configuration | Number of Coils | Sound Type |
| 157 | L1 => L2//L3 => L4//L5 | All | Parallel/Series |

TABLE 59

| ~L1 in series L2 in parallel L3 in series L5 in parallel L4 (two & two series coils+)~ | | | |
|---|---|---|---|
| Position | Configuration | Number of Coils | Sound Type |
| 158 | L1 => L2//L3 => L5//L4 | All | Parallel/Series |

TABLE 60

| ~L1 in series L3 in parallel L2 in series L4 in parallel L5 (two & two series coils+)~ | | | |
|---|---|---|---|
| Position | Configuration | Number of Coils | Sound Type |
| 159 | L1 => L3//L2 => L4//L5 | All | Parallel/Series |

TABLE 61

| ~L1 in series L3 in parallel L2 in series L5 in parallel L4 (two & two series coils+)~ | | | |
|---|---|---|---|
| Position | Configuration | Number of Coils | Sound Type |
| 160 | L1 => L3//L2 => L5//L4 | All | Parallel/Series |

TABLE 62

| ~L1 in series L3 in parallel L4 in series L5 in parallel L2 (two & two series coils+)~ | | | |
|---|---|---|---|
| Position | Configuration | Number of Coils | Sound Type |
| 161 | L1 => L3//L4 => L5//L2 | All | Parallel/Series |

TABLE 63

| ~L1 in series L4 in parallel L2 in series L3 in parallel L5 (two & two series coils+)~ | | | |
|---|---|---|---|
| Position | Configuration | Number of Coils | Sound Type |
| 162 | L1 => L4//L2 => L3//L5 | All | Parallel/Series |

TABLE 64

| ~L1 in series L4 in parallel L2 in series L5 in parallel L2 (two & two series coils+)~ | | | |
|---|---|---|---|
| Position | Configuration | Number of Coils | Sound Type |
| 163 | L1 => L4//L2 => L5//L2 | All | Parallel/Series |

TABLE 65

| ~L1 in series L4 in parallel L3 in series L5 in parallel L2 (two & two series coils+)~ | | | |
|---|---|---|---|
| Position | Configuration | Number of Coils | Sound Type |
| 164 | L1 => L4//L3 => L5//L2 | All | Parallel/Series |

TABLE 66

| ~Lx in series Lx in parallel Lx in series Lx in parallel Lx (two & two series coils+)~ | | | |
|---|---|---|---|
| Position | Configuration | Number of Coils | Sound Type |
| 165 | L1 => L5//L2 => L3//L4 | All | Parallel/Series |

TABLE 67

| ~Lx in series Lx in parallel Lx in series Lx in parallel Lx (two & two series coils+)~ | | | |
|---|---|---|---|
| Position | Configuration | Number of Coils | Sound Type |
| 166 | L1 => L5//L3 => L4//L5 | All | Parallel/Series |

TABLE 68

| ~Lx in series Lx in parallel Lx in series Lx in parallel Lx (two & two series coils+)~ | | | |
|---|---|---|---|
| Position | Configuration | Number of Coils | Sound Type |
| 167 | L1 => L5//L2 => L4//L4 | All | Parallel/Series |

TABLE 69

| ~Lx in series Lx in parallel Lx in series Lx in parallel Lx (two & two series coils+)~ | | | |
|---|---|---|---|
| Position | Configuration | Number of Coils | Sound Type |
| 168 | L1 => L2 => L3//L4 => L5 | All | Parallel/Series |

168/3 or around 56 positions per bank select when in menu switch mode.

Incrementing the menu pot back up to the +3.8V level, the specified combinations shall take place with the hysteresis acting to eliminate any oscillations between pickup sounds or switch chatter. Moving the menu pot up and down shall operate quickly and smoothly.

Step Changes Menu POT Pushed Down

With this exemplary embodiment, the Menu Pot, while pushed down, does nothing.

The Menu POT Save, 5-position Blade Switch and Bank Select Switch all operate in the same manner as described in the -1 configuration.

While the invention has been described with references to its preferred embodiments, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

I claim:

1. An illuminated potentiometer assembly configured as at least one of a volume control knob and a tone control knob, comprising:

a potentiometer;

a translucent shaft extending from the potentiometer;

at least one light emitting diode (LED); and a control knob affixed to the translucent shaft extending from the potentiometer, so as to be rotatable with the translucent shaft, such that rotation of the control knob directly actuates the potentiometer via the translucent shaft, wherein the at least one LED is structured and arranged to project illumination via the translucent shaft to the control knob to illuminate the control knob, and wherein the control knob is completely translucent.

2. The illuminated potentiometer assembly of claim 1, wherein the potentiometer is configured as a passive controller.

3. The illuminated potentiometer assembly of claim 1, wherein the potentiometer is configured as an active controller.

4. An illuminated potentiometer assembly, comprising:

a potentiometer;

a translucent shaft extending from the potentiometer;

at least one illumination source; and a control knob affixed to the translucent shaft extending from the potentiometer, so as to be rotatable with the translucent shaft, such that rotation of the control knob directly actuates the potentiometer via the translucent shaft, wherein the at least one illumination source is structured and arranged to project illumination via the translucent shaft to the control knob to illuminate the control knob, and wherein the control knob is completely translucent.

5. The illuminated potentiometer assembly of claim 4, wherein the illuminated potentiometer assembly is arranged on a musical instrument.

6. The illuminated potentiometer assembly of claim 4, wherein the illuminated potentiometer assembly is arranged on a musical instrument effect device.

7. The illuminated potentiometer assembly of claim 4, wherein the illuminated potentiometer assembly is arranged on a musical instrument amplifier.

8. The illuminated potentiometer assembly of claim 4, wherein the at least one illumination source is structured and arranged to backlight the translucent shaft directly.

9. The illuminated potentiometer assembly of claim 4, wherein the at least one illumination source is structured and arranged to light the translucent shaft indirectly.

10. The illuminated potentiometer assembly of claim 4, wherein the at least one illumination source comprises a plurality of differently colored illumination sources.

11. The illuminated potentiometer assembly of claim 4, wherein the at least one illumination source is axially aligned with a longitudinal axis of the translucent shaft.

12. The illuminated potentiometer assembly of claim 4, further comprising a printed circuit board, wherein the at least one illumination source is arranged on the printed circuit board.

13. The illuminated potentiometer assembly of claim 4, wherein the translucent shaft is a hollow shaft, the assembly further comprising at least one illumination source mounting arranged within the hollow shaft, wherein the at least one illumination source is arranged on the at least one illumination source mounting.

14. The illuminated potentiometer assembly of claim 13, further comprising a main printed circuit board, wherein the at least one illumination source mounting comprises a second printed circuit board in contact with and arranged approximately perpendicularly to the main printed circuit board.

15. The illuminated potentiometer assembly of claim 4, wherein the at least one illumination source comprises at least one light emitting diode (LED).

16. The illuminated potentiometer assembly of claim 4, wherein the potentiometer is arranged between the at least illumination source and the control knob.

17. An illuminated potentiometer assembly, comprising:

a potentiometer;

a translucent shaft extending from the potentiometer;

at least one illumination source; and an actuatable end of the translucent shaft extending from the potentiometer, so as to be rotatable with the translucent shaft, such that rotation of the actuatable end of the shaft directly actuates the potentiometer via the translucent shaft, wherein the at least one illumination source is structured and arranged to project illumination via the translucent shaft to the actuatable end of the translucent shaft to illuminate the actuatable end of the translucent shaft, wherein the actuatable end is completely translucent.

* * * * *